US009200390B2

(12) United States Patent
Kimura et al.

(10) Patent No.: US 9,200,390 B2
(45) Date of Patent: Dec. 1, 2015

(54) BUFFER SUBSTRATE AND USE THEREOF

(75) Inventors: Tomoaki Kimura, Okayama (JP); Toru Ochiai, Okayama (JP); Sumito Kiyooka, Okayama (JP); Satoshi Koizumi, Okayama (JP); Kazuhiro Muraki, Tokyo (JP)

(73) Assignee: Kuraray Co., Ltd., Kurashiki-shi (JP)

( * ) Notice: Subject to any disclaimer, the term of this patent is extended or adjusted under 35 U.S.C. 154(b) by 796 days.

(21) Appl. No.: 12/675,536

(22) PCT Filed: Aug. 27, 2008

(86) PCT No.: PCT/JP2008/065321

§ 371 (c)(1),
(2), (4) Date: Feb. 26, 2010

(87) PCT Pub. No.: WO2009/028564

PCT Pub. Date: Mar. 5, 2009

(65) Prior Publication Data

US 2010/0203788 A1 Aug. 12, 2010

(30) Foreign Application Priority Data

| | | |
|---|---|---|
| Aug. 31, 2007 | (JP) | 2007-226555 |
| Aug. 31, 2007 | (JP) | 2007-226556 |
| Dec. 21, 2007 | (JP) | 2007-330170 |
| Feb. 29, 2008 | (JP) | 2008-050238 |
| Mar. 28, 2008 | (JP) | 2008-088622 |

(51) Int. Cl.
*D04H 3/00* (2012.01)
*D04H 1/00* (2006.01)
(Continued)

(52) U.S. Cl.
CPC ..... *D04H 1/005* (2013.01); *D04H 1/5405* (2013.01); *D04H 1/74* (2013.01); *D04H 13/007* (2013.01); *Y10T 156/10* (2015.01); *Y10T 442/60* (2015.04)

(58) Field of Classification Search
CPC ..... D04H 1/005; D04H 13/007; D04H 1/74; D04H 1/5405; Y10T 156/10; Y10T 442/60
USPC ..... 442/352, 353, 356, 359, 361
See application file for complete search history.

(56) References Cited

U.S. PATENT DOCUMENTS

| | | | |
|---|---|---|---|
| 5,141,805 | A | 8/1992 | Nohara et al. |
| 5,569,525 | A | 10/1996 | Masuda et al. |

(Continued)

FOREIGN PATENT DOCUMENTS

| | | |
|---|---|---|
| EP | 0 371 807 A2 | 6/1990 |
| EP | 0 371 807 A3 | 6/1990 |

(Continued)

OTHER PUBLICATIONS

Supplementary Search Report issued Feb. 28, 2011 in European Patent Application No. 08828230.6-1217 / 2184391.

*Primary Examiner* — Jeremy R Pierce
(74) *Attorney, Agent, or Firm* — Oblon, McClelland, Maier & Neustadt, L.L.P.

(57) ABSTRACT

In a nonwoven fiber assembly which comprises a fiber comprising a thermal adhesive fiber under moisture and in which the fiber are entangled with each other, the fibers are bonded at contacting points of the fibers by melting the thermal adhesive fiber under moisture to distribute the bonded points approximately uniformly, thereby obtaining a buffer substrate. The buffer substrate may further comprises a conjugated fiber comprising a plurality of resins which are different in thermal shrinkage and form a phase separation structure, and the conjugated fibers may have an approximately uniform crimps having an average curvature radius of 20 to 200 μm and are entangled with the fibers constituting the nonwoven fiber assembly. The buffer substrate can be obtained by a method comprising the steps of: forming a web from the fiber comprising the thermal adhesive fiber under moisture; and subjecting the obtained fiber web to a heat and moisture treatment with a high-temperature water vapor to melt the thermal adhesive fiber under moisture for bonding the fibers. The buffer substrate has a high air-permeability, an excellent cushion property and softness.

16 Claims, 2 Drawing Sheets

(51) Int. Cl.

| | |
|---|---|
| ***D04H 1/54*** | (2012.01) |
| ***D04H 1/74*** | (2006.01) |
| ***D04H 13/00*** | (2006.01) |

(56) References Cited

U.S. PATENT DOCUMENTS

| | | | | |
|---|---|---|---|---|
| 8,518,841 | B2 * | 8/2013 | Kimura et al. | 442/353 |
| 2002/0114913 | A1 * | 8/2002 | Weinstein et al. | 428/371 |
| 2004/0116027 | A1 * | 6/2004 | Termonia et al. | 442/353 |
| 2004/0254555 | A1 * | 12/2004 | Wang et al. | 604/385.01 |
| 2009/0130939 | A1 * | 5/2009 | Kimura et al. | 442/364 |
| 2010/0035500 | A1 * | 2/2010 | Kimura et al. | 442/353 |

FOREIGN PATENT DOCUMENTS

| | | | |
|---|---|---|---|
| EP | 0 625 603 | A1 | 11/1994 |
| JP | 61 132664 | | 6/1986 |
| JP | 63 235558 | | 9/1988 |
| JP | 2-154050 | | 6/1990 |
| JP | 5 161765 | | 6/1993 |
| JP | 6-146148 | | 5/1994 |
| JP | 8 851 | | 1/1996 |
| JP | 2000 166606 | | 6/2000 |
| JP | 2002 223807 | | 8/2002 |
| JP | 2003 250666 | | 9/2003 |
| JP | 2003 293255 | | 10/2003 |
| JP | 2003 342864 | | 12/2003 |
| JP | 2004 41384 | | 2/2004 |
| JP | 2004 124266 | | 4/2004 |
| JP | 2004 300593 | | 10/2004 |
| WO | 91 19032 | | 12/1991 |
| WO | WO 2007116676 | A1 * | 10/2007 |
| WO | WO 2008015972 | A1 * | 2/2008 |
| WO | 2008 108295 | | 9/2008 |

* cited by examiner

BUFFER SUBSTRATE AND USE THEREOF

TECHNICAL FIELD

The present invention relates to a substrate which is for a buffer member (or cushioning material) and has a high air-permeability, an excellent cushion property and softness. The present invention also relates to a method for producing the buffer substrate (or buffer member substrate) and a use thereof (for example, a buffer member of a furniture, a bedding, a vehicle, a clothing, a footwear or the like).

BACKGROUND ART

A foamed urethane or a fiber assembly has been used as a cushion of a furniture, a bedding, a vehicle or the like, or as a buffer member of a clothing, a footwear or the like [e.g., a brassiere cup or a substrate thereof, a shoulder pad, and a substrate for a shoe insole (a sockliner or a shoe insert)]. For some applications, the foamed urethane is excessively elastic and poorly permeable to air, and its texture (hand or handle) is insufficient. In an application to be worn, particularly, the foamed urethane causes an uncomfortable humid state. Therefore, the fiber assembly has been used in an application which highly requires an excellent or soft texture or air-permeability. The fiber assembly, however, has drawbacks (e.g., a falling off of fibers and an insufficient cushion property or shape (configuration) stability). To overcome these drawbacks, a buffer member or the like comprising various fiber assemblies has been developed. The fiber assembly comprises a fiber web comprising a thermal adhesive component mixed in the web, and the fibers constituting the web are immobilized or fixed to each other by heating the fiber web from a surface thereof.

For example, Japanese Patent Application Laid-Open Publication No. 5-161765 (Patent Document 1) discloses a cushion comprising a fiber assembly comprising a highly crimped fiber having a number of crimps of not less than 50/25 mm and a degree of crimp of not less than 40%; and a sheath-core structure thermal adhesive fiber. The cushion has a structure formed by bonding the crimped fibers partly to each other with the sheath-core structure thermal adhesive fiber; and has a thickness of not less than 5 mm and a basic weight of not less than 200 g/m$^2$. This document describes that a resin having a melting point lower than that of a core component (e.g., a resin component such as a polyester copolymer, a polyamide, or a polyolefine) is used as a sheath component of the sheath-core structure thermal adhesive fiber. In Examples of the document, a sheath-core structure fiber comprising an isophthalic acid-modified poly(ethylene terephthalate) as a sheath component is used and subjected to a heat treatment at 155° C. for 3 minutes.

Moreover, Japanese Patent Application Laid-Open Publication No. 8-851 (Patent Document 2) discloses a fiber-based wadding material comprising a structure comprising a crimped fiber which comprises an inelastic thermoplastic resin and has a fineness of 1 to 10 denier and a three-dimensional crimp owing to its latent ability of developing the crimp; and a thermal adhesive conjugated (or composite) fiber which comprises an elastic thermoplastic resin as a thermal adhesive component and has a fineness of 1 to 6 denier. The structure is three-dimensionally formed by opening and blending the crimped fiber and the thermal adhesive conjugated fiber to entangle the crimped fibers with each other or the crimped fiber with the adhesive fiber due to the three-dimensional crimping; and melting the adhesive fibers to integrate the adhesive fibers with each other or the adhesive fiber with the crimped fiber at most of the contacting points of these fibers. Both surfaces of the structure are substantially flat or plane, and the structure has a thickness of 1 to 30 mm; and an apparent density of 0.01 to 0.10 g/cm$^3$. The elastic thermoplastic resin component shows an endothermic peak ranging from a room temperature to the melting point in a melting curve measured by a differential scanning calorimeter. This document discloses that, in a heat treatment at a temperature 10 to 40° C. higher than the melting point of the thermal adhesive component, the temperature rise process allows the fiber which has not yet developed a crimp to develop a fine, three-dimensional crimp to entangle the fibers with each other due to the three-dimensional crimping; and the heat treatment allows most of the contacting points of the thermal adhesive conjugated fiber with the fibers to form a thermally bonded point or area comprising the thermoplastic elastic resin by melting the thermal adhesive component. Specifically, in Examples, a mixture of the fibers is heat-treated with a hot air having a temperature of 200° C. for 5 minutes.

However, since a large adiathermancy of the mixed web seems to hinder a uniform heat conduction to the inside of the web, the above cushion wadding material or the cushion has neither a uniform percentage of crimp of the crimped fiber nor a uniform bonded ratio of the sheath-core structure thermal adhesive fiber in the thickness direction. Thus, the cushion or cushion wadding material has a poor cushion property and shape stability, and the falling off of the fibers is not effectively prevented.

Japanese Patent Application Laid-Open Publication No. 2003-293255 (Patent Document 3) discloses a needle-punched nonwoven fabric comprising a staple fiber. The staple fiber comprises a potential crimping polyester fiber which comprises two kinds of poly(trimethylene terephthalate)s having a difference in intrinsic viscosity of 0.05 to 0.4 (dl/g) therebetween and conjugated in a side-by-side structure. However, since the fibers are not fixed to each other or to other fibers at the intersecting or contacting points with an adhesive component, the nonwoven fabric has a low configuration stability and the fiber greatly falls off.

Further, Japanese Patent Application Laid-Open Publication No. 2003-342864 (Patent Document 4) discloses a cushion structure which comprises a conjugated staple fiber comprising a fiber-forming polyester polymer and a thermoplastic elastomer forming at least part of a surface of the conjugated staple fiber. The cushion structure has a density of 0.005 to 0.15 g/cm$^3$ and a thickness of not less than 5 mm. In the cushion structure, the conjugated staple fibers are thermally bonded to each other at the intersecting points thereof to distribute the thermally bonded points sporadically. Additionally, the cushion structure has an impact resilience of not less than 50%, a hardness at 25% compression of not more than 300 N, and a strain due to durability to compression of not more than 13%. This document also discloses that a dry-heat treatment is preferred and conducted at a temperature 10 to 80° C. higher than the melting point of the thermoplastic elastomer to thermally melt-bond the conjugated staple fibers to each others. However, the cushion structure still has a poor cushion property and shape stability, and the falling off of the fiber cannot effectively be prevented.

Moreover, as for a cushion used for a seat of a vehicle, a train, an aircraft, or the like, Japanese Patent Application Laid-Open Publication No. 2003-250666 (Patent Document 5) discloses a resin molded product having a spring structure comprising at least two sheets having the same or different spring property. The resin molded product comprises a solid-core and/or hollow continuous filament (s) comprising at least a thermoplastic resin; and/or a solid-core and/or hollow short filament(s) comprising at least a thermoplastic resin. The continuous filament and the short filament have a random loop or curl. The resin molded product has a three-dimensional structure having a predetermined bulkiness and voids and formed by contacting and entangling the loop or curl filaments adjacent to each other to aggregate the filaments. The document discloses that the filament used for the molded product is obtained by forming a filament having a fineness of 0.3 to 3.0 mm from a mixture of a polyolefinic resin and a vinyl acetate resin, a vinyl acetate-ethylene copolymer or a styrene-butadiene-styrene copolymer; forming a loop having a diameter of 1 to 10 mm; and bringing the fibers into contact and entangling the fibers with each other. However, this cushion has an insufficient cushion property due to a large loop diameter and has a difficulty in a meticulous control of cushion property due to a large fineness.

Further, International Publication WO 91/19032 (Patent Document 6) discloses a cushion structure which comprises an inelastic polyol-series crimped staple fiber assembly as a matrix and has a density of 0.005 to 0.10 g/cm$^3$ and a thickness of not less than 5 mm. The staple fiber assembly comprises an elastic conjugated fiber dispersed and mixed therein. The elastic conjugated fiber comprises an inelastic polyester and a thermoplastic elastomer which has a melting point 40° C. lower or more than 40° C. lower than that of a polyester polymer constituting the staple fiber, and the thermoplastic elastomer forms at least part of a surface of the conjugated fiber, and these fibers are thermally melt-bonded to each other at an intersected state. This document discloses that the conjugated fiber is treated with a hot water having a temperature of 95° C. to develop a crimp; a web comprising the crimped fiber is subjected to a heat treatment with a metal mold at 200° C. for 10 minutes to melt-bond the fibers to each other. However, this cushion structure deforms at a low temperature, and the fibers are easily separated or loosed at the intersecting points thereof. Additionally, neither the distribution of crimp nor bond of the fibers in the thickness direction is uniform. Therefore, the cushion structure has a low cushion property and form or shape retention property.

Moreover, a brassiere cup is a buffer member to be disposed in a brassiere in order to keep or retain the form or shape of the brassiere or the form of the breast. The brassiere cup widely used includes a sewn cup or a molded cup. This brassiere cup requires a soft or excellent texture, air-permeability for avoiding humidity, or the like, in addition to softness or elasticity, and form or shape retention property.

A brassiere cup satisfying those requirements is disclosed in, for example, Japanese Patent Application Laid-Open Publication No. 2004-124266 (Patent Document 7). The document suggests a substrate for a brassiere cup, comprising a fiber web and a thermosetting resin. The fiber web comprises a conjugated fiber at least in 30% by mass, and the conjugated fiber comprises a poly(ethylene terephthalate) or polycarbonate copolymer resin component and a poly(butylene terephthalate) copolymer resin component. The fibers are bonded with the thermosetting resin, and the mass of the thermosetting resin is 0.25 to 2 times as much as that of the fiber web. This document discloses a method comprising the steps of entangling the conjugated fibers with each other by a needle-punching; spraying, impregnating, or coating the resulting web with a thermosetting resin as a binder; and curing the binder. Alternatively, the document discloses a method comprising the steps of entangling the conjugated fibers having a spiral crimp with each other by a needle-punching; spraying, impregnating, or coating the resulting web with a thermosetting resin as a binder; and curing the binder.

However, in the substrate sprayed or coated with the binder, the bonded area of the fibers tends to concentrate on the substrate surface, thereby the shape retention property of the substrate is not sufficient. On the other hand, for the substrate impregnated with the binder, the fiber has an excessively large bonded area, leading to a decrease in cushion property. Additionally, in this substrate, the potential crimping fiber is heated to develop a crimp by a common manner used in the step of curing the binder. Therefore, the degrees of the crimps in the surface and inside of the substrate are not uniform, resulting in lowering the cushion property. The use of the crimped fiber provides a less fiber entanglement due to the crimped fiber, and the fibers and crimped fibers are intertwined or entangled with each other by a needle-punching. In this case, recoverability or shape retention property is decreased.

Further, Japanese Patent Application Laid-Open Publication No. 2004-300593 (Patent Document 8) suggests a substrate for a brassiere cup, comprising a fiber web. The fiber web comprises a thermal adhesive fiber comprising at least a polyester obtained by copolymerization of a caprolactone as a constituent component; a potential crimping fiber having a melting point higher than the adhesion temperature of the thermal adhesive fiber; and other fiber(s) having a melting point higher than the adhesion temperature of the thermal adhesive fiber. In the fiber web, and the adhesive fiber, the crimping fiber, and other fiber(s) are contained in a ratio of 10 to 50% by mass, 20 to 90% by mass, and 0 to 70% by mass, respectively, and the fibers are intertwined with each other by a needle-punching. For this substrate, the thermal adhesive fiber is melted to lose its fiber form, and the potential crimping fiber is heated at 170° C. (that is, dry heated) to develop a crimp.

However, since the crimp of the fiber is ununiform in the inside the substrate, the substrate has an insufficient cushion property. Moreover, since in the inside of the substrate, neither the melt-bonding of the thermal adhesive fiber due to the dry-heating nor the entanglement of the fibers by the needle-punching is uniform, the shape retention property and cushion property of the substrate are decreased.

A shoe insole usually has a laminated structure comprising a single- or multi-layer sheet (or sheet-like matter). For example, Japanese Patent Application Laid-Open Publication No. 2004-41384 (Patent Document 9) discloses a shoe insole obtained by laminating a surface fabric or cloth, a lining fabric or cloth, and a single- or multi-layer intermediate sheet therebetween; and fusing the resulting laminate in a shape of a shoe insole by conducting a high-frequency current through the laminate and simultaneously bonding a peripheral area of the laminate. As mentioned above, a known shoe insole includes a shoe insole in which a filler comprising a single- or multi-layer fabric is disposed by between outer surface materials (such as a fabric or cloth) and a peripheral area of the filler to those of outer surface materials. Since such a shoe insole usually comprises a fiber, the shoe insole has an air-permeability and tends to prevent or suppress a foot bottom from becoming humid. Additionally, in order to increase the cushion property, a thermally contractive fiber is sometimes used for the filler.

However, since the filler is fixed only at its peripheral area, the strength of the shoe insole is insufficient. Moreover, it is difficult to form a shoe insole to fit to a shape or configuration of a foot bottom. Further, in order to improve the strength, the filler may be bonded with an adhesive to the outer surface materials. However, in this case, the air-permeability of the shoe insole is decreased.

In order to obtain air-permeability, cushion properties, fitness, Japanese Patent Application Laid-Open Publication No. 2002-223807 (Patent Document 10) suggests a fiber structure for a shoe insole, comprising a supporting layer; a fiber layer comprising a fiber upstanding or extruding from a surface of the supporting layer. The fiber structure comprises an adhesive crimped fiber having a percentage of crimp of not less than 5% in a ratio of not less than 20% by mass. The fiber layer comprises a melt-bonded layer formed by a thermally bonding of the adhesive crimped fibers; and a bulky layer which is highly bulky and disposed on the melt-bonded layer so as to form a surface of the fiber structure. This document discloses that a fiber structure comprising the adhesive crimped fiber comprising an ethylene-vinyl alcohol-series copolymer is sprayed with water from a surface adjacent to the supporting layer; and the resulting fiber structure is subjected to a heat treatment to immobilize a bottom area of the bulky fiber with the melt-bonded layer comprising the melt-bonding fiber and allow the bulky fiber to be upstanding, thereby forming the bulky layer.

However, this fiber structure requires to make the bulky layer thin in order to maintain the fiber-upstanding structure, and the fiber upstanding from the melt-bonded layer easily falls off. Therefore, the cushion property or (mechanical) strength tends to decrease.

In order to improve fitness to a foot bottom and air-permeability, a manner to contrive a structure of a shoe insole, for example, a structure or mechanism for introducing air to an inside of a shoe by attaching an air pump to a bottom of the shoe is suggested. Japanese Patent Application Laid-Open Publication No. 2000-166606 (Patent Document 11) suggests a ventilating member for a shoe sole. The ventilating member comprises a sheet comprising a polymeric elastic body or substance and a housing frame disposed on a surface of the sheet and having a peripheral area having a uniform height. In the ventilating member, the sheet surface in or within the housing frame is provided with a plurality of through-holes; a mesh sheet and water-proof air-permeable sheet are successively intruded or inserted in the housing frame; and the peripheral area of the housing frame is sealed.

However, since the insole having such a mechanism or structure is complicated, the insole requires an intricate production step(s) and readily breaks. Additionally, due to the low air-permeability of the insole, even an introduction of air to the insole tends to fail to prevent humidity at a sole of a foot (or a foot bottom).

Moreover, Japanese Patent Application Laid-Open Publication No. 63-235558 (Patent Document 12) discloses a thermally bonded nonwoven fabric under moisture obtained by spraying water on or to a web containing a conjugated fiber comprising an ethylene-vinyl alcohol copolymer and other thermoplastic resins; and heating the resulting web with a heating roller.

However, this nonwoven fabric has an ununiform distribution of bond of the fibers in the thickness direction of the nonwoven fabric and a low cushion property.

[Patent Document 1] JP-5-161765 (Claim 1, Paragraph No. [0011], and Examples)

[Patent Document 2] JP-8-851 (Claims 1 and 6 and Examples)

[Patent Document 3] JP-2003-293255 (Claim 1)

[Patent Document 4] JP-2003-342864 (Claim 1, Paragraph Nos. [0033] and [0034], and Examples)

[Patent Document 5] JP-2003-250666 (Claim 1, Paragraph Nos. [0001], [0012] to [0015], and [0046] to [0048])

[Patent Document 6] WO91/19032 (Claim 1, Page 6, upper right column, lines 24 to 26, and Examples)

[Patent Document 7] JP-2004-124266 (Claims 1 to 4, Paragraph No. [0027], and Examples)

[Patent Document 8] JP-2004-300593 (Claim 1, Paragraph No. [0044], and Examples)

[Patent Document 9] JP-2004-41384 (Claim 1)

[Patent Document 10] JP-2002-223807 (Claims)

[Patent Document 11] JP-2000-166606 (Claim 1)

[Patent Document 12] JP-63-235558 (Claim 1 and Examples)

DISCLOSURE OF THE INVENTION

Problems to be Solved by the Invention

It is therefore an object of the present invention to provide a buffer substrate having a high air-permeability, an excellent cushion property and softness; a method for producing the substrate; and a use thereof (e.g., a cushion of a furniture, a bedding, a vehicle or the like, and a buffer member of a clothing, a footwear or the like).

Another object of the present invention is to provide a buffer substrate, being prevented from falling off of fibers and having an excellent shape or configuration stability (retention property); a method for producing the substrate; and a use thereof.

A further object of the present invention is to provide a buffer substrate, having an excellent cushion property and air-permeability, and a high compression recovery ratio and being suitable for a buffer member of a seat of a vehicle (such as an automobile); a method for producing the substrate; and a cushion.

Another object of the present invention is to provide a buffer substrate, having an excellent texture, a low skin irritation, a high water absorption property, and a durability to washing, and being suitable for a substrate for a brassiere cup; a method for producing the substrate; and a brassiere cup comprising the substrate.

Still another object of the present invention is to provide a buffer substrate, having a strength (or mechanical strength), lightness in weight, an excellent fitness to a foot, and being suitable for a substrate for a shoe insole; a method for producing the substrate; and a shoe insole comprising the substrate.

Another object of the present invention is to provide a substrate having a high moldability and conformability with a metal mold, and being suitable for a buffer member (such as a substrate for a brassiere cup or a shoe insole); a method for producing the substrate; and a cushion.

Means to Solve the Problems

The inventors of the present invention made intensive studies to achieve the above objects and finally found that a web in which fibers comprises a thermal adhesive fiber under moisture and are entangled or intertwined with each other is treated with a high-temperature water vapor (steam) to melt-bond the fibers to each other with the thermal adhesive fiber under moisture, thereby producing a buffer substrate having a high air-permeability in addition to an excellent cushion property and softness.

That is, the buffer substrate (or buffer member substrate) of the present invention comprises a nonwoven fiber assembly which comprises a fiber comprising a thermal adhesive fiber under moisture (or moistenable-thermal adhesive fiber, moistenable adhesive fiber under heat, or adhesive fiber under heat and moisture) and in which the fibers constituting the nonwoven fiber assembly are entangled with each other and bonded at contacting points by melting the thermal adhesive fiber under moisture to distribute the bonded points approximately uniformly. In this buffer substrate, the nonwoven fiber assembly may further comprise a conjugated (or composite) fiber comprising a plurality of resins which are different in thermal shrinkage and form a phase separation structure, and the conjugated fibers may have an approximately uniform crimps having an average curvature radius of 20 to 200 μm and be entangled with the fibers constituting the nonwoven fiber assembly. As used herein, "approximately uniform" with respect to the distribution of the bonded points of the fibers means that the bonded fiber ratio (ratio of bonded fiber) is 1 to 45% in each of three areas and the proportion of the minimum value relative to the maximum value among the bonded fiber ratios in each of the three areas is not less than 50%, providing that the three areas are obtained by cutting the buffer substrate (nonwoven fiber assembly) in the thickness direction to give a cross section and dividing the cross section in a direction perpendicular to the thickness direction equally into three. Moreover, "approximately uniform" with respect to the crimps of the fibers means that the curved ratio of the conjugated fiber (curvature ratio of the conjugated fiber) is not less than 1.3 in each of three areas and the proportion of the minimum value relative to the maximum value among the curved ratios in each of the three areas is not less than 75%, providing that the three areas are obtained by cutting the buffer substrate (nonwoven fiber assembly) in the thickness direction to give a cross section and dividing the cross section in a direction perpendicular to the thickness direction equally into three. The thermal adhesive fiber under moisture may be a sheath-core structure conjugated fiber which comprises a sheath comprising an ethylene-vinyl alcohol-series copolymer and a core comprising a polyester-series resin. The conjugated fiber may comprise a poly(alkylene arylate)-series resin and a modified poly(alkylene arylate)-series resin and have a side-by-side structure or an eccentric sheath-core structure. The proportion (mass ratio) of the thermal adhesive fiber under moisture relative to the conjugated fiber [the former/the latter] is about 90/10 to 10/90. The buffer substrate of the present invention may have an apparent density of about 0.01 to 0.2 g/cm$^3$. Further, the buffer substrate may have an air-permeability of about 0.1 to 300 cm$^3$/(cm$^2$·second) in accordance with a Frazier tester method. Moreover, in a 50% compression and recovery behavior in accordance with JIS K6400-2, the buffer substrate may have a ratio of a 25% compression stress in the recovery behavior relative to a 25% compression stress in the compression behavior of not less than 10%. Additionally, the buffer substrate may have a sheet- or plate-like form and an approximately uniform thickness. Further, in the buffer substrate of the present invention, the fibers may be oriented in a direction approximately parallel to a surface direction of the buffer substrate. Moreover, the nonwoven fiber assembly having such a fiber orientation may have a plurality of areas containing a large amount of the fibers oriented in the thickness direction of the buffer substrate, and the plurality of areas may be arranged regularly in the surface direction of the buffer substrate. Each of the areas may have a hole. The nonwoven fiber assembly having such a regular fiber orientation is suitable as a substrate to be subjected a secondary molding with respect to various buffer members (or cushioning materials).

The present invention also includes a method for producing a buffer substrate comprising the steps of: forming a web from a fiber comprising a thermal adhesive fiber under moisture; and subjecting the obtained fiber web to a heat and moisture treatment (thermal and moisture treatment or heating and humidifying treatment) with a high-temperature water vapor to melt the thermal adhesive fiber under moisture for bonding the fibers. In the method, after a step of subjecting a plurality of regularly arranged areas of a surface of the fiber web to a treatment to change the orientation directions of the fibers, the web may be subjected to the heat and moisture treatment. The production method of the present invention may comprise the steps of: forming a web from a fiber comprising a thermal adhesive fiber under moisture and a conjugated fiber comprising a plurality of resins which are different in thermal shrinkage and form a phase separation structure; and subjecting the obtained fiber web to a heat and moisture treatment with a high-temperature water vapor to melt the thermal adhesive fiber under moisture for bonding the fibers and to form or develop a crimp of the conjugated fiber.

Additionally, the buffer substrate of the present invention may be a substrate for a cushion (or cushion member). This substrate may be a seat cushion (or seat cushion member) for a vehicle and have an apparent density of 0.02 to 0.2 g/cm$^3$ and a compression recovery ratio of not less than 60%. The nonwoven fiber assembly of the substrate may comprise a conjugated fiber and have a proportion (mass ratio) of the thermal adhesive fiber under moisture relative to the conjugated fiber [the former/the latter] of 90/10 to 40/60 and a bonded fiber ratio of 3 to 30% in each of three areas, providing that the three areas are obtained by cutting the nonwoven fiber assembly in the thickness direction to give a cross section and dividing the cross section in a direction perpendicular to the thickness direction equally into three.

Further, the buffer substrate of the present invention may be a substrate for a brassiere cup. This buffer substrate may have an apparent density of 0.01 to 0.15 g/cm$^3$, a ratio of a 25% compression stress in the recovery behavior relative to a 25% compression stress in the compression behavior of not less than 20% in a 50% compression and recovery behavior in accordance with JIS K6400-2, and a bonded fiber ratio of 1 to 25% in each of three areas, providing that the three areas are obtained by cutting the buffer substrate in the thickness direction to give a cross section and dividing the cross section in a direction perpendicular to the thickness direction equally into three. Additionally, the nonwoven fiber assembly of the substrate may comprise a conjugated fiber and have a proportion (mass ratio) of the thermal adhesive fiber under moisture relative to the conjugated fiber [the former/the latter] of about 40/60 to 10/90. The present invention includes a brassiere cup comprising this buffer substrate.

Further, the buffer substrate of the present invention may be a substrate for a shoe insole. This substrate may have an apparent density of 0.03 to 0.20 g/cm$^3$, a ratio of a 25% compression stress in the recovery behavior relative to a 25% compression stress in the compression behavior of not less than 15% in a 50% compression and recovery behavior in accordance with JIS K6400-2, and a bonded fiber ratio of 4 to 35% in each of three areas, providing that the three areas are obtained by cutting the buffer substrate in the thickness direction to give a cross section and dividing the cross section in a direction perpendicular to the thickness direction equally into three. The substrate having such properties has softness while ensuring a cushion property to conform with a strong impact. Moreover, the combination of the crimps of the conjugated fiber with the thermal adhesive fiber under moisture imparts a cushion property to absorb a weaker impact sensitively and flexibly to the substrate. The present invention includes a shoe insole comprising this buffer substrate.

Furthermore, the present invention includes a method for producing a buffer member, comprising thermoforming the buffer substrate into a predetermined shape or form. In this method, it is preferred that the buffer substrate be pressed with supplying a high-temperature water vapor to the buffer substrate.

As used herein the term "buffer member" means a material or member which is for protecting an object (such as a body, a machine or equipment, or a building) and mitigates a shock by absorbing an energy generated by an impact or load; and encompasses a cushion or protective member. The buffer member may usually be formed by subjecting a buffer substrate to a secondary molding by a machine process or thermoforming. The buffer member may be a molded product by itself or may be part of a molded product.

Effects of the Invention

Since in the inside of the fiber assembly the fibers constituting the fiber assembly are uniformly melt-bonded with a thermal adhesive fiber under moisture, the buffer substrate of the present invention has a cushion property in spite of the fiber assembly having a nonwoven structure. Moreover, the above substrate further comprises a specific conjugated fiber having a phase separation structure. In the inside of the fiber assembly, the conjugated fiber is uniformly crimped to entangle the fibers constituting the fiber assembly, resulting in providing the fiber assembly with a high air-permeability, an excellent cushion property, and a superb softness. Moreover, although in the substrate the fibers constituting the fiber assembly are melt-bonded at a small area or spot, the fibers are efficiently fixed due to the entanglement of the conjugated fibers and the uniform melt-bond of the thermal adhesive fiber under moisture. Therefore, the falling off of the fibers is suppressed, and the substrate has an excellent shape stability (retention property). For that reason, the substrate of the present invention is suitable for a buffer member of a furniture, a bedding, a vehicle, a clothing, a footwear or the like.

In particular, since a large proportion of the thermal adhesive fiber under moisture can achieve a high compression recovery ratio together with an excellent cushion property and air-permeability, the substrate is suitable for a seat cushion of a vehicle such as an automobile. Moreover, since the buffer substrate of the present invention has an excellent moldability, the substrate can be used as a substrate for various protective members. In particular, since the substrate of the present invention has an excellent texture, a low skin irritation, a high water absorption property and a durability to washing, the substrate is suitable for a material of a brassiere cup, which contacts with or almost contacts with a human body (or skin). Further, since the substrate has an excellent fitness to a foot in addition to the mechanical strength and lightness in weight, the substrate is suitable for a material of a shoe insole (an insole). Additionally, since the substrate of the present invention has a high elongation property and softness, the substrate has an excellent moldability and a good conformability with a metal mold.

DETAILED DESCRIPTION OF THE INVENTION

Buffer Substrate

Figure 1:
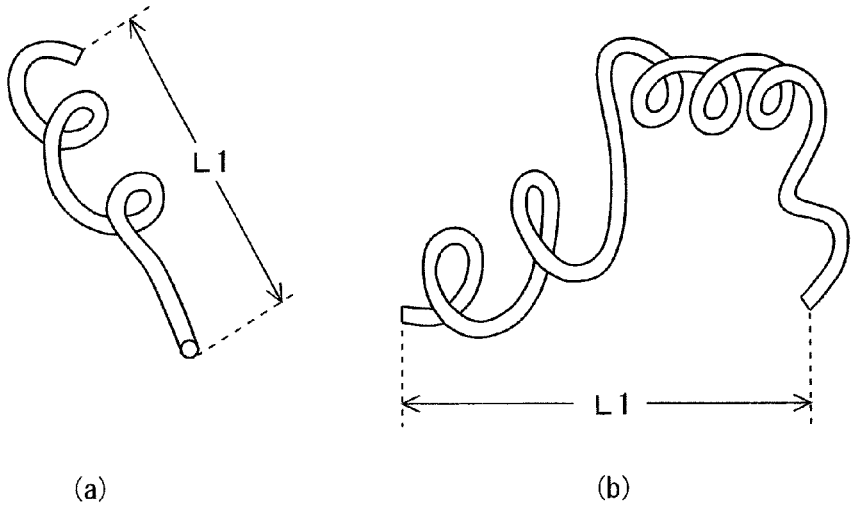
FIG. 1 is a schematic diagram showing a measuring method for the curved ratio of the fiber in the present invention.

The buffer substrate (buffer member substrate) of the present invention comprises a thermal adhesive fiber under moisture and has a nonwoven fiber structure. In particular, the substrate of the present invention not only has a high air-permeability or water absorption property which is a unique characteristic of a fiber structure due to the nonwoven fiber structure immobilized or fixed by an approximately uniform distribution of the melt-bond of the thermal adhesive fiber under moisture in the inside of the substrate, but also shows a cushion property, which a conventional nonwoven fabric does not show, due to an arrangement (orientation) of the fibers constituting the nonwoven fiber structure and an adjustment or control of a state in which the (entangled) fibers are bonded to each other to predetermined ranges.

For a nonwoven fiber assembly comprising a conjugated fiber (a potential crimping conjugated fiber or crimpable conjugated fiber) comprising a plurality of resins which are different in thermal shrinkage (or thermal expansion) and form a phase separation structure in addition to the thermal adhesive fiber under moisture, in the inside of the nonwoven fiber assembly, the thermal adhesive fiber under moisture is approximately uniformly melt-bonded and the conjugated fiber approximately uniformly forms or develops a crimp having an average curvature radius of 20 to 200 μm to entangle the fibers with each other sufficiently. This nonwoven fiber assembly can be obtained by, as described specifically later, applying a high temperature (over-heated or heated) water vapor to a web comprising the thermal adhesive fiber under moisture and the conjugated fiber to allow the conjugated fiber to develop a crimp, thereby entangling the fibers with each other mechanically or automatically; and to allow the thermal adhesive fiber under moisture to exhibit an adhesive action at a temperature not higher than the melting point of the thermal adhesive fiber under moisture, thereby bonding the fibers to each other partly. That is, the buffer substrate of the present invention has a stretching property, a cushion property, and a softness of the assembly due to the entanglement of the crimp of the conjugated fiber, together with a mechanical strength of the assembly due to the melt-bond of the thermal adhesive fiber under moisture. Moreover, in the substrate of the present invention, the fibers are bonded by a spot bonding or partial bonding with the thermal adhesive fiber with a small number of the bonded points while maintaining suitably or moderately small spaces between the fibers; and the fibers are entangled by the crimps of the conjugated fiber. Therefore, the falling off of the fibers is prevented, and the substrate has a high softness and shape retention property.

(Thermal Adhesive Fiber Under Moisture)

According to the present invention, since the thermal adhesive fiber under moisture is softened with moisture and heat to spot-bond the fibers to each other at the intersecting points thereof, the crimped conjugated fibers are efficiently fixed even with small area of the bonded point. Therefore, both the softness and the shape stability can be achieved simultaneously.

The thermal adhesive fiber under moisture comprises at least a thermal adhesive resin under moisture. It is sufficient that the thermal adhesive resin under moisture can flow (or melt) or easily deform and exhibit adhesiveness at a temperature reached easily with an aid of a high-temperature water vapor. Specifically, the thermal adhesive resin under moisture may include a thermoplastic resin which softens with (or by) a hot water (e.g., a water having a temperature of about 80 to 120° C. and particularly about 95 to 100° C.) to bond to itself or to other fibers. Such a thermal adhesive resin under moisture may include, for example, a cellulose-series resin (e.g., a $C_{1-3}$alkyl cellulose such as a methyl cellulose, a hydroxy$C_{1-3}$ alkyl cellulose such as a hydroxymethyl cellulose, a carboxy$C_{1-3}$alkyl cellulose such as carboxymethyl cellulose, or a salt thereof), a poly(alkylene glycol) resin (e.g., a poly ($C_{2-4}$alkylene oxide) such as a poly(ethylene oxide) or a poly (propylene oxide)), a polyvinyl-series resin (e.g., a poly(vinyl pyrrolidone), a poly(vinyl ether), a vinyl alcohol-series polymer, and a poly(vinyl acetal)), an acrylic copolymer and a salt of thereof [e.g., a copolymer containing a unit comprising an acrylic monomer such as (meth)acrylic acid or (meth)acrylamide, or an alkali metal salt of the copolymer], a modified vinyl-series copolymer [e.g., a copolymer of a vinyl-series monomer (such as isobutylene, styrene, ethylene, or vinyl ether) and an unsaturated carboxylic acid or an acid anhydride thereof (such as maleic anhydride), or a salt of the copolymer], a polymer having a hydrophilic substituent introduced therein (e.g., a polyester, a polyamide, and a polystyrene each of which has a sulfonic acid group, a carboxyl group, a hydroxyl group, or the like, introduced therein, or a salt of the polymer), and an aliphatic polyester-series resin (e.g., a polylactic acid-series resin). Moreover, the thermal adhesive resin under moisture may include a resin which softens at a temperature of a hot water (a high-temperature water vapor) to become adhesive, among a polyolefinic resin, a polyester-series resin, a polyamide-series resin, a polyurethane-series resin, and a thermoplastic elastomer or a rubber (e.g., a styrenic elastomer).

These thermal adhesive resins under moisture may be used singly or in combination. The thermal adhesive resin under moisture usually comprises a hydrophilic polymer or a water-soluble resin. Among the thermal adhesive resins under moisture, the preferred one includes a vinyl alcohol-series polymer (e.g., an ethylene-vinyl alcohol copolymer), a polylactic acid-series resin (e.g., a polylactic acid), a (meth)acrylic copolymer containing a (meth)acrylamide unit, particularly, a vinyl alcohol-series polymer containing an α-$C_{2-10}$olefin unit such as ethylene or propylene, particularly, an ethylene-vinyl alcohol-series copolymer.

The ethylene unit content in the ethylene-vinyl alcohol-series copolymer (the proportion of copolymerization) may be, for example, about 10 to 60 mol %, preferably about 20 to 55 mol %, and more preferably about 30 to 50 mol %. The ethylene unit content within the above-mentioned range provides a unique behavior. That is, the thermal resin under moisture or ethylene-vinyl alcohol-series copolymer has thermal adhesiveness under moisture and insolubility in hot water. An ethylene-vinyl alcohol-series copolymer having an excessively small ethylene unit content readily swells or gelats by a low temperature water vapor (or by water), whereby the copolymer readily deforms when once getting wet. On the other hand, an excessively large ethylene unit content decreases a hygroscopicity. In such a case, it is difficult to provide the melt-bond of the fibers with moisture and heat, whereby it is difficult to ensure a mechanical strength for practical use. The ethylene unit content, particularly, in the range of 30 to 50 mol % provides an excellent processability (or formability) into a sheet or a plate.

The degree of saponification of a vinyl alcohol unit in the ethylene-vinyl alcohol-series copolymer is, for example, about 90 to 99.99 mol %, preferably about 95 to 99.98 mol %, and more preferably about 96 to 99.97 mol %. An excessively small degree of saponification degrades the heat stability of the copolymer and causes a thermal decomposition or a gelation of the copolymer, whereby the stability of the copolymer is deteriorated. On the other hand, an excessively large degree of saponification makes the production of the thermal adhesive fiber under moisture difficult.

The viscosity-average degree of polymerization of the ethylene-vinyl alcohol-series copolymer can be selected if necessary and is, for example, about 200 to 2500, preferably about 300 to 2000, and more preferably about 400 to 1500. A viscosity-average degree of polymerization within the above-mentioned range provides an excellent balance between spinning property and thermal adhesiveness under moisture.

The cross-sectional shape or form of the thermal adhesive fiber under moisture (a form or shape of a cross section perpendicular to the length direction of the fiber) may include, but is not limited to, a common solid cross section such as a circular cross section or a modified cross section [e.g., a flat form, an oval (or elliptical) form, a polygonal form, a multi-leaves form from tri-leaves to 14-leaves, a T-shaped form, an H-shaped form, a V-shaped form, and a dog-bone form (1-shaped form)]. The cross-sectional form may be a hollow cross-section.

The thermal adhesive fiber under moisture may be a conjugated (or composite) fiber comprising a plurality of resins, at least one of which is the thermal adhesive resin under moisture. The conjugated fiber has the thermal adhesive resin under moisture on at least part or areas of the surface thereof. In order to bond the fibers, it is preferred that the thermal adhesive resin under moisture form at least part of a continuous area of the surface of the conjugated fiber in the length direction of the conjugated fiber.

The cross-sectional structure of the conjugated fiber having the thermal adhesive fiber under moisture forming at least part of the surface thereof, may include, e.g., a sheath-core structure, an islands-in-the-sea structure, a side-by-side structure or a multi-layer laminated structure, a radially-laminated structure, and a random composite structure. Among these cross-sectional structures, in terms of a high adhesiveness, the preferred one includes a sheath-core structure in which the thermal adhesive resin under moisture continuously forms or constitutes the entire surface of the fiber in the length direction (that is, a sheath-core structure in which a sheath comprises the thermal adhesive resin under moisture).

The conjugated fiber may comprise a combination of two or more of the thermal adhesive resins under moisture or a combination of the thermal adhesive resin under moisture and a non thermal adhesive resin under moisture. The non thermal adhesive resin under moisture (or moistenable-thermal non adhesive fiber, non moistenable adhesive fiber under heat, or non adhesive fiber under heat and moisture) may include a water-insoluble or hydrophobic resin, e.g., a polyolefinic resin, a (meth)acrylic resin, a vinyl chloride-series resin, a styrenic resin, a polyester-series resin, a polyamide-series resin, a polycarbonate-series resin, a polyurethane-series resin, and a thermoplastic elastomer. These non thermal adhesive resins under moisture may be used singly or in combination.

Among these non thermal adhesive resins under moisture, in view of heat resistance and dimensional stability, the preferred one includes a resin having a melting point higher than that of the thermal adhesive resin under moisture (particularly an ethylene-vinyl alcohol-series copolymer), for example, a polypropylene-series resin, a polyester-series resin, and a polyamide-series resin. In particular, the resin preferred in view of a balance of properties (e.g., both heat resistance and fiber processability) includes a polyester-series resin and a polyamide-series resin.

The preferred polyester-series resin includes an aromatic polyester-series resin such as a poly($C_{2-4}$alkylene arylate)-series resin (e.g., a poly(ethylene terephthalate) (PET), a poly (trimethylene terephthalate), a poly(butylene terephthalate), and a poly(ethylene naphthalate)), particularly, a poly(ethylene terephthalate)-series resin such as a PET. The poly(ethylene terephthalate)-series resin may contain, in addition to an ethylene terephthalate unit, a unit comprising other components in the proportion of not more than 20 mol %. The above-mentioned dicarboxylic acid may include, e.g., isophthalic acid, naphthalene-2,6-dicarboxylic aid, phthalic acid, 4,4'-diphenylcarboxylic acid, bis(carboxyphenyl)ethane, and sodium 5-sulfoisophthalate. The diol may include, e.g., diethylene glycol, 1,3-propanediol, 1,4-butanediol, 1,6-hexanediol, neopentyl glycol, cyclohexane-1,4-dimethanol, a poly(ethylene glycol), and a poly(tetramethylene glycol).

The preferred polyamide-series resin includes, e.g., an aliphatic polyamide (such as a polyamide 6, a polyamide 66, a polyamide 610, a polyamide 10, a polyamide 12, or a polyamide 6-12) and a copolymer thereof and a semiaromatic polyamide synthesized or polymerized from an aromatic dicarboxylic acid and an aliphatic diamine. These polyamide-series resins may also contain other copolymerizable units.

The proportion (mass ratio) of the thermal adhesive resin under moisture relative to the non thermal adhesive resin under moisture (a fiber-forming polymer) in the conjugated fiber can be selected according to the structure (e.g., a sheath-core structure) and is not particularly limited to a specific one as long as the thermal adhesive resin under moisture is present on the surface of the thermal adhesive fiber under moisture. For example, the proportion of the thermal adhesive resin under moisture relative to the non thermal adhesive resin under moisture is about 90/10 to 10/90, preferably about 80/20 to 15/85, and more preferably about 60/40 to 20/80. When the proportion of the thermal adhesive resin under moisture is exceedingly large, it is difficult to ensure the strength of the conjugated fiber. An excessively small proportion of the thermal adhesive resin under moisture makes it difficult to allow the thermal adhesive resin under moisture to be present on the surface of the conjugated fiber continuously in the length direction of the conjugated fiber, which lowers the thermal adhesiveness under moisture of the conjugated fiber. Such a tendency also appears in the conjugated fiber obtained by coating the surface of the non thermal adhesive fiber under moisture with the thermal adhesive resin under moisture of the fiber.

The average fineness of the thermal adhesive fiber under moisture can be selected, depending on the applications, for example, from the range of about 0.01 to 100 dtex, and is preferably about 0.1 to 50 dtex, and more preferably about 0.5 to 30 dtex (particularly about 1 to 10 dtex). A thermal adhesive fiber under moisture having an average fineness within the above-mentioned range has an excellent balance of strength and thermal adhesiveness under moisture of the thermal adhesive fiber under moisture.

The average fiber length of the thermal adhesive fiber under moisture can be selected from, for example, the range of about 10 to 100 mm, and is preferably about 20 to 80 mm, and more preferably about 25 to 75 mm (particularly about 35 to 55 mm). An average fiber length within the above-mentioned range produces a sufficient entanglement of the fibers enough, whereby the mechanical strength of the fiber assembly is improved.

The percentage of crimp of the thermal adhesive fiber under moisture is, for example, about 1 to 50%, preferably about 3 to 40%, and more preferably about 5 to 30% (particularly about 10 to 20%). Moreover, the number of crimps is, for example, about 1 to 100/25 mm, preferably about 5 to 50/25 mm, and more preferably about 10 to 30/25 mm.

(Other Fibers)

The nonwoven fiber assembly may further comprise a non thermal adhesive fiber under moisture. The non thermal adhesive fiber under moisture may include an organic fiber and an inorganic fiber. The organic fiber may include, for example, a polyester-series fiber (e.g., an aromatic polyester fiber such as a poly(ethylene terephthalate) fiber, a poly(trimethylene terephthalate) fiber, a poly(butylene terephthalate) fiber, or a poly(ethylene naphthalate) fiber), a polyamide-series fiber (e.g., an aliphatic polyamide-series fiber, a semiaromatic polyamide-series fiber, and an aromatic polyamide-series fiber), a polyolefinic fiber (e.g., a poly$C_{2-4}$olefinic fiber such as a polyethylene or a polypropylene fiber), an acrylic fiber (e.g., an acrylonitrile-series fiber having an acrylonitrile unit (such as an acrylonitrile-vinyl chloride copolymer fiber)), a polyvinyl-series fiber [e.g., a poly(vinyl acetal)-series fiber (such as a poly(vinyl acetal) or a poly(vinyl butyral fiber)), a poly(vinyl chloride)-series fiber (e.g., a poly(vinyl chloride), a vinyl chloride-vinyl acetate copolymer, and a vinyl chloride-acrylonitrile copolymer)], a poly(vinylidene chloride)-series fiber (e.g., a vinylidene chloride-vinyl chloride copolymer and a vinylidene chloride-vinyl acetate copolymer fiber), a poly(p-phenylenebenzobisoxazole) fiber, a poly(phenylene sulfide) fiber, and a cellulose-series fiber (e.g., a natural fiber, a rayon fiber, and an acetate fiber). The inorganic fiber may include, for example, a carbon fiber, a glass fiber, and a metal fiber. These non thermal adhesive fibers under moisture may be used singly or in combination.

In a shoe insole or the like which requires a predetermined (mechanical) strength, the preferably used non thermal adhesive fiber under moisture includes a hydrophilic fiber having a high hygroscopicity, for example, a polyvinyl-series fiber and a cellulose-series fiber, particularly, a cellulose-series fiber. The cellulose-series fiber may include, for example, a natural fiber (e.g., a cotton, a wool, a silk, and a linen or flax or ramie), a semi-synthetic fiber (e.g., an acetate fiber such as a triacetate fiber), and a regenerated fiber (e.g., a rayon, a polynosic, a cupra, and a reyocell (e.g., registered trademark: "Tencel")). Among these cellulose-series fibers, for example, a semi-synthetic fiber (such as a rayon) can preferably be used in combination with the thermal adhesive fiber under moisture. In this case, since the semi-synthetic fiber has a high affinity for the thermal adhesive fiber under moisture, the bond or adhesiveness of the fibers are improved with shrinking of the conjugated fiber. Therefore, a buffer member having mechanical properties and density which is relatively high for a buffer member of the present invention is obtained.

On the other hand, for producing a substrate for an application requiring a softness, a hydrophobic fiber having a low hygroscopicity, for example, a polyolefinic fiber, a polyester-series fiber, a polyamide-series fiber, particularly, a polyester-series fiber having various properties in a well-balanced manner (e.g., a poly(ethylene terephthalate) fiber) is preferably used. A combination use of the hydrophobic fiber and the thermal adhesive fiber under moisture reduces the number of the melt-bonded points of the fibers and produces a buffer substrate having an excellent softness.

The ranges of the average fineness and the average fiber length of the non thermal adhesive fiber under moisture are the same as those of the thermal adhesive fiber under moisture.

In order to improve the softness (particularly cushion property) of the buffer substrate, it is preferred that, among the hydrophobic fibers, particularly, a conjugated fiber (potential crimping conjugated fiber) having a phase separation structure formed from a plurality of resins different in thermal shrinkage (or thermal expansion) be used.

(Potential Crimping Conjugated Fiber)

The potential crimping conjugated fiber (or crimpable conjugated fiber) is a fiber (a potential crimping fiber) comprising a plurality of resins different in thermal shrinkage (or thermal expansion) and has an asymmetric or layer structure (a so-called bimetal structure) formed from the plurality of resins. When the conjugated fiber is heated, the crimp thereof is developed due to the difference in thermal shrinkage. The plurality of resins is usually different in softening point or melting point. Such resins may be selected from a thermoplastic resin, for example, a polyolefinic resin (e.g., a poly $C_{2-4}$olefinic resin such as a low-density polyethylene, a middle-density polyethylene, or a high-density polyethylene, or a polypropylene), an acrylic resin (e.g., an acrylonitrile-series resin having an acrylonitrile unit such as an acrylonitrile-vinyl chloride copolymer), a poly(vinyl acetal)-series resin (e.g., a poly(vinyl acetal) resin), a poly(vinyl chloride)-series resin (e.g., a poly(vinyl chloride), a vinyl chloride-vinyl acetate copolymer, and a vinyl chloride-acrylonitrile copolymer), a poly(vinylidene chloride)-series resin (e.g., a vinylidene chloride-vinyl chloride copolymer, and a vinylidene chloride-vinyl acetate copolymer), a styrenic resin (e.g., a heat-resistant polystyrene), a polyester-series resin (e.g., a poly($C_{2-4}$alkylene arylate)-series resin such as a poly (ethylene terephthalate) resin, a poly(trimethylene terephthalate) resin, a poly(butylene terephthalate) resin, or a poly (ethylene naphthalate) resin), a polyamide-series resin (e.g., an aliphatic polyamide-series resin such as a polyamide 6, a polyamide 66, a polyamide 11, a polyamide 12, a polyamide 610, or a polyamide 612, a semiaromatic polyamide-series resin, and an aromatic polyamide-series resin such as a poly (phenylene isophthalamide), a poly(hexamethylene terephthalamide), or a poly(p-phenylene terephthalamide)), a polycarbonate-series resin (e.g., a bisphenol-A based polycarbonate), a poly(p-phenylenebenzobisoxazole) resin, a poly(phenylene sulfide) resin, a polyurethane-series resin, and a cellulose-series resin (e.g., a cellulose ester). Additionally, each thermoplastic resin may contain other copolymerizable unit(s).

Among these resins, in the present invention, the preferred one includes a non thermal adhesive resin under moisture (or a heat-resistant hydrophobic resin or non aqueous resin) having a softening point or melting point of not lower than 100° C. since the non thermal adhesive resin under moisture neither melts or softens even by the heat and moisture treatment with a high-temperature water vapor not melt-bond to the fibers constituting the nonwoven fabric. Such a non thermal adhesive resin under moisture preferably includes, for example, a polypropylene-series resin, a polyester-series resin, and a polyamide-series resin. The particularly preferred resin includes an aromatic polyester-series resin and a polyamide-series resin because such resins have an excellent balance of a heat resistance, a fiber formability, and the like. In the present invention, in order to prevent the melt-bond with the conjugated fiber in the treatment with a high-temperature water vapor, it is preferred that the non thermal adhesive resin under moisture form at least a portion or part of surface of the conjugated fiber.

As long as the plurality of resins constituting the conjugated fiber are different in thermal shrinkage, the plurality of resins may be a combination of the same species or series resins or a combination of different species or series of resins.

In the present invention, in view of the adhesiveness between the plurality of the resins, a combination of the same series or species resins is preferred. Such a combination of the same series or series resins usually includes a combination of (A) a component forming a homopolymer (an essential component) and (B) a component forming a modified polymer (a copolymer component). That is, the homopolymer as an essential component may be modified by copolymerizing the homopolymer-forming component with the copolymerizable monomer (modified-polymer-forming component) which lowers a degree of crystallization, a melting point, a softening point, or the like, to provide a resulting modified polymer with a degree of crystallization lower than that of the homopolymer. The resulting modified polymer may also be amorphous and have a melting point, a softening point, or the like lower than that of the homopolymer. In this manner, the inherent crystallinity, melting point or softening point of the homopolymer may be changed in order to generate the difference in thermal shrinkage between the resins (the homopolymer and the copolymer). The difference in melting point or softening point therebetween may be, for example, about 5 to 150° C., preferably about 50 to 130° C., and more preferably about 70 to 120° C. The proportion of the copolymerizable monomer to be used for the modification of the homopolymer relative to the total monomers in the modified polymer is, for example, about 1 to 50 mol %, preferably about 2 to 40 mol %, and more preferably about 3 to 30 mol % (particularly, about 5 to 20 mol %). The composition rate (mass ratio) of the homopolymer-forming-component (A) relative to the modified-copolymer-forming component (B) may be selected depending on the structure of the conjugated fiber. The composition rate [the homopolymer-forming component (A)/the modified-copolymer-forming component (B)] is, for example, about 90/10 to 10/90, preferably about 70/30 to 30/70, and more preferably about 60/40 to 40/60.

According to the present invention, in order to produce the potential crimping conjugated fiber easily, which has a latent ability to develop a crimp, a combination of the aromatic polyester-series resins, particularly a combination of (a) and (b) may be used. In particular, a combination of the resins allows a crimp development after a web formation preferable for the present invention. In this regard, the above combination is preferred. The crimp development after a web formation allows an efficient entanglement of the fibers so that a web form is retained with a small number of the melt-bonded points. Therefore, a proper softness can be obtained.

The polyalkylene arylate-series resin (a) may be a homopolymer of an aromatic dicarboxylic acid (e.g., a symmetric aromatic dicarboxylic acid such as terephthalic acid or naphthalene-2,6-dicarboxylic acid) and an alkanediol component (a $C_{3-6}$alkanediol such as ethylene glycol or butylene glycol). Specifically, a poly($C_{2-4}$alkylene terephthalate)-series resin such as a poly(ethylene terephthalate) (PET) or a poly(butylene terephthalate) (PBT), or the like, is used. The PET usually employed is a PET used for a general PET fiber having an intrinsic viscosity of about 0.6 to 0.7.

On the other hand, for producing the modified poly(alkylene arylate)-series resin (b), a copolymerizable component lowering the melting point or softening point, or the degree of crystallization of the poly(alkylene arylate)-series resin (a), which is the essential component, may be used. Such a copolymerizable component may include, for example, a dicarboxylic acid component such as an asymmetric aromatic dicarboxylic acid, an alicyclic dicarboxylic acid, or an aliphatic dicarboxylic acid, an alkanediol component and/or an ether-bond-containing diol component which have/has a chain longer than the alkanediol of the polyalkylene arylate-series resin (a). These copolymerizable components may be used alone or in combination. Among these components, the dicarboxylic acid component widely used includes an asymmetric aromatic carboxylic acid (e.g., isophthalic acid, phthalic acid, and sodium 5-sulfoisophthalate), an aliphatic dicarboxylic acid (an aliphatic $C_{6-12}$dicarboxylic acid such as adipic acid). The diol component widely used includes an alkanediol (e.g., a $C_{3-6}$alkanediol such as 1,3-propanediol, 1,4-butanediol, 1,6-hexanediol, or neopentyl glycol), a (poly)oxyalkylene glycol (e.g., a (poly)oxy$C_{2-4}$alkylene glycol such as diethylene glycol, triethylene glycol, a poly(ethylene glycol), or poly(tetramethylene glycol)). The preferred one includes an asymmetric aromatic dicarboxylic acid such as isophthalic acid, a poly(oxy$C_{2-4}$alkylene glycol) such as diethylene glycol, or the like. Additionally, the modified poly(alkylene arylate)-series resin (b) may be an elastomer which has a $C_{2-4}$alkylene arylate (e.g., ethylene terephthalate and butylene terephthalate) as a hard segment and a (poly)oxyalkylene glycol as a soft segment.

The proportion of the dicarboxylic acid component (e.g., isophthalic acid) lowering the melting point or softening point of the polyalkylene arylate-series resin relative to the total amount of the dicarboxylic acid components in the modified polyalkylene arylate-series resin (b) is, for example, about 1 to 50 mol %, preferably about 5 to 50 mol %, and more preferably about 15 to 40 mol %. The proportion of the diol component (e.g., diethylene glycol) lowering the melting point or softening point of the homopolymer relative to the total amount of the diol components in the modified polyalkylene arylate-series resin (b) is, for example, not more than 30 mol %, and preferably not more than 10 mol % (e.g., about 0.1 to 10 mol %). An excessively small proportion of the copolymerizable component prevents a sufficient crimp development or formation, whereby after the crimp development, the shape stability and stretchability of the nonwoven fiber assembly are deteriorated. On the other hand, an excessively large proportion of copolymerizable component greatly prompts the crimp development. However, such a proportion prevents a stable spinning.

The modified polyalkylene arylate-series resin (b) may have a branched structure which results or is obtained from the combination use of a poly(alkylene arylate)-series resin with a polycarboxylic acid component (e.g., trimellitic acid and pyromellitic acid), a polyol component (e.g., glycerin, trimethylolpropane, trimethylolethane, and pentaerythritol), or the like, if necessary.

The cross-sectional form or shape of the potential crimping conjugated fiber (a form or shape of a cross section perpendicular to the length direction of the fiber) may include, but is not limited to, a common solid cross section. The cross-sectional form may include a hollow cross section. Such a common solid cross section may include, e.g., a circular cross section or a deformed (or modified) cross section [e.g., a flat form, an oval (or elliptical) form, a polygonal form, a multi-leave form from tri-leave to 14-leave, a T-shaped form, an H-shaped form, a V-shaped form, and a dog-bone form (1-shaped form)]. The conjugated fiber usually has a circular cross section.

The cross-sectional structure of the conjugated fiber may include a phase separation structure formed from a plurality of resins, e.g., a sheath-core structure, an islands-in-the-sea structure, a blended structure, a parallel structure (a side-by-side structure or a multi-layer laminated structure), a radial structure (a radially-laminated structure), a hollow radial structure, a block structure, and a random conjugate structure. Among these cross-sectional structures, the preferred one includes a structure having phases adjacent to each other (a structure which is like a bimetal structure) or a structure having phases disposed asymmetrically to each other (e.g., an eccentric sheath-core structure and a side-by-side structure) since the crimp is easily formed by heating.

Incidentally, in a sheath-core structure (such as an eccentric sheath-core structure) potential crimping conjugated fiber comprising the non thermal adhesive resin under moisture as the sheath, which is the outer part of the conjugated fiber, the core may comprise a thermal adhesive resin under moisture or a thermoplastic resin having a low melting point or softening point as long as the conjugated fiber has a latent ability to develop a crimp due to the difference in thermal shrinkage between the sheath and core. The above thermal adhesive resin under moisture includes, e.g., a vinyl alcohol-series polymer such as an ethylene-vinyl alcohol copolymer or a polyvinyl alcohol. The thermoplastic resin includes, e.g., a polystyrene and a low-density polyethylene.

The average fineness of the potential crimping conjugated fiber may be selected from, for example, the range of about 0.1 to 50 dtex, and may be preferably about 0.5 to 10 dtex, and more preferably about 1 to 5 dtex (particularly, about 1.5 to 3 dtex). A conjugated fiber having an excessively small fineness is difficult to produce and has a low fiber strength. In addition, such a conjugated fiber is difficult to form a continuous and smooth coil in the step for developing a crimp. On the other hand, a conjugated fiber having an excessively large fineness is stiff, which makes a sufficient crimp development difficult.

The average fiber length of the conjugated fiber may be selected from, for example, the range of about 10 to 100 mm, and may be preferably about 20 to 80 mm, and more preferably about 25 to 75 mm (particularly, about 40 to 60 mm). An excessively short fiber length makes a fiber web formation difficult and, in the step for developing a crimp, causes an insufficient entanglement of the fibers, whereby it is difficult to ensure the strength and stretchability of the nonwoven fiber assembly. On the other hand, an excessively long fiber length hinders the formation of a fiber web having a uniform basic weight. Additionally, at the web formation, the resulting fiber web has many fiber entanglements which hinder the crimp development since the move of the fibers is restrained by the entanglement. Therefore, it is difficult to provide a softness and a cushion property.

Such a potential crimping conjugated fiber mentioned above forms a crimp (or the crimp of such a conjugated fiber mentioned above is allowed to manifest themselves) by a heat treatment. In the crimp formation, the form of the fiber changes into a three-dimensional configuration or form such as a coil-like form or shape (a spiral form or shape or a helical or coil spring form or shape).

The number of crimps before heating (the number of mechanical crimps) is, for example, about 0 to 30/25 mm, preferably about 1 to 25/25 mm, and more preferably about 5 to 20/25 mm. The number of crimps after heating may be, for example, not less than 30/25 mm (e.g., about 30 to 200/25 mm), preferably about 35 to 150/25 mm, more preferably about 40 to 120/25 mm, and about 45 to 120/25 mm (particularly about 50 to 100/25 mm).

Since the crimp of the conjugated fiber is developed with or by a high-temperature water vapor, the nonwoven fiber assembly comprising the potential crimping conjugated fiber has a feature that the distribution of the crimp of the conjugated fiber is approximately uniform therein. Specifically, Among each of the three areas obtained by dividing a cross section equally into three in a direction perpendicular to the thickness direction, in a middle area (inner layer), the number of the fibers forming a coil-like crimp having at least one turn is, for example, 5 to 50, preferably 5 to 40, and more preferably 10 to 40 per area of 5 mm (in a length along with the surface direction) by 0.2 mm (in a length along with the thickness direction). Since in the assembly of the present invention the number of crimps is uniformly distributed in the thickness direction from an area in the vicinity of a surface through a middle area, the assembly has a high supplement and cushion property without containing a rubber or an elastomer. Additionally, the assembly has a mechanical strength enough for practical use without containing an adhesive agent. Incidentally, the term "an area obtained by dividing the cross section into three perpendicular to the thickness direction" in the present description means each of the three areas obtained by dividing or slicing the cross section perpendicular to the thickness direction of the nonwoven fiber assembly equally into three in a direction perpendicular to the thickness direction.

In addition, the uniform distribution of the crimp in the inside of the nonwoven fiber assembly can be also evaluated by, for example, the uniformity of the curved ratio of the fiber in the thickness direction thereof. The term "curved ratio of fiber" means a ratio (L2/L1) of a fiber length (L2) of the crimped fiber relative to a length between the both ends of the crimped fiber (L1). The curved ratio of the fiber (particularly, the curved ratio of the fiber in the middle area in the thickness direction of the fiber assembly) is, for example, not more than 1.3 (e.g., about 1.35 to 5), preferably about 1.4 to 4 (e.g., about 1.5 to 3.5), and more preferably about 1.6 to 3 (particularly, about 1.8 to 2.5). In the present invention, as described later, since the curved ratio of the fiber is measured based on an electron micrograph of the cross section of the fiber assembly, the fiber length (L2) means not a fiber length obtained by straightening a fiber which is three-dimensionally crimped to measure the length (an actual length), but a fiber length obtained by straightening a fiber whose crimps are two-dimensionally observed on an electron micrograph (a fiber length on a photograph). That is, the fiber length as used herein (the fiber length on the photograph) is shorter than the actual length.

Moreover, in the present invention, since the crimps are almost uniformly formed in the inside of the assembly, the curved ratio of the fiber is uniform. The uniformity of the curved ratio of the fiber is evaluated by, for example, comparing the curved ratio of the fiber of each of the three areas obtained by dividing the cross section with respect to the thickness direction equally into three. That is, the curved ratio of the fiber of any three areas mentioned above is within the range mentioned above. The proportion of the minimum value relative to the maximum value among the curved ratios of the fiber in each of the areas (the ratio of an area having the minimum curved ratio of the fiber relative to an area having the maximum curved ratio of the fiber) is, for example, not less than 75% (e.g., about 75 to 100%), preferably about 80 to 99%, and more preferably about 82 to 98% (particularly about 85 to 97%).

Specifically, the curved ratio of the fiber and the uniformity of the curved ratio of the fiber are measured by a method for taking an electron micrograph of the cross section with respect to the thickness direction of the fiber assembly and measuring the curved ratio of the fiber in an area selected from each of three areas obtained by dividing or slicing the cross section on the photograph equally into three in a direction perpendicular to the thickness direction. The measuring area is in each of the three areas [a surface or front side layer (a surface or front side area), an inner layer (a middle or intermediate area), and a backside layer (a backside area)] which are obtained by dividing or slicing the cross section on the photograph equally into three with respect to the thickness direction. The measuring area has a length of not less than 2 mm in the longitudinal or length direction. The length in the thickness direction of the measuring area is adjusted or selected so that each measuring area has the same width in the vicinity of a center in each layer. Moreover, each of the measuring areas is adjusted or selected so as to be parallel to each other in the thickness direction to contain not less than 100 pieces (preferably not less than 300 pieces, and more preferably about 500 to 1000 pieces) of the fibers which are measurable for the curved ratio of the fiber. After adjusting each measuring area, the curved ratio of all fibers in the area is measured. Then, an average of the curved ratio of the fiber is calculated, and the uniformity of the curved ratio of the fiber is calculated by comparing a measuring area having the maximum average curved ratio of the fiber with a measuring area having the minimum average curved ratio of the fiber.

The potential crimping fiber constituting the nonwoven fiber assembly has an approximately coil-like form or configuration after the crimp development, as mentioned above. The average curvature radius of the crimp or loop of the coil-like crimped fiber may be selected from, for example, the range of about 10 to 250 μm. The average curvature radius thereof may be, for example, about 20 to 200 μm (e.g., about 50 to 200 μm), preferably about 50 to 160 μm (e.g., about 60 to 150 μm), and more preferably about 70 to 130 μm. The average curvature radius is usually about 20 to 150 μm (e.g., about 30 to 100 μm). The average curvature radius is an index representing the average size of the loop of the coil-like crimped fiber. A large average curvature radius of the coil-like crimped fiber means that the crimped fiber has a loosely twisted coil-like form. In other words, the crimped fiber has a coil-like form having a small number of crimps or loops. A small number of crimps provide a modest fiber entanglement, which is disadvantageous to provide sufficient cushion property and softness. On the other hand, the development of crimp having an excessively small average curvature radius provides an insufficient fiber entanglement, which reduces the mechanical strength of the web. Additionally, it is very difficult to produce a potential crimping conjugated fiber to develop such a crimp.

The average pitch between the crimps of the coil-like crimped conjugated fiber is, for example, about 0.03 to 0.5 mm, preferably about 0.03 to 0.3 mm, and more preferably about 0.05 to 0.2 mm.

The proportion (mass ratio) of the thermal adhesive fiber under moisture relative to other fibers (particularly, the potential crimping conjugated fiber) (the former/the latter) may be selected from a range of, for example, about 100/0 to 1/99, preferably about 99/1 to 1/99, and more preferably about 95/5 to 5/95 (particularly about 90/10 to 10/90), depending on uses.

For the substrate of the present invention to be used for a cushion (for example, a cushion of a furniture, a bedding, a vehicle or the like), an adjustment of the proportion (mass ratio) of the thermal adhesive fiber under moisture relative to other fibers (particularly, the potential crimping conjugated fiber) can control a balance between the crimp of the conjugated fiber and the melt-bond of the thermal adhesive fiber under moisture, thereby improving the cushion property and the softness. The proportion (mass ratio) of the thermal adhesive fiber under moisture relative to other fibers may be selected from the range of, for example, about 99/1 to 1/99 (e.g., about 90/10 to 1/99), and is for example, about 80/20 to 3/97, preferably about 70/30 to 5/95, and more preferably about 60/40 to 10/90 (particularly about 50/50 to 15/85). Moreover, concerning the substrate to be used as a substrate for a seat cushion of a vehicle such as an automobile among the cushions, in view of improving compression recoverability and softness, the proportion (mass ratio) of the thermal adhesive fiber under moisture relative to other fibers may be, for example, about 95/5 to 50/50, preferably about 90/10 to 60/40, and more preferably about 85/15 to 70/30.

The substrate of the present invention is used for or as a protective member for a human body or skin (for example, a brassiere cup and a shoe insole) by adjusting the proportion (mass ratio) of the thermal adhesive fiber under moisture relative to other fibers (particularly, the potential crimping conjugated fiber) to reduce the density properly together with improving the cushion property and softness. In this manner, the substrate can obtain a soft or tender feel impression. For the substrate to be used as a substrate for a brassiere cup, the proportion (mass ratio) (the former/the latter) may be selected from a range of about 90/10 to 1/99, and is for example, about 40/60 to 10/90, preferably about 40/60 to 15/85, and more preferably about 35/65 to 20/80 (particularly about 35/65 to 25/75).

Concerning the substrate to be used as a substrate for a shoe insole, the proportion (mass ratio) of the thermal adhesive fiber under moisture relative to other fibers (particularly, the potential crimping fiber conjugated fiber) (the former/the latter) may be about 100/0 to 20/80, preferably about 90/10 to 20/80, and more preferably about 85/15 to 30/70. Moreover, for the substrate, of the present invention, to be used as a shoe insole, it is preferred that the proportion of the both fibers (particularly, the proportion of the thermal adhesive fiber under moisture relative to the potential crimping conjugated fiber) be selected depending on kinds of shoes.

For example, in order to achieve an effect (such as a bulkiness, a cushion property, or a softness due to the potential crimping conjugated fiber) significantly, the potential crimping conjugated fiber may preferably be contained in a ratio of not less than 10% by mass and preferably not less than 20% by mass (e.g., about 20 to 80% by mass) relative to the whole of the nonwoven fiber assembly constituting the substrate. Moreover, according to the thickness of an insole, a substrate comprising the potential crimping conjugated fiber in a ratio of not less than 40% by mass (e.g., 40 to 80% by mass) relative to the whole of the nonwoven fiber assembly constituting the substrate is used for an insole which usually has a high conformability with a movement of a foot bottom and an excellent fitness. Therefore, such an insole prevents fatigue of foot. Further, a substrate comprising the potential crimping fiber conjugated fiber in a ratio of not less than 50% by mass and preferably not less than 60% by mass (e.g., 60 to 80% by mass) relative to the whole of the nonwoven fiber assembly constituting the substrate is used for as an insole which has a high cushion property and a high property for protecting a joint.

Contrary, a substrate comprising the potential crimping conjugated fiber in a ratio of not more than 40% by mass (e.g., 10 to 40% by mass) relative to the whole of the nonwoven fiber assembly constituting the substrate is used for an insole which has a high conformability with a movement of a shoe bottom. One wearing a shoe using such an insole easily feels a ground surface at his/her foot through the shoe. Further, a substrate comprising the potential crimping conjugated fiber in a ratio of not more than 30% by mass and preferably not more than 20% by mass (e.g., 10 to 20% by mass) is used for an insole suitable for shoes for an advanced runner since an insole comprising or formed from the above substrate suppresses the loss of a runner's energy to kick a ground surface at his/her foot bottom in or during a use thereof.

Moreover, in the ratio of the thermal adhesive fiber under moisture contained of not less than 50% by mass and preferably not less than 60% by mass (e.g., 60 to 90% by mass) relative to the nonwoven fiber assembly constituting an insole, the bonded fiber ratio can be increased. Therefore, the durability of the insole can be enhanced.

The buffer substrate of the present invention may further comprise other fibers, excluding a potential crimping conjugated fiber, in addition to the potential crimping conjugated fiber as long as the other fibers do not deteriorate the properties of the potential crimping conjugated fiber. The preferred other fibers includes, for example, a regenerated fiber such as a rayon, a semisynthetic fiber such as a cellulose acetate, a polyolefinic fiber such as a polypropylene or a polyethylene, a polyester fiber, and a polyamide fiber. In particular, in view of blending fibers, the preferred one may be a fiber which is the same species of the potential crimping conjugated fiber. For example, when the potential crimping conjugated fiber is a polyester-series fiber, the other fibers may also be a polyester-series fiber.

The proportion of the other fibers excluding a potential crimping conjugated fiber is, for example, not more than 20% by mass, preferably not more than 10% by mass, and more preferably not more than 5% by mass (e.g., about 0.1 to 5% by mass) relative to the total amount of the thermal adhesive fiber under moisture and the potential crimping conjugated fiber.

The substrate of the present invention may further comprise a conventional additive, for example, a stabilizer (e.g., a heat stabilizer such as a copper compound, an ultraviolet ray absorber, a light stabilizer, and an antioxidant), an antibacterial agent, a deodorant, a perfume, a colorant (e.g., a dye or pigment), a filler, an antistatic agent, a flame retardant, a plasticizer, a lubricant, and a crystallization rate retardant. These additives may be used alone or in combination. These additives may be supported on the surface of the fiber or may be contained in the fibers.

(Properties of Buffer Substrate)

The buffer substrate of the present invention has a nonwoven fiber structure obtained from a web comprising the above fibers. The outer shape or form thereof may be selected depending on applications and is usually a sheet- or plate-like form. The appearance or shape of the plane thereof is not particularly limited to a specific one and may be, for example, a circular or oval form, a polygonal form, and a four-way type such as a square form or a rectangular form.

Moreover, it is necessary for the substrate of the present invention to adjust or control properly an arranged state and bonded state of the fibers constituting the nonwoven fiber web in order to ensure cushion property while having the fiber structure.

Specifically, in the nonwoven fiber assembly containing the potential crimping conjugated fiber, it is preferred that the thermal adhesive fiber under moisture be melt-bonded at an intersecting points of the thermal adhesive fibers under moisture with each other or with the crimped conjugated fibers (that is, an intersecting point of the thermal adhesive fibers under moisture or an intersecting point of the thermal adhesive fiber under moisture with the crimped conjugated fiber). According to the present invention, in the nonwoven fiber assembly, the fibers constituting the nonwoven fiber structure are bonded to each other at each of the contacting points by the thermal adhesive fiber under moisture. In order to maintain the form or configuration of the fiber assembly with a small number of the contacting points as far as possible, it is preferred that the distribution of the bonded point be approximately uniform from an area or region near a surface of the assembly to the inside thereof. For example, in an assembly having a plate-like form, it is preferred that the distribution of the bonded point be uniform from a surface of the fiber assembly to another surface thereof through the inside thereof (a middle area or region) in the surface direction and the thickness direction (particularly, the thickness direction in which it is difficult to make the distribution of the bonded point uniform). A concentration of the bonded points on a surface or inside of the fiber assembly decreases the cushion property; and an area or region having a less number of the bonded points has a low shape stability. For example, when the fiber assembly is treated at a high temperature for a long time by a conventional manner in order to bond the fibers to each other and develop a crimp, the fibers in an area near a heat source are excessively bonded to each other. Therefore, the cushion property (particularly, the softness or flexibility against an initial stress) is decreased. Moreover, the potential crimping conjugated fibers (for example, resin parts having a low melting point) are melted and bonded to each other, whereby cushion property and softness are decreased.

Contrary, in the substrate of the present invention the bonded points of the fibers are almost uniformly distributed from an area in the vicinity of the surface of the fiber assembly through the inside thereof to fix (or bond) the fibers efficiently. Therefore, although the substrate has a small number of the melt-bonded points and is free from an elastomer component, the substrate can show shape stability and achieve both a cushion property and a settling resistance. Further, since the fibers are melt-bonded with the thermal adhesive fiber under moisture, the falling off of the fibers is suppressed. For example, when the fiber assembly is cut into an objective size and the resulting matter is used, the falling off of the fibers from a cut surface thereof and the collapse of the structure do not tend to occur.

Specifically, in the substrate of the present invention, the fibers constituting the nonwoven fabric structure are bonded at a bonded fiber ratio of not more than 45% (e.g., about 1 to 45%) by the melt-bond of the thermal adhesive fiber under moisture. The bonded fiber ratio may be selected according to applications. The bonded fiber ratio in the present invention may be measured by the manner described in Examples as mentioned later and means the proportion of the number of the cross section of the bonded fibers relative to the total number of the cross section of the fibers in a cross section of the nonwoven fiber assembly. Therefore, a low bonded fiber ratio means that the proportion of the fibers melt-bonded to each other is low. In the present invention, an interaction of such a low bonded ratio with the coil-like crimps of the conjugated fiber described later can impart a good cushion property to the fiber assembly.

For the substrate of the present invention to be used for a cushion (e.g., a cushion of a furniture, a bedding, a vehicle or the like), the bonded fiber ratio may preferably be, for example, not more than 30% (e.g., about 3 to 30%), preferably about 4 to 25%, and more preferably about 5 to 20% in view of cushion property.

The substrate of the present invention can be used for a protective member for a body (e.g., a brassiere cup and a shoe insole) by adjusting the bonded fiber ratio to improve the cushion property, the softness, and a feel of the protective member against wearer's skin. Therefore, the substrate is suitable for an application to be worn (such as a brassiere cup or a shoe insole). For the substrate to be used as a substrate for a brassiere cup, the bonded fiber ratio may be, for example, not more than 25% (e.g., about 1 to 25%), preferably about 2 to 23%, and more preferably about 3 to 20% (particularly about 4 to 18%).

Concerning the substrate to be used as a substrate for a shoe insole, the bonded fiber ratio may be, for example, not more than 45% (e.g., about 4 to 45%), preferably about 4 to 35%, and more preferably about 5 to 30% (particularly about 10 to 20%). In particular, an insole comprising a substrate having a bonded fiber ratio of 10 to 20% has an excellent softness, cushion property, absorbing property for a minor or weak shock. Moreover, an insole comprising a substrate having a bonded fiber ratio of 15 to 35% has an excellent durability and absorbing property for a strong shock.

As for the uniformity of the melt-bond, taking as a fiber assembly having a sheet- or plate-like form as an example, it is preferred that the bonded fiber ratio be within the above range in any three areas obtained by dividing or cutting the cross section with respect to the thickness direction equally into three. The proportion of the minimum value of the bonded fiber ratio relative to the maximum value of the bonded fiber ratio among each area (the ratio of the minimum value of the bonded fiber ratio among the three areas relative to the maximum value of the bonded fiber ratio thereamong) is, for example, not less than 50% (e.g., about 50 to 100%), preferably about 55 to 99% (e.g., about 60 to 99%), more preferably about 60 to 98% (e.g., about 70 to 98%), particularly about 70 to 97% (e.g., about 75 to 97%). In the present invention, the bonded fiber ratio is such a uniformly distributed in the thickness direction. Therefore, in spite of a small number of the melt-bonded points, the form or configuration of the fiber assembly can be retained; the cushion property or air-permeability can be improved; and both of softness and form or configuration stability can be obtained.

As used herein the term "an area obtained by dividing the cross section into three with respect to the thickness direction" means each of the three areas obtained by dividing or slicing the cross section with respect to the thickness direction of the plate-like assembly equally into three in a direction perpendicular to the thickness direction.

The bonded fiber ratio which means the degree of melt-bond of the fibers can easily be determined by the following manner: taking a macrophotography of the cross section of the fiber assembly using a scanning electron microscope (SEM); and counting the number of the cross section of the melt-bonded fibers in a predetermined area of the macrophotograph. However, when the proportion of the thermal adhesive fiber under moisture is large, it is sometimes difficult to observe the fibers individually in the melt-bonded bundle of the fibers in which the fibers form a bundle or intersect with each other. In this case, the bonded fiber ratio can be determined by, for example, dissolving or loosing the melt-bonded fibers by a mean such as melting or washing out (or off) the thermal adhesive fiber under moisture; observing the cross section again; and comparing the observation with the observation of the fibers before dissolving or loosing the melt-bonded fibers.

As mentioned above, in the substrate of the present invention, the fibers are bonded by melting the thermal adhesive fiber under moisture to distribute the spot bonds uniformly. Additionally, these distributed spot-bonds having a short distance between the melt-bonded points (e.g., several tens to several hundreds μm) form a dense network structure throughout the substrate. It is presumed that owing to the softness of the fiber structure, even when an external force is applied on the substrate of the present invention, the substrate increases conformability with a strain generated by the external force and to each of the finely distributed melt-bonded points of the fibers the external force is dispersed to be weakened. Therefore, the substrate of the present invention presumably exhibits a high shape stability. On the other hand, a conventional porous shaped product or a foamed product has cell-like voids which are isolated by the continuous interfaces, thereby having a low air-permeability.

In particular, in order to impart an air-permeability and a cushion property to the nonwoven fiber structure of the substrate of the present invention in a balanced way, it is preferred that, in an inner configuration of the nonwoven fiber structure, the bonded state of the fibers be properly adjusted or controlled by melt-bonding the thermal adhesive fiber under moisture and the fibers adjacent to or intersecting each other be intertwined with each other by the helical crimps resulted from the crimp development of the potential crimping conjugated fiber. Because of the crimp development or formation in which the conjugated fiber is changed into a coil-like form fiber, the inner configuration of the nonwoven fiber assembly comprising the potential crimping fiber has a structure in which the fibers adjacent to or intersecting each other (the crimped fibers or the crimped fibers with the thermal adhesive fiber under moisture) are entangled with each other by the helical crimps to be fastened or hooked on or to each other.

The orientation (or arrangement) of each of the fibers is not particularly limited to a specific one. For example, in a plate- or sheet-like substrate, the oriented state of the fibers constituting the fiber assembly may properly be adjusted. That is, the fibers constituting the fiber assembly (for the coil-like crimped fibers, the long axis directions of the crimps) are oriented so as to intersect the fibers each other while being oriented or arranged in a direction approximately parallel to a sheet surface. As used herein, the term "being oriented in a direction approximately parallel to the surface direction" means, for example, a state which is different from a state in a conventional needle-punched nonwoven fabric and is free from repeatedly existing areas or portions which contain a large number of the fibers which are oriented in the thickness direction locally or regionally as if the fibers would penetrate the nonwoven fabric, thereby being the fibers fastened on each other to maintain the shape or form of the nonwoven fabric and contributing to ensuring of a high (mechanical) strength. Therefore, in view of orienting the fibers in parallel to the sheet surface, it is preferred that the degree of fiber entanglement by a needle-punching be lessened or that the fibers be not entangled with each other.

Moreover, for the arrangement of the fibers parallel to the sheet surface in such a plate-like substrate, the fibers adjacent to or intersecting each other are entangled with each other by the coil-like crimps and are slightly and moderately entangled with each other in the thickness direction (or in an oblique direction) of the fiber assembly. According to the present invention particularly, in the fiber assembly, in the process of the shrinkage or contraction of the conjugated fibers in the fiber web after the formation of the web, i.e., in the process of the change in the form of the conjugated fiber into a coil-like form, the helical crimps or loops of the conjugated fibers are entangled with each other. Therefore, the fibers are properly fastened on each other. Moreover, the entangled fibers are melt-bonded by the thermal adhesive fiber under moisture to provide a cushion property.

If a large amount or number of the fibers oriented in the thickness direction (a direction perpendicular to the sheet surface) exist in the fiber assembly, the fibers also form a coil-like crimp to give an exceedingly complicated entanglement of the fibers. This entanglement exceedingly fastens or immobilizes the fibers and hinders the coils of the conjugated fibers from extending and contracting. In this way, not only the softness of the entire fiber assembly is decreased but also the cushion property thereof is deteriorated. Therefore, it is preferred that the fibers be oriented in a direction parallel to the sheet surface as much as possible.

The coil-like crimped conjugated fiber is easily deformed or distorted by a force applied on the conjugated fiber in the length direction thereof, and it is difficult to recover its shape or configuration. On the other hand, the conjugated fiber is hardly deformed or distorted by a force applied on the conjugated fiber in a direction perpendicular to the coil (in a direction perpendicular to the length direction of the conjugated fiber), and even a deformation or distortion thereof is easily recovered. Therefore, the substrate of the present invention can achieve both form or configuration keeping property and cushion property in spite of having a small amount of the melt-bonded points of the thermally adhesive fiber under moisture.

Further, the substrate of the present invention may have an area or region containing a large number of the fibers arranged in the thickness direction in places. Preferably, such areas or regions may regularly or periodically be arranged in a surface direction (or length direction) of the plate-like fiber assembly. A nonwoven fiber assembly having such areas has a high shape stability against bending or distortion (or strain) together with a high cushion property against a pressure applied on the fiber assembly in the thickness direction.

As used herein, the term "fiber oriented in the thickness direction" means a fiber whose axis direction intersects the thickness direction with an acute angle in a range of about 0 to 45° (e.g., about 0 to 30° and particularly about 0 to 15°. For the coil-like crimped conjugated fiber, an axis direction is a coil axis direction. The orientation of the fibers in the thickness direction is easily confirmed or observed by the following manner: (1) taking a macrophotograph of a cross section of a nonwoven fabric assembly using a scanning electron microscope (SEM); and (2) counting the number of axis directions partly or entirely oriented in parallel with the thickness direction in a predetermined area or region.

Therefore, as used herein, the term "an area containing a large amount of the fibers oriented in the thickness direction" means, in a cross section in the thickness direction, an area or region containing a large amount or number of the fibers oriented in the thickness direction (i.e., an area or region having a high density of the fibers (a high-density portion)). Such an area or region can be formed, as described later, by applying a pressure on the web surface partly.

Such an area may be arranged regularly or periodically in a surface direction of the fiber assembly. A regular arrangement of the area means that each of the areas exists continuously or intermittently in accordance with a certain rule in a surface direction (a length and/or width direction(s) of the surface, particularly a length and width directions thereof). For example, the regular arrangement may include a mesh or lattice pattern [e.g., a vertical-striped pattern, a horizontal-striped pattern, a striped pattern, and a checkered pattern (such as a honeycomb checkered pattern)] and a dot pattern. Among the arrangements, for example, concerning a nonwoven fiber assembly having a tape or strip form, the arrangement of the above areas (the high-density portions) may be a striped pattern in the length (or longitudinal) direction of the nonwoven fiber assembly, and it is preferred that the arrangement be a mesh or lattice (hound's-tooth) pattern or a dot pattern. The size (average width) in the surface direction of each of the areas is, for example, about 0.1 to 50 mm, preferably about 0.5 to 10 mm, and more preferably about 0.5 to 5 mm (particularly about 1 to 3 mm). The density of the fibers in each of the areas is, for example, about 10 to 100 pieces/$mm^2$, preferably about 20 to 80 pieces/$mm^2$, and more preferably about 30 to 70 pieces/$mm^2$. The area ratio (%) of the low-density portion relative to the high-density portion is, for example, about 60/40 to 5/95, preferably about 50/50 to 10/90, and more preferably about 40/60 to 20/80. Incidentally, if the high-density portion has a hole, the total area of the high-density portion contains an area corresponding to the hole. A nonwoven fiber assembly in which the densities of the fibers oriented in the thickness direction regularly differ from each other has both a high cushion property and shape stability and an excellent durability to washing.

Such a high-density portion may have a hole. The hole can be formed, as described later, by increasing a pressure applied on the fiber web or fiber assembly, or the like. The hole may be a bore penetrating the fiber web or fiber assembly in the thickness direction (through-bore or through-hole in the thickness direction) or a depressed or concave portion. The form or shape of the hole (the form or shape in the surface direction of the fiber web or fiber assembly) may be a circular shape, an oval shape, a triangular shape, a rectangular shape, a polygonal shape (such as a lozenge shape, a hexagonal shape, or an octagonal shape), or the like. The hole may be formed regularly as the above high-density portion. The size of the hole (average hole diameter) may be, for example, about 0.1 to 50 mm, preferably about 0.5 to 10 mm, and more preferably about 0.5 to 5 mm (particularly about 1 to 3 mm).

A nonwoven fiber assembly having a hole easily conforms with a form or shape of a mold at a molding (particularly a secondary molding) since the hole absorbs a strain. Therefore, contacting the fiber assembly with a mold, a wrinkle to be generated by a local concentration of a stress or strain can be prevented or suppressed. Moreover, applying a stress on the fiber assembly, the hole absorbs the strain. Therefore, the fiber assembly having a high cushion property can obtain. Additionally, even in washing with a washing machine or the like, a stress due to water flow or the like can be dispersed to the hole. Thus, the fiber assembly also has shape stability after washing. Therefore, the nonwoven fiber assembly having a hole is suitable for a substrate which is for various buffer members and to be subjected to a thermoforming. Such a substrate may include a substrate for a brassiere cup, a shoe insole or the like.

The substrate of the present invention is not only anisotropic in the surface direction and the thickness direction but also usually anisotropic in the machine direction (MD) and the cross direction (CD). That is, in the production process for the substrate of the present invention, the fibers (for the coil-like crimped fibers, the axis direction of the coil) tend to be oriented not only in a direction approximately parallel to the surface direction of the nonwoven fabric but also in a direction approximately parallel to the machine direction. As a result, a rectangular form fiber assembly is anisotropic in the machine direction and the cross direction in the production of the fiber assembly.

Owing the nonwoven fiber structure, the substrate of the present invention has voids or spaces between the fibers. Since these voids are continuously connected with each other, unlike the voids which are independently from each other in a resin foam such as a sponge, the substrate has an air-permeability. The air-permeability of the substrate of the present invention measured by a Frazier tester method is not less than 0.1 $cm^3/(cm^2 \cdot second)$ (e.g., about 0.1 to 300 $cm^3/(cm^2 \cdot second)$), preferably about 0.5 to 250 $cm^3/(cm^2 \cdot second)$ (e.g., about 1 to 250 $cm^3/(cm^2 \cdot second)$), more preferably about 5 to 200 $cm^3/(cm^2 \cdot second)$, and usually about 1 to 100 $cm^3/(cm^2 \cdot second)$. An excessively small air-permeability makes it difficult to allow air to pass through the fiber assembly spontaneously, whereby an external pressure is needed to pass air therethrough. On the other hand, an excessively large air-permeability allows the fiber assembly to be highly air-permeable but means that the voids or spaces are large. Due to the large voids cushion property is decreased. According to the present invention, the fiber assembly can be comfortably used as a buffer member to contact with a human body without causing a humid state.

The apparent density of the substrate of the present invention may be selected, according to uses, from the range of, for example, about 0.01 to 0.2 $g/cm^3$, and is preferably about 0.02 to 0.18 $g/cm^3$, and more preferably about 0.03 to 0.15 $g/cm^3$.

Concerning the substrate of the present invention to be used for a cushion (e.g., a cushion of a furniture, a bedding, and a vehicle), the apparent density is, for example, about 0.02 to 0.2 $g/cm^3$ (e.g., about 0.03 to 0.18 $g/cm^3$), preferably about 0.05 to 0.15 $g/cm^3$, and more preferably about 0.1 to 0.13 $g/cm^3$. An excessively small apparent density improves the air-permeability but deteriorates the shape stability. Contrary, an excessively large apparent density ensures a shape stability but deteriorates the air-permeability or the cushion property. According to the present invention, a use of the thermal adhesive fiber under moisture and the crimped fiber results in a combination of high uniformities of the melt-bond and crimp. Therefore, the fiber assembly can show a cushion property while retaining the shape thereof in spite of a relatively low density. Moreover, the apparent density may be, for example, about 0.05 to 0.2 $g/cm^3$, preferably about 0.07 to 0.2 $g/cm^3$, and more preferably about 0.1 to 0.2 $g/cm^3$. The substrate having such an apparent density can show an excellent cushion property in spite of a density higher than that of a conventional seat cushion. Therefore, the substrate of the present invention is suitable for a seat cushion in a vehicle.

The substrate of the present invention is used for a protective member for a body (e.g., a brassiere cup and a shoe insole) by adjusting the apparent density to increase a cushion property after molding and an air-permeability together with ensuring the shape stability and moldability of the substrate. For the substrate to be used as a substrate for a brassiere cup, the apparent density may be selected from the range of, for example, about 0.01 to 0.15 $g/cm^3$, and is preferably, about 0.02 to 0.1 $g/cm^3$, and more preferably about 0.03 to 0.08 $g/cm^3$. An excessively small apparent density improves the air-permeability but deteriorates the shape stability. It is highly possible that molding a fiber assembly having such an apparent density produces or generates a low density of the fibers of the molded product or breaks at a greatly extended area or region of the fiber assembly. Contrary, an excessively large apparent density can ensure the shape stability and moldability but deteriorates the cushion property after molding and air-permeability. According to the present invention, a use of the thermal adhesive fiber under moisture and the crimped fiber results in a combination of high uniformities of the melt-bond and crimp. Therefore, the fiber assembly can show a cushion property while retaining the cup shape thereof after a secondary molding despite having a relatively low density cushion property. The apparent density of the brassiere cup after a secondary molding may be selected from the range of, for example, about 0.05 to 0.2 $g/cm^3$, and is preferably about 0.07 to 0.18 $g/cm^3$, and more preferably about 0.09 to 0.15 $g/cm^3$.

Concerning the substrate to be used as a substrate for a shoe insole, from the same reason for the substrate for a brassiere cup, the apparent density may be selected from the range of, for example, about 0.03 to 0.20 $g/cm^3$, and is preferably about 0.04 to 0.15 $g/cm^3$, and more preferably about 0.05 to 0.12 g/cm$^3$. The apparent density after a secondary molding of the substrate as a shoe insole may be selected from the range of, for example, about 0.05 to 0.25 g/cm$^3$, and is preferably about 0.06 to 0.20 g/cm$^3$, and more preferably about 0.07 to 0.15 g/cm$^3$.

The basic weight (basic weight after heating) of the substrate of the present invention may be selected from the range of, for example, about 50 to 10000 g/m$^2$, depending on applications, and is preferably about 150 to 5000 g/m$^2$, and more preferably about 200 to 3000 g/m$^2$ (particularly about 300 to 1000 g/m$^2$). For the substrate to be used for a seat cushion of a vehicle, the basic weight may be, for example, about 500 to 10000 g/m$^2$, preferably about 1000 to 8000 g/m$^2$, and more preferably about 1500 to 6000 g/m$^2$. An excessively small basic weight makes it difficult to ensure the cushion property or shape stability. On the other hand, a nonwoven fiber assembly or a fiber web having an excessively large basic weight is so thick that at a heat process under moisture, a high-temperature water vapor cannot sufficiently enter the inside of the nonwoven fiber assembly or the fiber web, which makes it difficult to produce a nonwoven fiber assembly having uniform distributions of the melt-bond or the crimp in the thickness direction.

The substrate of the present invention has an excellent cushion property, particularly, a low initial stress, and a soft or tender feel. Moreover, in an application to be worn, a sense of pressure is small, and a wear comfort can be obtained. Such a cushion property is represented with a ratio of a recovery stress (Y) relative to a compression stress (X) based on a hysteresis loop of a behavior in 50% compression and recovery after the compression (50% compression recovery behavior) in accordance with JIS K6400-2. The compression stress (X) is a stress at 25% compression in an initial 50% compression behavior, and the recovery stress (Y) is a stress at 25% compression in returning (recovering) behavior after 50% compression. In the substrate of the present invention, the above ratio in at least one direction (the thickness direction or the like) may be, for example, not less than 10%, for example, not less than 15% (e.g., about 15 to 90%), preferably not less than 20% (e.g., about 20 to 80%), and more preferably about 20 to 60%. This ratio (Y/X) may be selected from such a range according to applications. The higher the ratio is more excellent cushion property is. In the present invention, since the ratio is high, in spite of soft or tender feel the nonwoven fiber assembly increases a repulsive force slowly corresponding to a load applied thereon but the shape or configuration thereof is even restored when the load is removed.

In the substrate of the present invention to be used for a cushion (e.g., a cushion of a furniture, a bedding, a vehicle or the like), the above ratio (Y/X) is, for example, not less than 15% (e.g., about 15 to 60%), preferably not less than 18%, and more preferably not less than 20% (e.g., about 20 to 50%).

In the substrate of the present invention to be used for a protective member for a body (e.g., a brassiere cup and a shoe insole), the ratio (Y/X) may also be selected from the above range. For example, in the substrate to be used as a substrate for a brassiere cup, the ratio (Y/X) may be, for example, not less than 20%, preferably not less than 25%, and more preferably not less than 30% (e.g., about 35 to 60%). The ratio (Y/X) of a brassiere cup after a secondary molding may be, for example, not less than 20%, preferably not less than 25%, and more preferably 30% (e.g., about 35 to 60%).

In the substrate of the present invention to be used as a substrate for a shoe insole, the ratio (Y/X) may be, for example, not less than 15%, preferably not less than 20%, and more preferably not less than 25% (e.g., about 25 to 80%). The ratio (Y/X) of a shoe insole after a secondary molding may be, for example, not less than 15%, preferably not less than 20%, and more preferably not less than 25% (e.g., about 25 to 80%).

Although the substrate of the present invention has a soft or tender feel, the substrate has an excellent cushion property. For that reason, the compression stress needed for 25% compression of the substrate of the present invention may be, for example, about 0.1 to 70 N/30 mmϕ; and the compression stress needed for 50% compression thereof may be, for example, about 2 to 200 N/30=4).

Concerning the substrate of the present invention to be used for a cushion (e.g., a cushion of a furniture, a bedding, a vehicle or the like), the compression stress needed for 25% compression of the substrate of the present invention may be, for example, about 5 to 50 N/30=4) (particularly about 10 to 30 N/30=4)); and the compression stress needed for 50% compression thereof may be, for example, about 20 to 150 N/30 mmϕ (preferably about 30 to 120 N/30=4), and more preferably about 40 to 80 N/30 mmϕ). Therefore, the substrate has an excellent cushion property.

The compression stresses of the substrate of the present invention to be used for a protective member for a body (e.g., a brassiere cup and a shoe insole) may be selected from the above ranges in order to improve the cushion property. For example, in the substrate to be used as a substrate for a brassiere cup, the compression stress needed for 25% compression of the substrate may be, for example, about 0.1 to 3 N/30 mmϕ (particularly about 0.5 to 2 N/30 mmϕ); and the compression stress needed for 50% compression thereof may be, for example, about 2 to 7 N/30 mmϕ) (particularly about 3 to 6 N/30 mmϕ). In an evaluation of the pushing resilience of the brassiere cup obtained by subjecting this substrate for a brassiere cup to a secondary molding, the compression stress needed for 7.5-mm compression of the brassiere cup may be, for example, about 0.1 to 3.0 N/30 mmϕ) (particularly about 0.2 to 2.0 N/30 mmϕ), and the compression stress needed for 15-mm compression thereof may be, for example, about 0.2 to 8 N/30=4) (particularly about 0.5 to 5 N/30 mmϕ).

Concerning the substrate to be used as a substrate for a shoe insole, the compression stress needed for 25% compression of the substrate may be, for example, about 1 to 70 N/30 mmϕ (particularly about 5 to 50 N/30 mmϕ); and the compression stress needed for 50% compression thereof may be, for example, about 25 to 200 N/30 mmϕ) (particularly about 30 to 150 N/30 mmϕ). Even for an insole obtained after a thermoforming of the substrate, the compression stress needed for 25% compression of the insole may be, for example, about 3 to 100 N/30 mmϕ (particularly about 5 to 80 N/30 mmϕ); and the compression stress needed for 50% compression thereof may be, for example, about 10 to 250 N/30 mmϕ) (particularly about 30 to 220 N/30 mmϕ).

The substrate of the present invention has an excellent retention property of stress at 25% compression with passage of time. The retention ratio thereof after 30 minutes is, for example, not less than 50%, preferably about 55 to 99%, and more preferably about 60 to 95% (particularly about 65 to 90%). Additionally, the retention ratio thereof after two hours is, for example, as much as not less than 30%, preferably as much as about 40 to 90%, and more preferably as much as about 50 to 85% (particularly about 55 to 80%). Therefore, the substrate of the present invention has a high retention ratio of compression stress. The retention ratio of compression stress, as described later in Examples, is defined in the present invention as a ratio of a stress after keeping 25% compression for a predetermined time relative to an initial stress at 25% compression.

The compression ratio of the substrate of the present invention may be selected from the range of, for example, about 1 to 95%, depending on uses. Concerning the substrate of the present invention to be used for a cushion (e.g., a cushion of a furniture, a bedding, a vehicle or the like), the compression ratio may be selected from the range of, for example, about 1 to 50%, and is, e.g., about 3 to 40%, preferably about 5 to 30%, and more preferably about 7 to 20% (particularly about 10 to 20%). For the substrate of the present invention to be used as a substrate for a protective martial for a body (e.g., a brassiere cup and a shoe insole), the compression ratio may be selected from the range of, for example, about 30 to 95%, and is, e.g., about 35 to 90%, preferably about 40 to 85%, and more preferably about 45 to 80% (particularly about 50 to 78%). In spite of having an excellent cushion property for a buffer substrate, the substrate of the present invention has a high softness and can greatly be compressed even with a small load.

An increase in the proportion of the thermal adhesive fiber under moisture or the like can improve compression recoverability of the substrate of the present invention. The compression recovery ratio may be not less than 60% (e.g., about 60 to 100%), for example, not less than 80% (e.g., about 80 to 99.9%), preferably about not less than 90% (e.g., about 90 to 99.5%), and more preferably about 95% (e.g., about 95 to 99%). As used herein, the compression recovery ratio represents a recovery ratio when a recovery (return) stress after the compression becomes "0" in 50% compression recovery behavior.

The substrate of the present invention has also an excellent shape stability and may have an elongation at break of not less than 20% in at least one direction (e.g., a length direction of a plate-like assembly). The elongation at break may be selected depending on applications. The elongation at break of the substrate of the present invention to be used for a cushion (e.g., a cushion of a furniture, a bedding, a vehicle or the like) may be not less than 30%, preferably not less than 50% (e.g., about 50 to 250%), and more preferably not less than 80% (e.g., about 80 to 200%). The elongation at break of the substrate of the present invention to be as a substrate for a protective member for a body (e.g., a brassiere cup and a shoe insole) may be not less than 20%, and is for example, not less than 30% (e.g., about 30 to 300%), preferably not less than 40% (e.g., about 40 to 250%), and more preferably not less than 50% (e.g., about 50 to 200%). The elongation at break within the range provides the substrate a high shape stability.

The stress at 30% elongation at break at least one direction of the substrate of the present invention may be selected, according to uses, from the range of, for example, about 1 to 100 N/mm. For the substrate of the present invention to be used for a cushion (e.g., a cushion of a furniture, a bedding, a vehicle or the like), the stress at 30% elongation may be for example, about 3 to 80 N/30 mm, preferably about 5 to 70 N/30 mm, and more preferably about 10 to 50 N/30 mm.

Concerning the substrate of the present invention to be used as a substrate for a protective member for a human body (e.g., a brassiere cup and a shoe insole), the stress at 30% elongation may be selected depending on uses. The stress at 30% elongation of the substrate to be used as a substrate of a brassiere cup may be not more than 30 N/30 mm (e.g., about 1 to 25 N/30 mm), preferably about 3 to 20 N/30 mm, and more preferably about 5 to 15 N/30 mm. A stress at 30% elongation within the range allows the substrate to easily change its form at a molding. Molding the above substrate into a brassiere cup having a complicated configuration or shape, the substrate shows an excellent conformability with a configuration or shape of a mold for the brassiere cup. Moreover, molding the substrate into a shape or configuration with changing the form of the substrate greatly, the generation of an excessively thin area or region due to extending the web partly is suppressed.

For the substrate to be used as a substrate for a shoe insole, the stress at 30% elongation may be, for example, not less than 5N/30 mm (e.g., about 10 to 100N/30 mm), preferably about 15 to 80 N/30 mm, and more preferably about 20 to 70 N/30 mm. The stress at 30% elongation within the range allows the substrate to change easily the shape thereof at a molding. Molding the above substrate into a shoe insole having a complicated form or shape, the substrate shows an excellent conformability with a form or shape of a mold for the shoe insole. Moreover, molding the substrate into a form with a great change in the form of the substrate, the generation of an excessively thin area or region due to extending the web partly is prevented.

The substrate of the present invention may have, in at least one direction, a deformation ratio after 30% elongation (30% recovery strain) of, for example, not more than 20% (e.g., about 3 to 20%), preferably not more than 15% (e.g., about 5 to 15%), and more preferably not more than 10% (e.g., about 5 to 10%). A strain within the range provides a high shape stability against a deformation. Deforming (or changing the shape of) the substrate as a buffer substrate in a process after molding, the substrate returns to its original form without strain. Therefore, the substrate can beautifully be processed.

The thickness of a plate- or sheet-like substrate of the present invention is not particularly limited to a specific one. The thickness may be selected from the range of about 1 to 500 mm, and is for example, about 2 to 300 mm, preferably about 3 to 200 mm, and more preferably about 5 to 150 mm (particularly about 10 to 100 mm). Concerning the substrate of the present invention to be used as a substrate for a shoe insole, the thickness may be selected from the range of about 1 to 30 mm, and is for example, about 2 to 25 mm, preferably about 3 to 20 mm, and more preferably about 4 to 15 mm (particularly about 5 to 10 mm). An excessively thin substrate does not easily show cushion property. Incidentally, a laminate of a plurality of the sheet-like fiber assemblies may be used as a substrate for a shoe insole.

Moreover, the substrate of the present invention has a low thickness variance (a spot or unevenness due to thickness) and a uniform thickness even though the substrate has a plate- or sheet-like form. Specifically, in a length of 3 to 100 mm in a surface direction of the sheet, the proportion of the minimum value of the sheet thickness relative to the maximum value thereof (the minimum value/the maximum value) may be not less than 90% (e.g., about 90 to 99.9%), preferably not less than 93% (e.g., about 93 to 99%), and more preferably not less than 95% (e.g., about 95 to 98%). As described above, since the substrate of the present invention has a uniform thickness despite a nonwoven fiber structure, the substrate can effectively be used for various cushions.

The substrate of the present invention has a high water absorption property (and water retention property) and moisture-permeability due to a capillary effect of the fiber (including the conjugated fiber and other fibers) and an affinity for water of the thermal adhesive resin under moisture. Therefore, the substrate can release an excess sweat to the outside while leaving an appropriate moisture in or on a brassiere cup or shoe insole surface contacting with a human body (such as breast or foot bottom). As a result, both skin irritation due to dryness and humidity due to sweat can be prevented. For example, the rate of water absorption of the substrate of the present invention may be, e.g., not more than 10 seconds, preferably not more than 5 seconds, and more preferably not more than 1 second.

Moreover, the water absorption ratio (water retention ratio) may be, for example, not less than 100% by mass, preferably not less than 200% by mass (e.g., about 200 to 5000% by mass), and more preferably not less than 500% by mass (e.g., about 500 to 3000% by mass).

Further, the moisture-permeability may be, for example, not less than 100 g/cm$^2$·hr, about 150 to 400 g/cm$^2$·hr, and more preferably about 200 to 350 g/cm$^2$·hr. Since the buffer substrate of the present invention shows such a moisture-permeability at a high rate of water absorption as described above, the substrate can easily absorb sweat and release the sweat into the outside. On the other hand, since a proper water retention property of the thermal adhesive fiber under moisture can provide a good feel or texture against wearer's skin. Therefore, a use of the substrate as a substrate to be worn (such as a brassiere cup or a shoe insole) gives a comfortable feeling when wearing the buffer member (e.g., wear comfort or foot comfort).

The substrate of the present invention for a buffer member may have water repellency. In the production process described later, the fibers of the untreated nonwoven fiber assembly (or web) is exposed to water or a water vapor to wash away a hydrophilic material adhered to the fibers, whereby the fibers are allowed to exhibit the essential behaviors of the resin on the surface of the fibers. Specifically, the water repellency preferably shows a score of not less than 3 (preferably 3 to 5, and more preferably 4 to 5) in JIS L1092 Testing methods for water resistance of textiles (Spray test). In addition, the washing-away action with water or a water vapor removes an oil for a fiber which has been adhered to the fibers as well, leading to a decrease in skin irritation of the substrate of the present invention. Therefore, the substrate is useful for an application to contact with a human body (e.g., a cushion of a bedding).

The substrate of the present invention may have a proper surface hardness. The hardness may be, for example, not less than 40, preferably not less than 50, and more preferably about 60 to 100 (particularly about 70 to 100), determined by an FO type durometer hardness test (the test in accordance with JIS K6253 "Rubber, vulcanized or thermoplastic-determination of hardness"). The substrate having such a hardness is suitable for a seat cushion of a vehicle among the buffer members.

(Method for Producing Buffer Substrate)

The method for producing the buffer substrate of the present invention comprises a step of forming a fiber web with or from the fibers comprising the thermal adhesive fiber under moisture and a step of subjecting the resulting fiber web to a heat and moisture treatment with a high temperature water vapor to melt-bond the fibers each other (to melt the thermal adhesive fiber under moisture for boding the fibers).

In the method for producing the buffer substrate of the present invention, firstly, a web is formed from the fiber comprising the thermal adhesive fiber under moisture. The web-forming process which may be used includes a conventional method, e.g., a direct process such as a span bond process or a melt-blow process, a carding process using a melt-blow fiber or a staple fiber, and a dry process such as air-laid process. Among these processes, a carding process using a melt-blow fiber or a staple fiber, particularly, a carding process using a staple fiber is commonly used. The web obtained by using the staple fiber may include, e.g., a random web, a semi-random web, a parallel web, and a cross-wrap web.

In order to form the areas or regions each having a large amount of the fibers whose length (or longitudinal) directions are oriented in the thickness direction, a treatment for changing the orientation direction of the fiber length direction is conducted in a position regularly predetermined on the web surface. The examples of such a treatment include a means for applying a fluid (air or water flow) on or to a web in the thickness direction thereof (particularly, a means for applying a pressure on a web in the thickness direction of the web using a fluid) and a mechanical means (such as a needle-punching). These treatments can change the direction of the fiber oriented mainly in the surface direction in the web, from the surface direction to the thickness direction. Moreover, applying a high pressure on the web, using a needle-punching, or the like, can form a hole in the above area with orienting the fiber length direction in the thickness direction. Among these treatments, a needle-punching is preferred in view of ensuring the formation of the hole and the orientation of the fibers. In particular, a means using a water flow is preferred from the viewpoint of an easy control of the orientation of the fibers due to an adjustment of a pressure condition.

In the means using a water flow, water (water flow) may be continuously, preferably, intermittently or periodically sprayed with respect to the fiber web. The intermittent or periodic spray of a water to the fiber web can form a low-density portion(s) and a high-density portion(s) (an area in which the large number of the fibers oriented in the thickness direction). The low-density portion and the high-density portion can be formed alternately in a regular or periodic pattern. The formation of density difference in the fiber web can be effective for a secondary molding and prevent the fibers from scattering by spraying the fiber web with a high-temperature and high-pressure water vapor in the next step.

The water jetting or spraying pressure in this step may be selected from, for example, the range of about 0.1 to 2 MPa, and may be, e.g., about 0.1 to 1.5 MPa, preferably about 0.3 to 1.2 MPa, and more preferably 0.5 to 1.0 MPa. Concerning forming the hole, the water jetting pressure may be, for example, not less than 0.5 MPa (e.g., about 0.5 to 2 MPa), and preferably not less than 0.6 MPa (e.g., 0.6 to 1.5 MPa). The water temperature is, for example, about 5 to 50° C., preferably about 10 to 40° C., for example, about 15 to 35° C. (a room temperature).

The process for spraying the web with water intermittently or periodically is not particularly limited to a specific one as long as the process can produce the density differences (i.e., the high-density and low-density portions) alternately formed in a regular or periodic pattern. The preferred one includes a process for jetting or spraying water to the fiber web through a plate (e.g., a porous plate) having a plurality of pores forming a regularly spraying area or pattern in view of the convenience.

Then, the obtained fiber web is transferred to the next step by a belt conveyor. Then the fiber web may be subjected to a heat and moisture treatment with a high-temperature water vapor to melt the thermal adhesive fiber under moisture for bonding the fibers three-dimensionally. According to the present invention, a use of a method for treating the web using a high-temperature water vapor as a heating method can provide the melt-bond of the fibers uniformly from a surface through the inside of the fiber assembly.

Concretely, the obtained fiber web is transferred to the next step by a belt conveyor. Then the fiber web may be exposed to an over heated or high-temperature water vapor stream (high pressure steam) to produce the substrate of the present invention comprising a fiber assembly having a nonwoven fiber structure. That is, when the fiber web transferred by the belt conveyor passes through a high-speed, high-temperature water vapor stream is jetted or sprayed from a nozzle of a vapor spraying apparatus, the fibers (the thermal adhesive fibers under moisture or the thermal adhesive fiber under moisture and other fibers) are three-dimensionally bonded to each other by melt-bond of the thermal adhesive fiber under moisture due to the sprayed high temperature water vapor.

A use of the potential crimping conjugated fiber provides the entanglement of the fibers due to the development of the crimp of the conjugated fiber in addition to the three-dimensional bond or adhesion of the fibers by a melt-bond of the thermal adhesive fiber under moisture. Moreover, in the inside of the fiber assembly, the uniform crimp of the conjugated fibers through the surfaces to the inside of fiber assembly is formed as well as the uniform melt-bond of the fibers. That is, due to the crimp development of the potential crimping conjugated fiber(s), the potential crimping conjugated fibers shrink or the form of the fibers changes into a coil-like form having a specific curvature radius to entangle the fibers three-dimensionally. In particular, since the fiber web of the present invention has an air-permeability, a high-temperature water vapor percolates through or enters the inside of the web, resulting in providing a fiber assembly having an approximately uniform network or structure (the uniform distribution of the bonded point of the thermal adhesive fiber under moisture, and the uniform distribution of the crimp of the conjugated fiber, and a uniform entanglement).

The fiber web (particularly, a fiber web comprising the potential crimping conjugated fiber) is treated with a high-temperature water vapor by the belt conveyor. As soon as the high-temperature water vapor treatment starts, the fiber web contracts or shrinks. Accordingly, it is preferred that an excess amount of the fiber web be fed just before being exposed to a high-temperature water vapor depending on an objective size or length of the fiber assembly. The web is overfed at a rate of about 110 to 300%, and preferably about 120 to 250% per objective length of the nonwoven fiber assembly.

The belt conveyor used is not particularly limited to a specific one as long as the conveyor can transfer the fiber web without deforming the form of the fiber web to be processed. The preferably used one includes an endless conveyer. A common single belt conveyer may be used, and if necessary, a combination of the common single belt conveyers (i.e., two common single belt conveyers) may be used to transfer the fiber web with holding the web between the belts of these conveyors. Transferring the web in the above-mentioned manner can prevent the deformation of the fiber web being transferred due to an external force such as a water used for a treatment, a high-temperature water vapor (steam), or a vibration of the conveyer at the web treatment. Moreover, an adjustment of the clearance between the belts can control the density or thickness of the treated nonwoven fabric.

In order to supply the fiber web with a water vapor, a conventional water vapor spraying apparatus is used. The preferred one includes an apparatus which can spray the fiber web approximately uniformly in the entire width of the web with a water vapor at a desirable pressure and amount. In the combination use of the two belt conveyers, a vapor spraying apparatus for supplying the web with the vapor is attached to the inside of one of the conveyors to supply the web with the vapor through a water-permeable conveyor belt or a conveyor net placed on the conveyor, and a suction box may be attached to the inside of another conveyor. A surplus vapor which has passed through the fiber web may be removed by the suction box. In addition, in order to treat the both surfaces of the fiber web with the water vapor at once, another water vapor spraying apparatus may be attached to the inside of the conveyer opposite to the conveyer equipped with the water vapor spraying apparatus and may be disposed on an area which is the downstream side of the vapor spraying apparatus. An alternative process for subjecting the both surfaces of the fiber web to the vapor treatment without the second vapor spraying apparatus and the second suction box may be as follows: allowing the fiber web to pass through the clearance between the first vapor spraying apparatus and the suction box; reversing the fiber web to subject to a surface of the web to the vapor treatment; and allowing the reversed fiber web to pass through therebetween to subject another surface of the web to the vapor treatment.

The endless belt used for the conveyer is not particularly limited to a specific one as long as the belt does not hinder the transport of the fiber web or the high-temperature vapor treatment. However, depending on the condition of the vapor treatment, the surface form of the endless belt is sometimes transferred on a surface of a fiber web treated with a high temperature water vapor. Accordingly, it is preferred that the endless belt be selected depending on uses. When a net is used as an endless belt for producing a substrate having a plane or flat surface particularly, a net having a mesh count smaller than about 90 (e.g., about 10 to 50) is preferred. A fine net having a mesh count not less then above-mentioned number has a low air-permeability and makes it difficult to allow the water vapor to pass therethrough. The material of the mesh belt in view of heat resistance for the water vapor treatment or the like preferably includes, for example, a metal, and a heat-resistant resin such as a polyester-series resin treated for heat resistance, a poly(phenylene sulfide)-series resin, a polyarylate-series resin (a fully aromatic polyester-series resin), or an aromatic polyamide-series resin.

The high-temperature water vapor sprayed from the water vapor spraying apparatus is a gaseous flow or stream and enters the inside of the fiber web being treated without moving the fibers thereof greatly, unlike a hydroentangling or a needle-punching. Presumably, this water vapor-entering effect and heat-moisture action (or heat and humidity action) allow the vapor to cover the surface of each fiber of the web efficiently, whereby the uniform thermal-bond (and thermal crimp development) can be attained. Moreover, the time of the treatment which is conducted under the high-speed stream is so short that the heat is conducted only to the surface of the fiber adequately or sufficiently but not to the inside of the fiber adequately or sufficiently before the completion of the treatment. For that reason, the treatment hardly tends to cause a deformation such as a crush of the whole fiber web (being treated) or a decrease in the thickness of the fiber web (being treated) by the pressure or heat of the high-temperature water vapor. As a result, the almost uniform distributions of the bond of the fibers due to moisture and thermal (heat) in the surface direction and in the thickness direction of the fiber web are achieved without a huge deformation of the fiber web. Furthermore, since the water vapor treatment can transmit heat to the inside of the fiber assembly more sufficiently than a dry heat treatment, the degree of melt-bonded (crimping) is almost uniform in the surface direction and the thickness direction of the nonwoven fabric.

For spraying the high-temperature water vapor, a plate or die having a plurality of predetermined orifices arranged in series in a width direction thereof is used as a nozzle, and the plate or die is disposed to arrange the orifices in the width direction of the fiber web to be conveyed. The plate or die may have at least one orifice line or array or a plurality of orifice lines or arrays, being parallel to each other. Moreover, it is possible that a plurality of nozzle dies, each having one orifice line or array, is disposed being parallel to each other.

The thickness of a plate nozzle having an orifices formed therethrough may be about 0.5 to 1 mm. The diameter of the orifice or the pitch between the orifices is not particularly limited to a specific one as long as the condition of the diameter or pitch thereof efficiently provides an objective fiber fixation (or fiber immobilization) and a fiber entanglement in the crimp development. The diameter of the orifice is usually, about 0.05 to 2 mm, preferably about 0.1 to 1 mm, and more preferably about 0.2 to 0.5 mm. The pitch between the orifices is, usually, about 0.5 to 3 mm, preferably about 1 to 2.5 mm, and more preferably about 1 to 1.5 mm. An excessively small diameter of the orifice tends to cause difficulties, for example, a difficulty in an apparatus for producing such a nozzle with a highly accurate process and an operational difficulty in using such a nozzle due to a frequent plugging of the orifice. An excessively large diameter of the orifice hinders the nozzle from the power for jetting with vapor of the nozzle. On the other hand, an excessively small pitch between the orifices makes the distance between nozzle holes so close that the strength of the nozzle is decreased. An excessively large pitch between the orifices causes a possible ununiform contact of a high-temperature water vapor with the fiber web, whereby the strength of the obtained web is low.

The high-temperature water vapor used is not particularly limited to a specific one as long as an objective fixing or bonding of the fibers and an appropriate fiber entanglement together with the crimp development of the fiber can be achieved. The pressure of the high-temperature water vapor is, depending on the quality of material or form of the fiber used, for example, about 0.1 to 2 MPa, preferably about 0.2 to 1.5 MPa, and more preferably about 0.3 to 1 MPa. An excessively high or strong pressure of the water vapor possibly moves the fibers constituting the web unnecessarily, causing a deterioration of the texture; exceedingly melt the fibers, failing to keep the fiber form or shape partly in the web; or entangles the fibers with each other unnecessarily. On the other hand, an excessively weak pressure of the water vapor fails to give an amount of heat which is necessary to the melt-bond of the fibers or the crimp development of the conjugated fibers to the web or to allow a water vapor to penetrate the fiber web, whereby the melt-bond spot or fleck or the ununiform distribution of the crimp of the fibers sometimes occurs in the thickness direction of the fiber assembly. Moreover, controlling uniform jetting of the water vapor from the nozzle is sometimes difficult.

The temperature of the high-temperature water vapor is, for example, about 70 to 150° C., preferably about 80 to 120° C., and more preferably about 90 to 110° C. The speed of the treatment with the high-temperature water vapor may be, for example, about not more than 200 m/minute, preferably about 0.1 to 100 m/minute, and more preferably about 1 to 50 m/minute.

If necessary, a plurality of plate-like fiber assemblies may be laminated to produce a laminate, or the plate-like fiber assembly and the other materials may be laminated to produce a laminate. Additionally, the plate-like fiber assembly may be processed into a desired shape (e.g., various shapes such as a cylinder or column, a square pole, a spherical shape, and an oval shape).

Sometimes the nonwoven fiber assembly contains water remaining therein after the thermal bonding under moisture of part of the fibers of the fiber web in such a manner. If necessary, the fiber assembly after the water vapor treatment may be dried. As for drying, it is necessary that the fibers of the assembly surface contacting with a heating element for drying do not lose or deteriorate the fiber form or shape by melting due to heat. As long as the fiber form is maintained, the drying can employ a conventional manner (or process). For example, a large-scale dryer equipment which is used for drying a nonwoven fabric, such as a cylinder dryer or a tenter dryer may be used. However, since the remaining water content in the assembly is so small that the assembly can practically be dried by a relatively mild drying means, the drying means preferably used is a non-contacting manner (e.g., an extreme infrared rays irradiation, a microwave irradiation, and an irradiation of electron beam), a manner for blowing a hot air or a manner for allowing a hot air to pass through the assembly.

The substrate of the present invention is obtained by bonding the fibers of the web with the thermal adhesive fiber under moisture by applying the high-temperature water vapor on the web as mentioned above. Additionally, the substrate may also be obtained by a combination of the above manner with other conventional processes for bonding the obtained fiber assemblies to each other. The conventional process may include a partial thermocompression melt-bonding (e.g., heat emboss process), a partial mechanical compressing (e.g., needle-punching).

[Buffer Member]

The buffer member (or cushioning materials) of the present invention can be used as a buffer substrate in various fields (e.g., an industrial field, an agricultural field, and a field of a material of a commodity) due to a high air-permeability and an excellent cushion property and shape stability (retention property). The examples of the buffer member include a furniture (e.g., a sofa and a bed), a bedding (e.g., a futon or mattress), a clothing, a commodity (e.g., a sheet-like cushion and a mat or rug), a packaging (or packing) material, and a cushion of a vehicle. Furthermore, making use of the soft or tender texture or low skin irritability, the buffer member of the present invention can be used as a buffer substrate to contact with a human body or to be worn, e.g., a protective member (or a cushion) such as a brassiere cup, a shoulder pad, or a shoe insole.

The buffer member of the present invention may comprise the buffer substrate described above itself or may be formed by subjecting the substrate described above to a secondary molding by a mechanical process (e.g., a cutting), thermoforming, or the like. The thermoforming to be used may include, e.g., a pressure forming (e.g., an extrusion-pressure forming, a hot-plate pressure forming, a vacuum and pressure forming), a free blowing, a vacuum molding or forming, a bending, a matched-mold forming, a hot-plate molding, and a thermally press molding under moisture. In particular, since the substrate of the present invention can highly duplicate or reproduce the pattern or configuration of a metal mold, the substrate may be subjected to a pressing forming using a metal mold. For example, the substrate may be molded at a temperature of about 100 to 150° C. (particularly about 120 to 140° C.), with a pressure of about 0.05 to 2 MPa (particularly about 0.1 to 1 MPa).

(Cushion (or Cushion Member))

A substrate having a proportion (mass ratio) of the thermal adhesive fiber under moisture relative to the potential crimping conjugated fiber (the former/the latter) of 95/5 to 50/50 has an excellent compression recoverability. Such a substrate is useful as a seat cushion (such as an area or portion contacting with the buttocks or a backrest member or the like which contacts with the back) requiring a highly comfortable sitting (such as cushion property, durability, or air-permeability) over a travel or transfer for long hours with a vehicle (such an automobile, an auto two-wheeled vehicle, or a bicycle or train) or a transporting machine (such as a plane or a marine vessel).

The method for producing the cushion is not particularly limited to a specific one. For a nonwoven fiber assembly molded or formed into a plate- or sheet-like form, the plate-like assembly may be cut into a form or shape according to use and then processed, or the plate-like assembly may be subjected to a secondary molding by a thermoforming. If necessary, the above plate-like assembly may be a laminate comprising a plurality of the plate-like nonwoven fiber assemblies laminated on each other to have a desired thickness. When a seat cushion particularly is curved or bent depending on a form or configuration of a human body, it is efficient to use a secondary molding.

(Brassiere Cup)

Among the protective members, for example, a brassiere cup may be formed from the above substrate alone or a combination of the substrate and a fabric or the like, depending on kinds of brassiere cups. In a combination of the substrate and other fabric(s) (a fabric comprising a fiber), the substrate of the present invention may have at least one surface, particularly, the whole surface (both surface), covered with the fabric comprising a fiber.

The shape of the brassiere cup is usually a bowl (cup)-like shape (hollow hemispheric configuration) or a partial shape thereof which can cover a female breast. The substrate is not necessarily to be formed or molded into the above shape. The substrate may be folded into a brassiere shape and sewn together the brassiere or temporally tacked (with an adhesive tape, a velcro fastener or the like) on the brassiere. Concerning retaining the form of breast or the like, it is preferred that the substrate also be molded into the above cup-like shape or configuration. The method for molding the substrate into a cup-like shape may include a cutting. The preferred method comprises subjecting a plate- or sheet-like substrate to a secondary molding by a conventional thermoforming. Among the thermoformings, the preferred one includes a thermally press molding under moisture in which the substrate is pressed with supplying a high-temperature water vapor to the substrate.

In the thermally press molding under moisture, the particularly preferred method (process)) comprises holding a substrate between first and second metal molds having a large number of through-holes formed in predetermined positions; and jetting a high-temperature water vapor out from the through-holes of the first metal mold to apply the vapor on the substrate. The size of the through-hole of the metal mold may be, for example, about 0.5 to 3 mm (particularly about 1 to 2.5 mm). An excessively small size of the through-hole is easily clogged with impurities contained in the water vapor or the like. On the other hand, an excessively large size of the through-hole provides a large amount of water vapor to be jetted, and the surface of the brassiere cup easily gets a trace of the jetted water vapor due to the force thereof. Incidentally, the jetted high-temperature water vapor may be suctioned through the second metal mold. The shape of the through-hole is not particularly limited to a specific one and may be a circular shape, an oval shape, a triangular shape, a rectangular shape, a lozenge shape, a hexagonal shape, an octagonal shape, or the like. Among the shapes, a circular shape is preferred, in view of pressure drop or uniform jetting of the water vapor, durability of the through-hole, or the like. In terms of providing a high surface uniformity of a brassiere cup, the density of the through-hole on the metal mold surface may be, for example, about 0.05 to 2/cm$^2$ (particularly about 0.1 to 1/cm$^2$). The temperature of the water vapor is, for example, about 100 to 200° C., and preferably about 110 to 150° C., and the pressure of the water vapor is, for example, about 0.05 to 1 MPa, preferably about 0.07 to 1 MPa (e.g., about 0.1 to 1 MPa), and more preferably about 0.08 to 0.5 MPa (e.g., about 0.2 to 0.5 MPa). The water vapor as mentioned above is preferably jetted to the substrate without a pressure loss or a decrease in temperature.

(Shoe Insole)

Among the protective members, for example, a substrate for a shoe insole may be, depending on use or required performances of shoes, formed from the substrate alone or a combination of the substrate and other members comprising a rubber or the like (e.g., a sheet-like members). In a combination of the substrate and other members, the other members may have a shape or form covering all surface of a shoe, excluding an inner surface of a sole member formed from a foamed elastic body or a synthetic rubber conventionally used as a sole and the shoe inner surface which contacts with a wearer's foot (i.e., a shoe inner wall and shoe sole contacting with a wearer's foot may comprise at least the substrate of the present invention). The preferred shape is a shape which does not seriously deteriorate air-permeability.

In view of imparting various required performances to a shoe insole, it is preferred that the shoe insole be a laminate comprising a plurality of the substrates of the present invention, each having different formation of the nonwoven fiber. For example, the cushion property can be suitably controlled by laminating plate-like fiber assemblies, each having different density or basic weight or different proportion of the thermal adhesive fiber under moisture or the potential crimping conjugated fiber, or the like. In the laminate, each layer is preferably bonded to each other. The method for bonding the layers may include, for example, an existing method such as a thermally bonding or a chemical bonding. In light of preventing a decrease in air-permeability, the method preferably used is a thermally bonding (particularly, a method for bonding the thermal adhesive fibers under moisture to each other with heat). Moreover, in view of production efficiency, it is preferred that the substrates for an insole of the present invention be laminated and molded into an insole since the layers can be bonded to each other simultaneously.

Since the substrate of the present invention has an excellent moldability, according to use an uneven or irregular surface can be imparted to an insole formed from the substrate to improve a fitting property to a foot bottom. Moreover, for a purpose of a finger-pressure effect, an uneven or irregular structure can be imparted to a surface of the insole. In particular, in order to ensure foot comfort or fitting property to a foot bottom, it is preferred that an insole surface to be contacted with wearer's foot be molded into a form depending on purposes (e.g., a form conforming with the whole form of a foot bottom, a form having a fallen area to be contacted with a toe or heel, and a form having a raised area for fitting to a plantar arch). The process for molding the substrate into a shape fitting to wearer's foot may be a cutting. Preferably, a plate- or sheet-like substrate is subjected to a secondary molding with a conventional thermoforming. The secondary molding (thermoforming) used includes the same as the manner used for the brassiere cup.

Since the shoe insole of the present invention has the uniform bonded state and the uniform entangled state of the fibers, the shoe insole shows an excellent cushion property and air-permeability in spite of the fibers oriented almost in the surface direction. Moreover, during or in a use of the shoe insole, the following action is repeated as a wearer moves: the wearer's weight applied on the insole pushes air in voids in the insole out of the insole as if the air were pumped out; and the insole absorbs air with recovering its shape as the weight is removed. Since the fibers constituting the insole of the present invention are mainly oriented in the surface direction of the insole, the air released by the air releasing-absorbing action tends to pass (or to be released or discharged) through a lateral side of the insole. Further, the air released from the insole is efficiently discharged to the outside, through a material forming an instep of the shoe and along a surface of the feet, without remaining in the shoe. That is, the insole of the present invention has an effect that an air containing a moisture due to sweat coming from a wearer's foot is released to the outside as the wearer moves.

INDUSTRIAL APPLICABILITY

The buffer substrate of the present invention is used as a substrate for various buffer members, for example, a cushion and a protective member. Specifically, the substrate is used as a cushion of a furniture, a bedding, a vehicle, or the like (e.g., an automobile member, a member for a furniture or interior) or as a protective member for a body such as a clothing or a footwear (e.g., a sewn or molded brassiere cup or a substrate thereof, a shoulder pad, and substrate for a shoe insole).

EXAMPLES

Hereinafter, the following examples are intended to describe this invention in further detail and should by no means be interpreted as defining the scope of the invention. Each of the values of physical properties in Examples was measured by the following method. Incidentally, the terms "part(s)" and "%" are by mass unless otherwise indicated.

(1) Intrinsic Viscosity of Poly(ethylene Terephthalate) Resin

A sample of a poly(ethylene terephthalate) was dissolved in a mixed solvent containing phenol and tetrachloroethane in equal mass to prepare a solution having a concentration of 1 g/0.1 L. The flow times of the mixed solvent and the obtained solution at 30° C. were measured using a viscometer. The intrinsic viscosity [η] was calculated from the following equation (1):

[Equation 1]

$$\eta_{sp} = (t - t_0)/t_0 = (t/t_0) - 1 \quad (1)$$

$$[\eta] = \lim_{C \to 0} \eta_{sp}/C$$

providing that t represents the flow time (second) of the obtained solution, $t_0$ represents the flow time (second) of the mixed solvent, and C represents the concentration (g/L) of the sample.

(2) Basic Weight (g/m$^2$)

In accordance with JIS L1913 "Test methods for nonwovens made of staple fibers", the basic weight was measured.

(3) Thickness (mm) and Apparent Density (g/cm$^3$)

In accordance with JIS L1913 "Test methods for nonwovens made of staple fibers", the thickness was measured. The apparent density was calculated from the obtained thickness and the basic weight.

(4) Number of Crimps

In accordance with JIS L1015 "Test methods for man-made staple fiber" (8.12.1), the number of crimps was evaluated.

(5) Average Curvature Radius

Using a scanning electron microscope (SEM), a macrophotograph of a cross section of a nonwoven fiber assembly was taken (100 magnifications). Among the fibers observed in the photograph thereof, the curvature radius of each of fibers forming helix (coil) having at least one turn was measured by the following method: (1) drawing a circle along with the turn formed by the helix (by observing the crimped fiber from the coil axis direction) and (2) measuring a radius of the circle. Concerning a fiber forming a spiral having an oval shape, the half of the sum of the lengths of the major and minor axes of the oval-shaped loop or crimp was regarded as the curvature radius. In order to omit a fiber forming an insufficient (deformed or odd) crimp or loop or a fake or false oval or ellipse shape of a helix or crimp of fiber observed from a direction deviating from the coil axis direction from the measuring object, only the fiber having an oval-shaped loop or crimp having a ratio of the major axis relative to the minor axis within the range of 0.8 to 1.2 was regarded as the measuring object. Incidentally, the curvature radius was determined with respect to an SEM image of a cross section arbitrarily selected. The average curvature radius was calculated, given 100 as the number "n".

(6) Curved Ratio of Fiber (Curvature Ratio of Fiber) and Uniformity thereof

A cross section of the nonwoven fiber assembly was photographed with an electron micrograph (100 magnifications). The area in which the fibers were observed was equally divided in the thickness direction into three areas [a surface or front side layer, an inner or middle or intermediate layer, and a backside layer]. A measuring area was defined as an area which was in approximately middle of each layer and had a length of not less than 2 mm in the length direction and a width adjusted to allow the area to contain not less than 500 of the measurable fiber pieces. In each measuring area, a distance between both ends (the shortest distance) of the fiber was measured. Additionally, the fiber length (the fiber length on the photograph) of the same fiber was measured. That is, for an objective fiber having an end protruding from the inside of the nonwoven fiber assembly, the end was simply regarded as an end for measuring the distance between both ends. For an objective fiber having an end buried in the inside of the nonwoven fiber assembly, the boundary at which the fiber was buried or embedded in the inside of the fiber assembly and disappeared or became invisible on the photograph (the end of the fiber on the photograph) was regarded as an end for measuring the distance between both ends. Among the fibers photographed, a fiber which did not have a length of not less than 100 μm continuously on the photograph (image) was omitted from the measuring objects. The curved ratio of the fiber (L2/L1) [the ratio of the fiber length (L2) relative to the distance between both ends (L1)] was calculated. The average curved ratio of the fiber was calculated for each of the three areas (the surface layer, the inside layer, and the backside layer) obtained by dividing the cross section equally in the thickness direction. In addition, the uniformity of the curved ratio of the fiber in the thickness direction was calculated from the proportion of the maximum value among the curved ratios of the fiber in each of the layers relative to the minimum value among the curved ratios of the fiber therein.

FIG. 1 illustrates a schematic diagram of the manner for measuring the fiber photographed (or the fiber on the photograph). FIG. 1(*a*) illustrates a fiber having a first end protruding from the inside of the nonwoven fiber assembly and a second end buried in the inside of the nonwoven fiber assembly. In this case, the distance L1 between the ends is defined as a distance between the first end of the fiber and the boundary at which the fiber was buried or embedded in the inside of the nonwoven fiber assembly and disappears or becomes invisible on the photograph. On the other hand, the fiber length L2 is defined as a length obtained by straightening an observable area of the fiber (an area from a first end to a second end at which the fiber was buried or embedded in the inside of the nonwoven fiber assembly and disappears or becomes invisible on the photograph) two-dimensionally on the photograph.

FIG. 1(*b*) illustrates a fiber having both ends hiding in the nonwoven fiber assembly. In this case, the distance L1 between the ends is defined as a distance to be measured between the boundaries at which the fiber is buried or embedded in the inside of the nonwoven fiber assembly and disappears or becomes invisible on the photograph (the both ends observed on the photograph). On the other hand, the fiber length L2 is defined as a length obtained by straightening or extending an area of the fiber protruding from the inside of the nonwoven fiber assembly two-dimensionally on the photograph.

(7) Bonded Fiber Ratio (Ratio of Bonded Fiber)

The bonded fiber ratio was obtained by the following method: (1) taking a macrophotograph of a cross section with respect to the thickness direction of a fiber assembly (100 magnifications) using a scanning electron microscope (SEM); (2) dividing the obtained macrophotograph in the thickness direction equally into three; and (3) in each of the three areas [a surface or front side area, an inner or middle or intermediate area, and a backside area)], calculating the proportion (%) of the number of the cross sections of the fibers melt-bonded relative to the total number of the cross sections of the fibers (end sections of the fibers) which can be observed based on the equation mentioned below. In the contact part or area of the fibers, the fibers just contacted with each other without melt-bonding or adhered to each other by melt-bonding. The fibers which just contacted with each other disassembled at the cross section of the fiber assembly due to the stress of each fiber after cutting the fiber assembly for taking the microphotograph of the cross section. Accordingly, in the microphotograph of the cross section, the fibers which still contacted with each other were determined as being bonded.

Bonded fiber ratio(%)=(the number of the cross sections of the bonded fibers)/(the total number of the cross sections of the fibers)×100;

providing that in each microphotograph, all visible cross sections of the fibers were counted, and when the total number of the cross sections of the fibers was not more than 100, the observation was repeated with respect to macrophotograph which were taken additionally until the total number of the cross sections of the fibers became over 100. For each area which had been obtained by dividing the cross section equally in the thickness direction into three, the bonded fiber ratio was determined. The proportion of the minimum value of among the bonded fiber ratios in each of the three areas relative to the maximum value among the bonded fiber ratios therein was calculated as a uniformity of the bonded fiber ratio in the thickness direction.

(8) 25% Compression Stress, 50% Compression Stress, 25% Recovery/Compression Stress Ratio, and Compression Recovery Ratio In accordance with JIS K6400-2 "7.3 Stress-strain characteristic in compression B method", the 25% compression stress and 50% compression stress were determined by the following manner: (1) compressing a sample having a cylinder form of 30 mmϕ to 50% of the initial thickness by applying a 40-mmϕ circular pressure plate on the sample at a rate of 100 mm/minute; (2) returning the pressure plate at the same rate (removing the load at the same rate) to the initial position soon after the 50% compression; and (3) from the force-flexture curve obtained by the above compression, reading the value of a stress at 25% compression as a 25% compression stress and the value of a stress at 50% compression as a 50% compression stress. The ratio of the 25% recovery stress/25% compression stress was determined by the following manner: (1) reading the value of a stress when recovering the sample to 25% of the initial thickness in the 25% compression as a 25% recovery stress; and (2) calculating the ratio of the 25% recovery stress relative to the 25% compression stress. Moreover, the compression recovery ratio was calculated when after compression a recovery stress became "0".

(9) 25% Compression Stress Retention Ratio

In accordance with the above measuring method of 25% compression stress, the 25% compression stress retention ratio was measured by the following manner; (1) compressing a sample to an objective compression ratio (25% compression) by applying a compression device used in the measurement on the sample; (2) suspending the compression device to record a stress at this point; and (3) while keeping this compression state, measuring stresses after predetermined times (30 minutes, 1 hour, and 2 hours). The ratio of the stress after the predetermined time relative to the 25% compression stress when the compression device was suspended was expressed in percentage, as the stress retention ratio.

(10) Compression Ratio

Using a measuring instrument for nonwoven fabric thickness a load of 0.5 g/m$^2$ was applied on a fiber assembly to measure a thickness (A1) thereof. Then, a load of 35 g/m$^2$ was applied on the fiber assembly to measure a thickness (A2) thereof. The compression ratio was calculated from the following equation.

$$\text{Compression ratio}(\%)=100\times(A1-A2)/A1$$

(11) Elongation at Break and Stress at 30% Elongation

In accordance with JIS L1913 "Test methods for nonwovens made of staple fibers", a sample was elongated using a tensile tester. From the obtained measuring chart, the stress at an elongation of 30% was read and determined as the stress at 30% elongation. For each of the machine direction (MD) and cross direction (CD) of the nonwoven fabric, the elongation at break and stress at 30% elongation were measured.

(12) Recovery Strain After 30% Elongation

In accordance with JIS L1096 "Testing method for woven fabrics 8.13 Elongation elastic modulus", the recovery strain after 30% elongation was determined by the following manner: (1) preparing a sample having a width of 5 cm and a length of 20 cm; (2) stretching (or extending) the sample 30% at a tensile rate of 1 cm/minute with a clamp distance of 10 cm; and (3) soon returning the clamp at the same rate (removing the load at the same rate) to the initial position, and regarding an elongation when the stress became "0" as the recovery strain after 30% elongation.

(13) Shape Stability After Cutting

A nonwoven fiber sample was cut into a cubic shape having a side length of 5 mm. The obtained cubic sample was placed in an Erlenmeyer flask (100 cm$^3$) containing water of 50 cm$^3$. The flask was then set on a shaker ("MK160 type" manufactured by Yamato Scientic Co., Ltd.) and shaken for 30 minutes with rotating the flask under the condition of an amplitude of 30 mm at a shaking speed of 60 rpm. After shaking the flask, the form retention state and the change in the shape of the sample were visually observed.

(14) Thickness Variance

In accordance with JIS L1913 "Test methods for nonwovens made of staple fibers 6.3 Determination of thickness", the thicknesses at 10 points arbitrarily selected were measured. The average thickness was calculated therefrom. The ratio of the difference between the maximum and minimum values relative to the average thickness was expressed in percentage.

(15) Air-Permeability

In accordance with JIS L1096, the air-permeability of the fiber assembly was measured with a Frazier method.

(16) Water Retention Ratio (Water Absorption Ratio)

In accordance with JIS L1907 "Absorption ratio", the water retention ratio was measured as follows. A sample (5 cm in length and 5 cm in width) was prepared, and the weight (substrate weight) was measured. This sample was sunk in water for 30 seconds and then pulled out of water. The sample was hung in air for one minute with directing one corner upward to drain water spontaneously from the surface of the sample. Thereafter, the weight of the sample (weight after water absorbing) was measured. The water retention ratio was calculated based on the following equation.

Water absorption ratio=[(the weight after water absorbing)−(the substrate weight)]/(the substrate weight)×100(%)

(17) Rate of Water Absorption

In accordance with JIS-L1907 "Test methods for water absorption properties of fiber product", the rate of water absorption was measured as follows. One water droplet of 0.05 g/drop was dropped on a substrate from a level 10 mm high, and the time required for the sample to absorb the droplet was measured.

(18) Moisture-Permeability

In accordance with JIS L1099 "Test methods for moisture-permeability of fiber product A-1 calcium chloride method", the moisture-permeability was measured.

(19) Surface Hardness

In accordance with an FO type durometer hardness test (the test in accordance with JIS K6253 "Rubber, vulcanized or thermoplastic-determination of hardness"), the surface hardness was measured.

(20) Evaluation as Seat of Automobile

The sitting comfort was evaluated by the following manner: (1) cutting a 30-cm square pad portion (having a thickness of about 3 cm) out of a seat member of a passenger seat of an automobile so as to include an area contacting with the buttocks in an approximately middle region in the cut-out pad part; (2) inserting the nonwoven fiber assembly, each being obtained in Examples and Comparative Examples, in the depression instead of the cut-out pad portion; and (3) evaluating the comfortable sitting of the seat comprising the nonwoven fiber assembly inserted therein based on the following criteria. Incidentally, the cut-out pad portion had a curved form, depending on the form of the buttocks, to allow the center area of the cut-out pad portion to be the middle of the bottom of the seat.

(Elasticity)

A: Excellent cushion property and comfortable

B: Soft and lack of elasticity

C: Almost no cushion property

D: No cushion property (Settling)

A: Almost no settling

B: Slight settling

C: Partial shape recovery and considerable settling

D: Great settling and no shape recovery (Sense of Humidity)

A: Not humid

B: Slightly humid

C: Humid

D: Very humid

(21) Pushing Resilience of Molded Product

The pushing of the molded product was conducted by the following manner: (1) placing a substrate (a molded product) molded into a brassiere cup using a metal mold on a pedestal with directing a top of the cup upward (with facing a top of the cup in a direction opposing to gravity); (2) pushing a 40-mmϕ) circular plane device or piece whose center corresponded to the top of the cup-like shaped substrate 15 mm from the top thereof at a rate of 100 mm/minute; and (3) allowing the shape of the cup to return to the initial one at the same rate. While measuring the stress, the behavior of the cup when the place device or piece was returned was observed and evaluated based on the following criteria. Incidentally, the pedestal had a form or shape whose surface was contacted with the entire bottom peripheral of the cup placed on the pedestal in the above manner. Moreover, from the chart recoding a change in stress in this pushing-recovery action in accordance with JIS K6400-2 "7.3 Stress-strain characteristic in compression B method", the following stresses were read: a stress at 7.5-mm pushing in 15-mm pushing (regarded as a 7.5-mm pushing stress); a stress at 15-mm pushing in 15-mm pushing (regarded as a 15-mm pushing stress); and a stress at 7.5-mm in a recovery after 15-mm pushing (regarded as a 7.5-mm recovery stress). The ratio of the 7.5-mm recovery stress relative to the 7.5-mm pushing stress was calculated as a ratio of 7.5-mm recovery stress/7.5-mm pushing stress.

A: Complete recovery to the state before pushing

B: Insufficient recovery to the state before pushing

C: No recovery from the pushed state

(22) Durability to Washing (Height Retention Ratio)

In accordance with JIS L0844 "Test methods for color fastness to washing and laundering", a washing test of a sample was conducted. The durability to washing was evaluated by the following manner: (1) placing a substrate (a molded product) molded into a brassiere cup using a metal mold on a pedestal with directing a top of the cup upward (with facing a top of the cup in a direction opposing to gravity); and (2) measuring the height from the surface of the pedestal to the top of the cup with respect to both before and after washing. The ratio (%) of the height after washing relative to the height before washing was calculated as a durability to washing.

Example 1

A Sheath-Core Structure Conjugated Staple Fiber ("Sofista" manufactured by Kuraray Co., Ltd., having a fineness of 3 dtex, a fiber length of 51 mm, a sheath-core mass ratio of 50/50, a number of crimps of 21/25 mm, and a degree of crimp of 13.5%) was prepared as a thermal adhesive fiber under moisture. The core component of the conjugated staple fiber comprised a poly(ethylene terephthalate) and the sheath component of the conjugated staple fiber comprised an ethylene-vinyl alcohol copolymer (having an ethylene content of 44 mol % and a degree of saponification of 98.4 mol %).

A side-by-side structure conjugated staple fiber ("PN-780" manufactured by Kuraray Co., Ltd., having a fineness of 1.7 dtex, a fiber length of 51 mm, a number of mechanical crimps of 12/25 mm, and a number of crimps of 62/25 mm after a heat treatment at 130° C. for one minute) was prepared as a potential crimping fiber. The conjugated fiber comprised a poly (ethylene terephthalate) resin (A component) having an intrinsic viscosity of 0.65 and a modified poly(ethylene terephthalate) resin (B component). The B component was a poly(ethylene terephthalate) resin modified or copolymerized with 20 mol % of isophthalic acid and 5 mol % of diethylene glycol as copolymerizing components.

The sheath-core structure conjugated staple fiber (the thermal adhesive fiber under moisture) and the side-by-side structure conjugated staple fiber (the potential crimping fiber) were blended with each other in amass ratio (the former/the latter) of 20/80. Thereafter, a card web having a basic weight of about 100 g/m$^2$ was produced by a carding process. Then seven sheets of the card webs were put in layers to give a card web having a total basic weight of 700 g/m$^2$.

The resulting card web was transferred to a belt conveyor equipped with a 50-mesh stainless-steel endless belt having a width of 500 mm. Incidentally, above the belt conveyor, a belt conveyor having the same metal mesh was disposed, the belt conveyors independently revolved at the same speed rate in the same direction, and the clearance between the metal mesh was adjustable arbitrarily.

Then the card web was introduced to a water vapor spraying apparatus attached on the lower belt conveyor. The card web was subjected to a water vapor treatment by spraying the card web (perpendicularly) with a water vapor jetted at a pressure of 0.4 MPa from the water vapor spraying apparatus so that the water vapor penetrated the web in the thickness direction of the web. Thereafter the card web was dried with hot air having a temperature of 120° C. for one minute to give a nonwoven fiber assembly. The water vapor spraying apparatus had a nozzle disposed in the inside of the under conveyor so as to spray to the web with the high temperature water vapor through the conveyor net. A suction apparatus was disposed inside the upper conveyor. In a downstream side in the web traveling direction with respect to this spraying apparatus, another pair of a nozzle and a suction apparatus in inverse arrangement of the above pair was disposed. In this way, the both surfaces of the web were subjected to the water vapor treatment.

Incidentally, the water vapor spraying apparatus used had nozzles, each having a pore size of 0.3 mm, and these nozzles were arranged in a line parallel to the width direction of the conveyor in a pitch of 1 mm. The processing speed was 3 m/minute, and the clearance (distance) between the upper and lower conveyor belts was disposed was 10 mm. Each of the nozzles was disposed on the backside of the belt so that the nozzle almost contacted with the belt.

The results are shown in Table 1.

Figure 2:
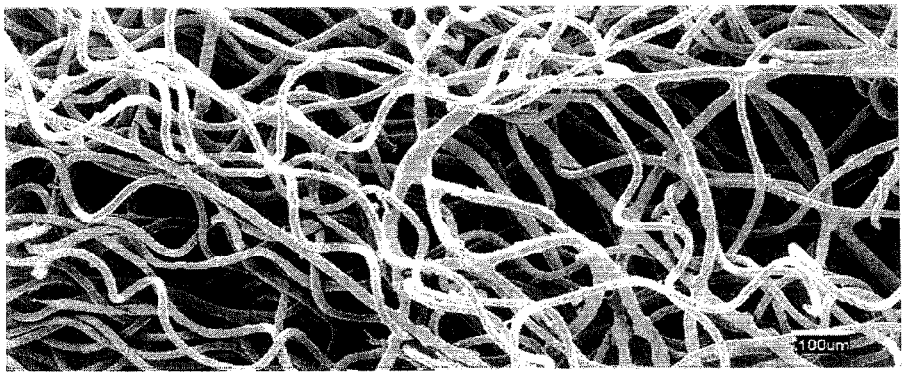
FIG. 2 is an electron micrograph of a surface of the buffer substrate obtained in Example 1.
Figure 3:
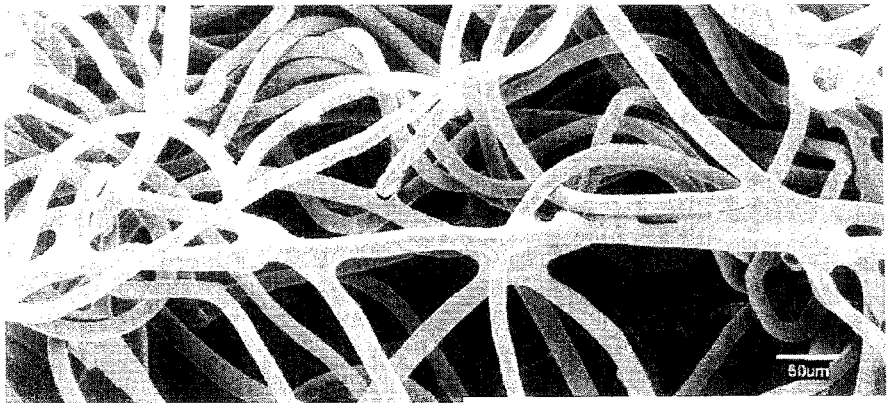
FIG. 3 is an electron micrograph of a surface of the buffer substrate obtained in Example 1.

The results of taking photographs of a surface of the obtained fiber assembly (buffer substrate) with an electron micrograph are shown in FIGS. 2 and 3. FIG. 3 is twice as much as that of FIG. 2. Incidentally, scale bars in the electron micrographs respectively indicate 100 μm in FIG. 2 and 50 μm in FIG. 3.

Figure 4:
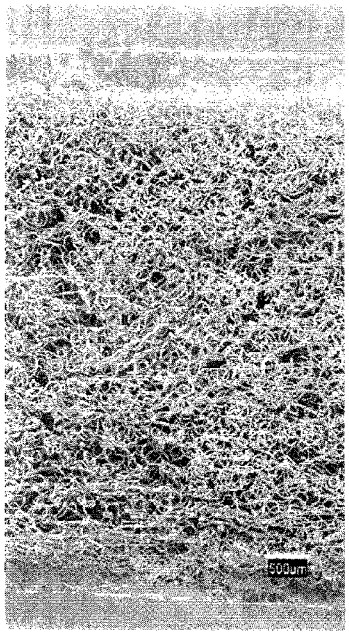
FIG. 4 is an electron micrograph of a cross section in the thickness direction of the buffer substrate obtained in Example 1.
Figure 5:
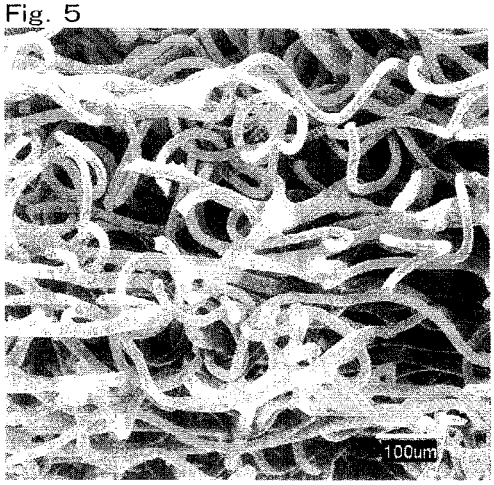
FIG. 5 is an electron micrograph of a cross section in the thickness direction of the buffer substrate obtained in Example 1.

Moreover, the results of taking photographs of a cross section in the thickness direction of the obtained fiber assembly with an electron micrograph are shown in FIGS. 4 and 5. FIG. 5 is five times as much as that of FIG. 4. Incidentally, the lengths of scale bars in the electron micrographs respectively indicate 500 μm in FIG. 4 and 100 μm in FIG. 5.

As apparent from results of FIGS. 2 to 5, it was observed that in the buffer substrate obtained in Example 1, the fibers were oriented in an approximately parallel to a surface direction of the substrate and bonded at the intersecting points thereof by melting the thermal adhesive fiber under moisture as well as each of the crimped fiber had a uniform approximately coil-like crimp in the thickness direction.

Example 2

In the same manner as in Example 1 except for blending the thermal adhesive fiber under moisture and the potential crimping conjugated fiber with each other in the proportion (mass ratio) (the former/the latter) of 10/90, a fiber assembly (buffer substrate) was obtained. The results are shown Table 1.

Example 3

In the same manner as in Example 1 except for blending the thermal adhesive fiber under moisture and the potential crimping conjugated fiber with each other in the proportion (mass ratio) (the former/the latter) of 60/40, a fiber assembly (buffer substrate) was obtained. The results are shown Table 1.

Example 4

In the same manner as in Example 1 except for using a side-by-side structure conjugated staple fiber ("PN-780", manufactured by Kuraray Co., Ltd., having a fineness of 3.3 dtex, a fiber length of 51 mm, a number of mechanical crimps of 12/25 mm, and a number of crimps of 62/25 mm after a heat treatment at 130° C. for one minute) as the potential crimping fiber, a fiber assembly (buffer substrate) was obtained. The results are shown Table 1.

Comparative Example 1

In the same manner as in Example 1 except for heat-treating a card web in a hot air dryer at a temperature of 150° C. for three minutes instead of a water vapor treatment, a fiber assembly was obtained. The results are shown Table 1.

Comparative Example 2

Figure 6:
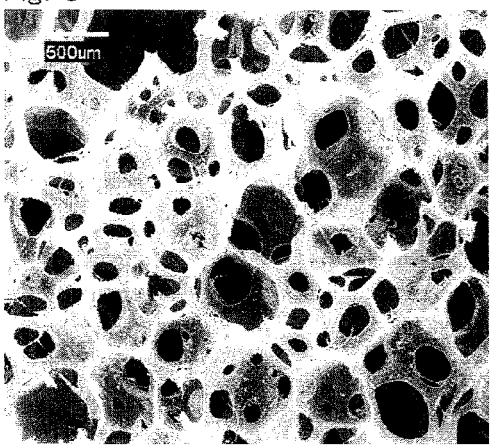
FIG. 6 is an electron micrograph of a surface of a commercially available foamed polyethylene board used in Comparative Example 2.

A commercially available foamed polyethylene (manufactured by LION Corporation, Lion board, 5 mm in thickness) was evaluated. The results are shown Table 1. The result of taking a photograph of a surface of the obtained foamed polyethylene board using an electron micrograph is shown in FIG. 6. Incidentally, the length of a scale bar in the electron micrographs indicates 500 μm.

TABLE 1

| | Examples | | | | Comparative Examples | |
|---|---|---|---|---|---|---|
| | 1 | 2 | 3 | 4 | 1 | 2 |
| Average curvature radius (μm) | 106 | 97 | 132 | 81 | 224 | — |
| Curved ratio (surface) | 1.75 | 1.81 | 1.63 | 1.82 | 1.42 | — |
| Curved ratio (inside) | 1.62 | 1.74 | 1.36 | 1.73 | 0.98 | — |
| Curved ratio (backside) | 1.89 | 1.87 | 1.59 | 1.9 | 1.39 | — |

TABLE 1-continued

| | Examples | | | | Comparative Examples | |
|---|---|---|---|---|---|---|
| | 1 | 2 | 3 | 4 | 1 | 2 |
| Distribution of curved ratio (uniformity) (%) | 85.7 | 93.0 | 85.5 | 91.1 | 69.0 | — |
| Bonded fiber ratio (surface) (%) | 7.2 | 6.3 | 23.2 | 6.9 | 4.6 | — |
| Bonded fiber ratio (inside) (%) | 8.4 | 5.9 | 17.9 | 7.3 | 1.1 | — |
| Bonded fiber ratio (backside) (%) | 9.3 | 6.6 | 21.5 | 7.7 | 4.7 | — |
| Distribution of bonded fiber ratio (uniformity) (%) | 77.4 | 89.4 | 77.2 | 89.6 | 23.4 | — |
| Density (g/cm$^3$) | 0.11 | 0.09 | 0.18 | 0.13 | 0.022 | 0.018 |
| 25% Recovery/compression stress ratio (%) | 27 | 36 | 17 | 31 | 12 | 52 |
| 25% Compression stress (N/30 mm) | 12.5 | 11.1 | 21.7 | 14.3 | 0.044 | 22.4 |
| 50% Compression stress (N/30 mm) | 57.5 | 46.2 | 82.7 | 62.4 | 0.11 | 61.2 |
| Compression ratio (%) | 13.3 | 17.1 | 5.2 | 10.5 | 45 | 19.2 |
| Elongation at break in MD (%) | 115 | 128 | 171 | 123 | 82 | 66 |
| Elongation at break in CD (%) | 56 | 48 | 82 | 63 | 34 | 70 |
| Recovery strain after 30% elongation | 9.7 | 11.3 | 6.7 | 7.6 | 21.4 | 13.1 |
| Shape stability | Retained | Retained | Retained | Retained | Easily broken | Retained |
| Thickness variance (%) | 3.2 | 4.1 | 2.1 | 3.3 | 13.6 | 0.7 |
| Air-permeability (ml/cm$^2$ · second) | 12 | 34 | 6 | 16 | 105 | 0 |

As apparent from the results in Table 1, each of the fiber assemblies obtained in Examples was a excellent cushion in which the falling off of the fibers was prevented and which had an excellent shape stability as well as an excellent cushion property and a high air-permeability.

Example 5

The thermal adhesive fiber under moisture and the potential crimping conjugated fiber were blended with each other in a mass ratio (the former/the latter) of 80/20, and a card web having a basic weight of about 500 g/m$^2$ was produced by a carding process. Then 6 sheets of the obtained webs were put in layers to form a card web having a total basic weight of 3240 g/m$^2$. Except for the clearance (distance) between the upper and lower (nozzle side and suction side) conveyor belts was 30 mm, a nonwoven fiber assembly having a thickness of 27.9 mm was obtained in the same manner as in Example 1. This fiber assembly was a buffer substrate, in which the falling off of the fibers was prevented and which had an excellent shape stability as well as an excellent cushion property and high degree of air-permeability. Moreover, this buffer substrate was dried with a hot air having a temperature of 120° C. for one minute. Thereafter, this substrate was subjected to a pressing using a metal mold having a curved surface corresponding to the shape of the buttocks at a sitting position for 120 seconds under the condition of a temperature of 135° C. and a pressure of 0.5 MPa to obtain a cup-like shape seat cushion (diameter: 150 mmϕ, height: 60 mm). The obtained seat cushion was subjected to the evaluation test of a seat of an automobile. The results are shown Table 2.

Example 6

The thermal adhesive fiber under moisture and the potential crimping conjugated fiber were blended with each other in a mass ratio (the former/the latter) of 55/45, and a card web having a basic weight of about 500 g/m$^2$ was produced by a carding process. Then ten sheets of the obtained webs were put in layers to form a card web having a total basic weight of 5123 g/m$^2$. Except for using the card web, a nonwoven fiber assembly having a thickness of 31.3 mm was obtained in the same manner as in Example 5. This fiber assembly was a buffer substrate, in which the falling off of the fibers was prevented and which had an excellent shape stability as well as an excellent cushion property and a high air-permeability. Using this cushion, a seat cushion was molded in the same manner as in Example 5. The results are shown Table 2.

Example 7

Except for laminating four sheets of the webs each having a basic weight of about 500 g/m$^2$ on another to form a card web having a total basic weight of 2137 g/m$^2$, a nonwoven fiber assembly having a thickness of 31.4 mm was obtained in the same manner as in Example 5. This fiber assembly was a buffer substrate in which the falling off of the fibers was prevented and which had an excellent shape stability as well as an excellent cushion property and a high air-permeability. Using this cushion, a seat cushion for a seat was molded in the same manner as in Example 5. The results are shown Table 2.

Comparative Example 3

The thermal adhesive fiber under moisture and the potential crimping conjugated fiber were blended with each other in a mass ratio (the former/the latter) of 80/20, and a card web having a basic weight of about 500 g/m$^2$ was produced by a carding process. A nonwoven fiber assembly was obtained in the same manner as in Example 1 except for heat-treating the card web in a hot-air dryer at 150° C. for 3 minutes while passing through the clearance between the two conveyers disposed with a distance therebetween of 3 mm instead of treating with a high-temperature water vapor. Ten sheets of the obtained nonwoven fiber assemblies were put in layers to produce a buffer substrate having a thickness of 33.7 mm and basic weight of 4977 g/m$^2$. Using this buffer substrate, a seat cushion was molded in the same manner as in Example 5. The results are shown Table 2.

TABLE 2

| | Examples | | | Comparative Example |
|---|---|---|---|---|
| | 5 | 6 | 7 | 3 |
| Average curvature radius (μm) | 142 | 104 | 121 | 182 |
| Curved ratio (surface) | 1.36 | 1.63 | 1.38 | 1.80 |

TABLE 2-continued

| | Examples | | | Comparative Example |
|---|---|---|---|---|
| | 5 | 6 | 7 | 3 |
| Curved ratio (inside) | 1.32 | 1.51 | 1.34 | 1.11 |
| Curved ratio (backside) | 1.52 | 1.88 | 1.54 | 2.13 |
| Distribution of curved ratio (uniformity) (%) | 86.8 | 80.3 | 87.0 | 52.1 |
| Bonded fiber ratio (surface) (%) | 17.6 | 19.2 | 10.7 | 34.2 |
| Bonded fiber ratio (inside) (%) | 15.8 | 16.4 | 9.6 | 6.4 |
| Bonded fiber ratio (backside) (%) | 16.9 | 21.1 | 11.2 | 29.2 |
| Distribution of bonded fiber ratio (uniformity) (%) | 89.8 | 77.7 | 85.7 | 18.7 |
| Density (g/cm$^3$) | 0.12 | 0.17 | 0.07 | 0.148 |
| FO hardness | 92 | 78 | 82 | 88 |
| Air-permeability (ml/cm$^2$ · second) | 1.7 | 2.8 | 6.5 | 12 |
| 25% Recovery/compression stress ratio (%) | 31 | 46 | 39 | 13 |
| 25% Compression stress (N/30 mm) | 35 | 26 | 24 | 53 |
| 25% Recovery stress (N/30 mm) | 11 | 12 | 8 | 11 |
| 50% compression stress (N/30 mm) | 127 | 159 | 98 | 237 |
| Compression recovery ratio (%) | 96 | 88 | 92 | 53 |
| Compression stress retention ratio 30 minutes | 78 | 73 | 71 | 48 |
| Compression stress retention ratio 1 hour | 72 | 61 | 66 | 42 |
| Compression stress retention ratio 2 hours | 69 | 58 | 62 | 40 |
| Elasticity | A | A | A | B |
| Settling | A | B | B | D |
| Sense of humidity | A | A | B | C |

As apparent from the results in Table 2, each of the buffer substrates obtained in Examples had a high compression recovery ratio, an excellent cushion property, a high air-permeability, and a highly comfortable sitting as a seat cushion of an automobile. In particular, the cushion in Example 7 had a low compression stress and was easily deformed compared with the other cushions and thus easily fitted to a human body. On the other hand, when one sat on the cushion obtained in Comparative Example, which had been subjected to the hot-air treatment, the cushion was exceedingly soft and readily sank. Therefore, the cushion was uncomfortable for sitting. Presumably, the reason for that was that since in the above cushion, the melt-bond of the fibers was formed by the hot air, the heat was not conducted to the inside of each layer. That is, it can be inferred that since the hot-air treatment can provide a sufficient bonded ratio of a surface area of the substrate but a low bonded ratio of a middle area in the thickness direction in each layer, the middle area easily deforms when applied a load on the cushion. Additionally, the cushion obtained in Comparative Example had a low compression recovery ratio and was uncomfortable as a seat cushion of an automobile.

Example 8

The thermal adhesive fiber under moisture and the potential crimping conjugated fiber were blended with each other in a mass ratio (the former/the latter) of 30/70, and a card web having a basic weight of about 100 g/m$^2$ was produced by a carding process. Then four sheets of the webs were put in layers to produce a card web having a total basic weight of 400 g/m$^2$. A buffer substrate (9.5 mm in thickness) was obtained in the same manner as in Example 1 except for using the resulting card web. The results are shown in Table 3.

Then, the substrate was subjected to a pressing using a metal mold having a brassiere cup configuration or shape for 120 seconds under the condition of a temperature of 135° C. and a pressure of 0.5 MPa to obtain a cup-like shape brassiere cup (diameter: 150 mmϕ, height: 60 mm). The obtained brassiere cup reproduced the fine configuration of the metal mold and was in a good molded state. The evaluation results of the molded product are shown in Table 4.

Additionally, the obtained brassiere cup was evaluated for air-permeability, water retention ratio, rate of water absorption, and moisture-permeability as well as the substrate. The decreases in properties were not observed. On the other hand, for a cup (made of a foamed polyurethane) of a commercially available brassiere (manufactured by Maindenform Ltd., a brassiere 34B style No. 7959) the rate of water absorption was evaluated, and the cup hardly absorbed water.

Example 9

In the same manner as in Example 8 except for blending the thermal adhesive fiber under moisture and the potential crimping conjugated fiber with each other in a proportion (mass ratio) (the former/the latter) of 10/90, a buffer substrate was obtained. The results are shown in Table 3. Further, the results of the brassiere cup molded from the obtained substrate are shown in Table 4.

Example 10

In the same manner in Example 8 except for blending the thermal adhesive fiber under moisture and the potential crimping conjugated fiber with each other in a proportion (mass ratio) (the former/the latter) of 40/60, a buffer substrate was obtained. The results are shown in Table 3. Further, the results of the brassiere cup molded from the obtained substrate are shown in Table 4.

Example 11

The buffer substrate obtained in Example 8 was placed on a metal mold having a brassiere cup configuration or shape and circular through-holes each having a diameter of 1.6 mmϕ disposed at a rate of 0.3 pore/cm$^2$. A water vapor having a pressure of 0.1 MPa was jetted to the substrate for five seconds for pre-heating. With jetting the water vapor thereto, a pressing of the substrate was started under the condition of a temperature of 105° C. and a pressure of 0.5 MPa. After 20 seconds, the jetting of the water vapor was suspended while keeping the compression. Then, for 20 seconds, the water vapor was sucked from the metal mold surface from which the water vapor had been jetted. In this manner, a cup-like shape brassiere cup (diameter: 150 mmϕ, height: 60 mm) was obtained. The obtained brassiere cup duplicated or reproduced the fine configuration of the metal mold and was in a good molded state. The evaluation results of the molded product are shown in Table 4.

Comparative Example 4

Using a sheath-core structure conjugated staple fiber (having a fineness of 2.2 dtex, a fiber length of 51 mm, a sheath-core mass ratio of 50/50, and a degree of crimp of 13.5%) as a thermally melt-bondable fiber instead of the thermal adhesive fiber under moisture, a car web was produced in the same manner as in Example 1. In the staple fiber, the core component was a poly(ethylene terephthalate) and the sheath component was a low density polyethylene (MI=11 g/10 minutes). Four sheets of the webs were put in layers as in Example 8 in attempt to integrate the webs. However, the webs could not be melt-bonded while keeping a soft texture. On the other hand, the webs which were melt-bonded to each other for easy handling had a surface in which the fibers were exceedingly melt-bonded, whereby the soft texture of the web could not be maintained. Then, each web was exposed to a hot air having a temperature of 130° C. for 30 seconds to melt-bond the thermally melt-bondable fiber. In this way, a nonwoven fabric was obtained. The evaluation results of the nonwoven fabric are shown in Table 3.

Then, a laminate of four sheets of the nonwoven fabrics were molded into a brassiere cup shape under the same condition as in Example 1 except for a molding temperature of 120° C., and a brassiere cup was obtained. The results of the compression test of this cup are shown in Table 4. The surface of this cup was very hard, and the whole of the cup showed a high compression stress. When the cup was pushed to 50% of the initial height, the shape of the cup remained dent and did not recover its original form.

TABLE 3

| | Examples | | | Comparative Example |
|---|---|---|---|---|
| | 8 | 9 | 10 | 4 |
| Average curvature radius (μm) | 103.4 | 97 | 127 | 124 |
| Curved ratio (surface) | 1.71 | 1.88 | 1.69 | 1.92 |
| Curved ratio (inside) | 1.46 | 1.81 | 1.53 | 1.08 |
| Curved ratio (backside) | 1.79 | 1.92 | 1.77 | 1.49 |
| Distribution of curved ratio (uniformity) (%) | 81.6 | 94.3 | 86.4 | 56.3 |
| Bonded fiber ratio (surface) (%) | 15.3 | 5.2 | 16.2 | 2.6 |
| Bonded fiber ratio (inside) (%) | 9.5 | 4.9 | 12.3 | 1.1 |
| Bonded fiber ratio (backside) (%) | 13.1 | 5.6 | 14.8 | 1.7 |
| Distribution of bonded fiber ratio (uniformity) (%) | 62.1 | 87.5 | 75.9 | 42.3 |
| Basic weight (g/m$^2$) | 467.4 | 394.1 | 426.3 | 97.7 |
| Thickness (mm) | 9.5 | 11.2 | 8.1 | 4.4 |
| Density (g/cm$^3$) | 0.049 | 0.035 | 0.053 | 0.022 |
| 25% Recovery/compression stress ratio (%) | 37.5 | 16 | 42 | 12 |
| 25% Compression stress (N/30 mm) | 1.91 | 0.9 | 2.7 | 0.024 |
| 50% Compression stress (N/30 mm) | 4.64 | 3.8 | 4.8 | 0.08 |
| Compression ratio (%) | 64.7 | 77.1 | 55.9 | 88.3 |
| Elongation at break in MD (%) | 53 | 48 | 82 | 37 |
| Elongation at break in CD (%) | 132 | 128 | 171 | 142 |
| Stress afrer 30% elongation in MD (%) | 10.2 | 8.7 | 10.7 | 2.1 |
| Stress after 30% elongation in CD (%) | 9.9 | 6.1 | 10.2 | 0.96 |
| Air-permeability (ml/cm$^2$ · second) | 65 | 94 | 56 | 205 |
| Water retention ratio (wt %) | 2011 | 1394 | 2820 | 637 |
| Rate of water absorption (second) | 0 | 0 | 0 | 1.2 |
| Moisture-permeability (g/cm$^2$ · hr) | 281 | 361 | 274 | Not less than 1000 |

TABLE 4

| | Examples | | | | Comparative Example |
|---|---|---|---|---|---|
| | 8 | 9 | 10 | 11 | 4 |
| Thickness (mm) | 4.32 | 4.61 | 3.78 | 4.41 | 3.41 |
| Density (g/cm$^3$) | 0.108 | 0.085 | 0.113 | 0.079 | 0.115 |
| Curved ratio (surface) | 2.68 | 2.79 | 2.61 | 2.73 | 3.21 |
| Curved ratio (inside) | 1.63 | 1.92 | 1.58 | 2.19 | 1.54 |
| Curved ratio (backside) | 2.66 | 2.87 | 2.54 | 2.77 | 3.12 |
| Distribution of curved ratio (uniformity) (%) | 60.8 | 66.9 | 60.5 | 79.1 | 48 |
| Bonded fiber ratio (surface) (%) | 23.7 | 8.3 | 23.1 | 28.7 | 22.4 |
| Bonded fiber ratio (inside) (%) | 16.6 | 5.4 | 14.2 | 27.1 | 3.3 |
| Bonded fiber ratio (backside) (%) | 21.4 | 7.6 | 22.7 | 29.2 | 21.5 |
| Distribution of bonded fiber ratio (uniformity) (%) | 70 | 65.1 | 61.5 | 92.8 | 14.7 |
| Pushing resilience (Before washing) | A | A | A | A | C |
| 7.5-mm recovery/compression stress ratio (%) | 38.7 | 20.9 | 46 | 37.2 | 0 |
| 7.5-mm compression stress (N/30 mm) | 1.22 | 0.43 | 1.76 | 1.12 | 3.07 |
| 15-mm compression stress (N/30 mm) | 2.05 | 0.78 | 3.83 | 1.82 | 5.21 |
| 7.5-mm recovery stress (N/30 mm) | 0.47 | 0.09 | 0.81 | 0.417 | 0 |

TABLE 4-continued

| | Examples | | | | Comparative Example |
|---|---|---|---|---|---|
| | 8 | 9 | 10 | 11 | 4 |
| (After washing) | | | | | |
| 7.5-mm recovery/compression stress ratio (%) | 23.6 | 16.4 | 32.1 | 34.4 | 0 |
| 7.5-mm compression stress (N/30 mm) | 0.72 | 0.24 | 1.02 | 0.616 | 1.17 |
| 15-mm compression stress (N/30 mm) | 0.96 | 0.31 | 1.28 | 0.853 | 1.83 |
| 7.5-mm recovery stress (N/30 mm) | 0.17 | 0.04 | 0.33 | 0.212 | 0 |
| Durability to washing (height retention) (%) | 86 | 81 | 89 | 92 | 23.2 |

As apparent from the results in Tables 3 and 4, the substrates and brassiere cups obtained in Examples had a high air-permeability and a capability of retaining a large amount of water and an excellent shape stability as well as an excellent cushion property.

Example 12

Before transferring to a belt conveyor equipped with an endless metal net (mesh), the card web having a total basic weight of 400 g/m$^2$ was traveled on a conveyer net to pass through a porous plate drum having pores, each having a diameter of 1 mmϕ and arranged in a hound's-tooth pattern at a pitch of 2 mm, and a water flow was sprayed to a web and the conveyor net at a pressure of 0.8 MPa from the inside of the drum. In the same manner as in Example 8 except for the mentioned above, a substrate (having a thickness of 8.0 mm) for a buffer member was obtained. The obtained substrate had a high-density portion and a low-density portion formed alternately at a pitch of 2 mm. The high density portion had a large proportion of the fibers oriented in the thickness direction, and in a center portion thereof, holes, each having a pore diameter of about 0.1 to 1.0 mm, was formed. The results are shown in Table 5.

The obtained substrate was subjected to a pressure molding in the same manner as in Example 11 to give a cup-like shape brassiere cup (diameter: 150 mmϕ, and height: 60 mm). The obtained brassiere cup duplicated even a fine configuration of the metal mold and had a good molded state. The results of the evaluation of the molded product are shown in Table 6. Additionally, for the obtained brassiere cup as well as the substrate, air-permeability, water retention ratio, rate of water absorption, moisture-permeability were evaluated. In comparison with the substrate, no performance decrements were observed.

Example 13

In the same manner as in Example 12 except for blending the thermal adhesive fiber under moisture and the potential crimping conjugated fiber in a proportion (mass ratio) (the former/the latter) of 10/90, a buffer substrate was obtained. The obtained substrate had holes similar to that in Example 12. The results are shown in Table 5. Further, the results of a brassiere cup molded from the obtained substrate are shown in Table 6.

Example 14

In the same manner as in Example 12 except for blending the thermal adhesive fiber under moisture and the potential crimping conjugated fiber in a proportion (mass ratio) (the former/the latter) of 40/60, a buffer substrate was obtained. The obtained substrate had holes similar to that in Example 12. The results are shown in Table 5. Further, the results of a brassiere cup molded from the obtained substrate are shown in Table 6.

Example 15

The thermal adhesive fiber under moisture and the potential crimping conjugated fiber were blended with each other in a mass ratio (the former/the latter) of 30/70, and a card web having a basic weight of about 250 g/m$^2$ was produced by a carding process. In the same manner as in Example 12 except for using the web without putting the webs in layers, a buffer substrate was obtained. The obtained substrate had holes similar to that in Example 12. The results are shown in Table 5. Additionally, the results of a brassiere cup molded from the obtained substrate are shown in Table 6.

Example 16

The thermal adhesive fiber under moisture and the potential crimping conjugated fiber were blended with each other in a mass ratio (the former/the latter) of 30/70 to produce, and a card web having a basic weight of about 500 g/m$^2$ was produced by a carding process. In the same manner as in Example 12 except for using the web without putting the webs in layers, a buffer substrate was obtained. The obtained substrate had holes similar to that in Example 12. The results are shown in Table 5. Additionally, the results of a brassiere cup molded from the obtained substrate are shown in Table 6.

Example 17

In the same manner as in Example 1 except for using the buffer substrate obtained in Example 12 and not jetting water vapor and the condition of a molding temperature of 135° C. and a pressing time of 120 seconds. The buffer substrate obtained in Example 12 was molded into a brassiere cup. The compressing test results of the cup are shown in Table 8. The cup had a very hard surface, and the whole of the cup showed a high compression stress.

Example 18

In the same manner as in Example 12 except for blending the thermal adhesive fiber under moisture and the potential crimping conjugated fiber at a proportion (mass ratio) (the former/the latter) of 5/95, a buffer substrate was obtained. The obtained substrate had holes similar to that in Example 12. The results are shown in Table 7. Further, the results of a brassiere cup molded from the obtained substrate are shown in Table 8.

Example 19

In the same manner as in Example 12 except for blending the thermal adhesive fiber under moisture and the potential crimping conjugated fiber at a proportion (mass ratio) (the former/the latter) of 5/95, a buffer substrate was obtained. The obtained substrate had holes similar to that in Example 12. The results are shown in Table 7. Further, the results of a brassiere cup molded from the obtained substrate are shown in Table 8.

Comparative Example 5

A commercially available soft urethane foam (manufactured by INOAC CORPORATION, "EFF", 20 mm in thickness) was subjected to a pressing with a metal mold having a brassiere cup configuration or shape for 180 seconds under the condition of a temperature of 180° C. and a pressure of 0.5 MPa to give a cup-like shape brassiere cup (diameter: 150 mmϕ, height: 60 mm). The results of the evaluation of the obtained cup are shown in Tables 7 and 8.

Comparative Example 6

Using a commercially available soft urethane foam (manufactured by INOAC CORPORATION, "SC", 20 mm in thickness), which was harder than the urethane foam in Comparative Example 5, a brassiere cup was obtained under the same condition as in Comparative Example 5. The evaluation results of the obtained brassiere cup are shown in Tables 7 and 8.

TABLE 5

| | Examples | | | | |
|---|---|---|---|---|---|
| | 12 | 13 | 14 | 15 | 16 |
| Average curvature radius (μm) | 102.7 | 98.9 | 115.4 | 99.1 | 110 |
| Curved ratio (surface) | 1.75 | 1.87 | 1.65 | 1.72 | 1.77 |
| Curved ratio (inside) | 1.48 | 1.82 | 1.47 | 1.61 | 1.51 |
| Curved ratio (backside) | 1.77 | 1.85 | 1.64 | 1.74 | 1.73 |
| Distribution of curved ratio (uniformity) (%) | 83.6 | 97.3 | 89.1 | 92.5 | 85.3 |
| Bonded fiber ratio (surface) (%) | 16.1 | 4.9 | 16.5 | 15.2 | 17.8 |
| Bonded fiber ratio (inside) (%) | 9.8 | 4.4 | 13.4 | 11.4 | 12.1 |
| Bonded fiber ratio (backside) (%) | 13.7 | 4.6 | 15.9 | 13.8 | 16.9 |
| Distribution of bonded fiber ratio (uniformity) (%) | 60.9 | 89.8 | 81.2 | 75 | 67.9 |
| Basic weight (g/m$^2$) | 424.7 | 470.7 | 405.6 | 224 | 504 |
| Thickness (mm) | 8.0 | 8.3 | 8.1 | 4.81 | 8.72 |
| Density (g/cm$^3$) | 0.053 | 0.057 | 0.050 | 0.059 | 0.058 |
| 25% Recovery stresses/compression stress ratio (%) | 33.6 | 18.1 | 55.5 | 16.8 | 35 |
| 25% Compression stress (N/30 mm) | 1.89 | 1.1 | 2.21 | 0.868 | 2.05 |
| 50% Compression stress (N/30 mm) | 4.66 | 4.21 | 4.88 | 4.19 | 5.16 |
| Compression ratio (%) | 64.9 | 69.8 | 61.3 | 57.4 | 74.9 |
| Elongation at break in MD (%) | 61 | 58 | 76 | 63 | 59 |
| Elongation at break in CD (%) | 130 | 135 | 156 | 130 | 141 |
| Stress after 30% elongation in MD (%) | 10.5 | 8.4 | 10.9 | 7.4 | 13.5 |
| Stress after 30% elongation in CD (%) | 10.1 | 6.8 | 10.3 | 7 | 12.6 |
| Air-permeability (ml/cm$^2$ · second) | 66 | 88 | 62 | 117 | 48 |
| Water retention ratio (wt %) | 2120 | 1170 | 2789 | 2005 | 2210 |
| Rate of water absorption (second) | 0 | 0 | 0 | 0 | 0 |
| Moisture-permeability (g/cm$^2$ · hr) | 284 | 370 | 276 | 416 | 259 |

TABLE 6

| | Examples | | | | |
|---|---|---|---|---|---|
| | 12 | 13 | 14 | 15 | 16 |
| Thickness (mm) | 4.55 | 4.68 | 4.34 | 3.81 | 5.6 |
| Density (g/cm$^3$) | 0.106 | 0.097 | 0.117 | 0.052 | 0.089 |
| Curved ratio (surface) | 2.62 | 2.77 | 2.47 | 2.67 | 2.68 |
| Curved ratio (inside) | 2.51 | 2.68 | 2.33 | 2.48 | 2.55 |
| Curved ratio (backside) | 2.71 | 2.72 | 2.48 | 2.63 | 2.71 |
| Distribution of curved ratio (uniformity) (%) | 92.6 | 96.8 | 94 | 92.8 | 95.1 |
| Bonded fiber ratio (surface) (%) | 23.2 | 7.3 | 24.3 | 32.1 | 34.6 |
| Bonded fiber ratio (inside) (%) | 19.7 | 5.8 | 21.5 | 27.1 | 29.7 |
| Bonded fiber ratio (backside) (%) | 20.7 | 6.8 | 26.3 | 29.9 | 32.2 |
| Distribution of bonded fiber ratio (uniformity) (%) | 84.9 | 79.5 | 81.7 | 84.4 | 85.8 |
| Pushing resilience (Before washing) | A | A | A | A | A |
| 7.5-mm recovery/compression stress ratio (%) | 30.2 | 31.8 | 46.6 | 22.5 | 32.1 |
| 7.5-mm compression stress (N/30 mm) | 1.26 | 0.66 | 1.78 | 0.77 | 1.43 |

TABLE 6-continued

| | Examples | | | | |
|---|---|---|---|---|---|
| | 12 | 13 | 14 | 15 | 16 |
| 15-mm compression stress (N/30 mm) | 2.11 | 0.92 | 3.79 | 1.74 | 2.92 |
| 7.5-mm recovery stress (N/30 mm) (After washing) | 0.38 | 0.21 | 0.83 | 0.19 | 0.46 |
| 7.5-mm recovery/compression stress ratio (%) | 26.3 | 28.3 | 37.2 | 20.3 | 30.8 |
| 7.5-mm compression stress (N/30 mm) | 0.88 | 0.47 | 1.34 | 0.54 | 1.07 |
| 15-mm compression stress (N/30 mm) | 1.97 | 0.62 | 2.01 | 0.745 | 4.05 |
| 7.5-mm recovery stress (N/30 mm) | 0.23 | 0.13 | 0.5 | 0.11 | 0.33 |
| Durability to washing (height retention) (%) | 91.1 | 85.3 | 92.6 | 78.2 | 93 |

TABLE 7

| | Examples | | Comparative Examples | |
|---|---|---|---|---|
| | 18 | 19 | 5 | 6 |
| Average curvature radius (μm) | 94 | 123 | — | — |
| Curved ratio (surface) | 1.83 | 1.59 | — | — |
| Curved ratio (inside) | 1.78 | 1.43 | — | — |
| Curved ratio (backside) | 1.91 | 1.61 | — | — |
| Distribution of curved ratio (uniformity) (%) | 93.2 | 88.8 | — | — |
| Bonded fiber ratio (surface) (%) | 4.9 | 16.8 | — | — |
| Bonded fiber ratio (inside) (%) | 4.1 | 13.0 | — | — |
| Bonded fiber ratio (backside) (%) | 4.3 | 15.3 | — | — |
| Distribution of bonded fiber ratio (uniformity) (%) | 83.7 | 77.4 | — | — |
| Basic weight (g/m$^2$) | 396 | 397 | 370 | 580 |
| Thickness (mm) | 8.8 | 4.32 | 20 | 20 |
| Density (g/cm$^3$) | 0.045 | 0.092 | 0.019 | 0.029 |
| 25% Recovery stresses/ compression stress ratio (%) | 11.4 | 45 | — | — |

TABLE 7-continued

| | Examples | | Comparative Examples | |
|---|---|---|---|---|
| | 18 | 19 | 5 | 6 |
| 25% Compression stress (N/30 mm) | 0.7 | 2.38 | — | — |
| 50% Compression stress (N/30 mm) | 3.6 | 5.77 | — | — |
| Compression ratio (%) | 52.5 | 77.1 | — | — |
| Elongation at break in MD (%) | 66 | 56.3 | — | — |
| Elongation at break in CD (%) | 142 | 124 | — | — |
| Stress after 30% elongation in MD (%) | 8.1 | 11.7 | — | — |
| Stress after 30% elongation in CD (%) | 6.3 | 10.8 | — | — |
| Air-permeability (ml/cm$^2$ · second) | 88 | 61 | 45 | 68 |
| Water retention ratio (wt %) | 1090 | 2920 | — | — |
| Rate of water absorption (second) | 0 | 0 | — | — |
| Moisture-permeability (g/cm$^2$ · hr) | 408 | 271 | — | — |

TABLE 8

| | Examples | | | Comparative Examples | |
|---|---|---|---|---|---|
| | 17 | 18 | 19 | 5 | 6 |
| Thickness (mm) | 4.87 | 4.73 | 4.22 | 4.55 | 4.77 |
| Density (g/cm$^3$) | 0.086 | 0.089 | 0.121 | 0.081 | 0.122 |
| Curved ratio (surface) | 2.74 | 2.63 | 2.27 | — | — |
| Curved ratio (inside) | 1.29 | 1.77 | 2.13 | — | — |
| Curved ratio (backside) | 2.52 | 2.71 | 2.33 | — | — |
| Distribution of curved ratio (uniformity) (%) | 47.1 | 65.3 | 91.4 | — | — |
| Bonded fiber ratio (surface) (%) | 23.9 | 8.3 | 26.9 | — | — |
| Bonded fiber ratio (inside) (%) | 13.1 | 5.1 | 24.1 | — | — |
| Bonded fiber ratio (backside) (%) | 27.4 | 8.0 | 26.1 | — | — |
| Distribution of bonded fiber ratio (uniformity) (%) | 47.8 | 61.4 | 89.6 | — | — |
| Pushing resilience (Before washing) | B | C | B | A | A |
| 7.5-mm recovery/compression stress ratio (%) | 23.6 | 26.2 | 48.1 | 54.2 | 51.6 |
| 7.5-mm compression stress (N/30 mm) | 3.22 | 0.38 | 1.92 | 0.96 | 2.44 |
| 15-mm compression stress (N/30 mm) | 4.28 | 0.43 | 2.21 | 1.72 | 1.26 |
| 7.5-mm recovery stress (N/30 mm) (After washing) | 0.76 | 0.1 | 0.924 | 0.52 | 4.12 |
| 7.5-mm recovery/compression stress ratio (%) | 14.8 | 22.1 | 33.7 | 50 | 46.1 |
| 7.5-mm compression stress (N/30 mm) | 0.27 | 0.236 | 1.42 | 0.68 | 2.06 |
| 15-mm compression stress (N/30 mm) | 0.46 | 0.052 | 2.02 | 1.15 | 3.48 |
| 7.5-mm recovery stress (N/30 mm) | 0.04 | 0.31 | 0.478 | 0.34 | 0.95 |
| Durability to washing (height retention) (%) | 44.3 | 21.4 | 96 | 94 | 96 |

As apparent from the results in Tables 5 to 8, each of the substrates and brassiere cups obtained in Examples had an excellent cushion property, a high air-permeability, a high capability of retaining water, and an excellent shape stability.

Example 20

A sheath-core structure conjugated staple fiber ("Sofista" manufactured by Kuraray Co., Ltd., having a fineness of 3 dtex, a fiber length of 51 mm, a sheath-core weight ratio of 50/50, a number of crimps of 21/25 mm, and a degree of crimp of 13.5%) was prepared as a thermal adhesive fiber under moisture. The above fiber comprised a poly(ethylene terephthalate) as a core component and an ethylene-vinyl alcohol copolymer (ethylene content of 44 mol % and degree of saponification of 98.4 mol %) as a sheath component.

This sheath-core structure conjugated staple fiber (a thermal adhesive fiber under moisture) was used, a card web having a basic weight of about 100 g/m$^2$ was produced by a carding process. Then four sheets of the card webs were put in layers to obtain a card web having a total basic weight of 400 g/m$^2$. This card web was treated with belt conveyors (upper and lower belt conveyers), each equipped with a 50-mesh stainless-steel endless metal net and having a width of 500 mm. The belt conveyers were independently revolved at the same speed in the same direction, and the clearance between both the metal nets was adjustable arbitrarily.

Then, the card web was introduced to a water vapor spraying apparatus disposed on the lower belt conveyor. This apparatus had a nozzle disposed thereon to pass a high-temperature water vapor at a pressure of 0.4 MPa through the card web in the thickness direction of the card web. The upper conveyor had a suction apparatus attached thereon. In a downstream side in the web traveling direction with respect to this spraying apparatus, another pair of a nozzle and a suction apparatus in inverse arrangement of the above pair was disposed. In this way, the both surfaces of the web were subjected to the water vapor treatment.

Incidentally, the water vapor spraying apparatus used had nozzles, each having a pore size of 0.3 mm, and these nozzles were arranged in a line parallel to the width direction of the conveyor in a pitch of 1 mm. The processing speed was 3 m/minute, and the clearance distance between the upper and lower conveyor belts was disposed was 10 mm. Each of the nozzles was disposed on the backside of the belt so that the nozzle almost contacted with the belt. The results are shown in Table 9.

Then, the obtained buffer substrate for a shoe was placed on a metal mold having a shape of a rubber sole part of a walking shoe. The metal mold had circular through-holes, each having a diameter of 1.6 mmϕ and disposed at a rate 0.3 pore/cm$^2$. A water vapor having a pressure of 0.1 MPa was jetted to the substrate for 5 seconds for pre-heating. With jetting the water vapor thereto, a pressing of the substrate was started under the condition of a temperature of 105° C. and a pressure of 0.5 MPa. After 30 seconds, the jetting of the water vapor was suspended while keeping the compression. Then, for 30 seconds, the water vapor was sucked from the surface from which the water vapor had been jetted. In this manner, the substrate was molded into a shoe insole shape. The obtained shoe insole reproduced or duplicated a fine configuration or shape of the metal mold and was in a good molded state. A rim of this molded product was cut off along the form of a shoe insole to obtain a shoe insole. The obtained shoe insole was put in a walking shoe, and a pair of the shoes was worn for 8 hours to conduct sensory evaluations for foot comfort, cushion property, and sense of humidity. The evaluation results were excellent. The evaluation results of the obtained insole are shown in Table 10.

Example 21

A side-by-side structure conjugated staple fiber ("PN-780", manufactured by Kuraray Co., Ltd., having a fineness of 1.7 dtex, a fiber length of 51 mm, a number of mechanical crimps of 12/25 mm, and a number of crimps of was 62/25 mm after a heat treatment at 130° C. for 1 minute) was prepared as a potential crimping conjugated fiber. The conjugated fiber comprised a poly(ethylene terephthalate) resin (A component) having an intrinsic viscosity of 0.65 and a modified poly(ethylene terephthalate) resin (B component). The B component was a polyethylene terephthalate) resin modified or copolymerized with 20 mol % of isophthalic acid and 5 mol % of diethylene glycol as copolymerizing components.

The sheath-core structure conjugated staple fiber (the thermal adhesive fiber under moisture) in Example 20 and the side-by-side structure conjugated staple fiber (the potential crimping conjugated fiber) were blended with each other in a mass ratio (the former/the latter) of 30/70. Thereafter, a card web was produced by a carding process. In the same manner as in Example 20 except for the clearance (distance) between the upper (nozzle side) and lower (suction side) conveyer belts of 10 mm in a high-temperature water vapor treatment, a buffer substrate was obtained. The results are shown in Table 9. The results of a shoe insole molded from the obtained substrate are shown in Table 10. The shoe insole was evaluated as in Example 20, and the results were excellent.

Example 22

In the same manner as in Example 21 except for blending the thermal adhesive fiber under moisture and the potential crimping conjugated fiber with each other in the proportion (mass ratio)(the former/the latter) of 10/90, a buffer substrate was obtained. The results are shown in Table 9. Moreover, the results of a shoe insole molded from the obtained substrate are shown in Table 10. The shoe insole was evaluated as in Example 20, and the results were excellent.

Example 23

In the same manner as in Example 21 except for blending the thermal adhesive fiber under moisture and the potential crimping conjugated fiber with each other in the proportion (mass ratio)(the former/the latter) of 40/60, a buffer substrate was obtained. The results are shown in Table 9. Moreover, the results of a shoe insole molded from the obtained substrate are shown in Table 10. The shoe insole was evaluated as in Example 20, and the results were excellent.

Comparative Example 7

Under the same condition as in Example 20 except for the a molding temperature of 120° C. and using a laminate of four sheets of the nonwoven fabrics obtained in Comparative Example 4, the laminate was molded and cut into a shoe insole. The obtained shoe insole had an insufficient cushion property. The results are shown in Table 10.

TABLE 9

| | Examples | | | |
|---|---|---|---|---|
| | 20 | 21 | 22 | 23 |
| Average curvature radius (μm) | — | 103 | 97 | 127 |
| Curved ratio (surface) | 1.17 | 1.71 | 1.88 | 1.69 |
| Curved ratio (inside) | 1.09 | 1.46 | 1.81 | 1.53 |
| Curved ratio (backside) | 1.21 | 1.79 | 1.92 | 1.77 |
| Distribution of curved ratio (uniformity) (%) | 90.1 | 81.6 | 94.3 | 86.4 |
| Bonded fiber ratio (surface) (%) | 23.2 | 15.3 | 5.2 | 16.2 |
| Bonded fiber ratio (inside) (%) | 18.8 | 9.5 | 4.9 | 12.3 |
| Bonded fiber ratio (backside) (%) | 22.1 | 13.1 | 5.6 | 14.8 |
| Distribution of bonded fiber ratio (uniformity) (%) | 81.0 | 62.1 | 87.5 | 75.9 |
| Basic weight (g/m$^2$) | 532.6 | 467.4 | 394.1 | 426.3 |
| Thickness (mm) | 5.39 | 9.5 | 11.2 | 8.1 |
| Density (g/cm$^3$) | 0.098 | 0.049 | 0.035 | 0.053 |
| 25% Recovery stresses/ compression stress ratio (%) | 78 | 38 | 16 | 42 |
| 25% Compression stress (N/30 mm) | 28.5 | 1.9 | 0.9 | 2.7 |
| 50% Compression stress (N/30 mm) | 90.5 | 4.6 | 3.8 | 4.8 |
| Compression ratio (%) | 92 | 65 | 77 | 56 |
| Elongation at break in MD (%) | 31 | 53 | 48 | 82 |
| Elongation at break in CD (%) | 78 | 132 | 128 | 171 |
| Stress after 30% elongation in MD (%) | 46.3 | 10.2 | 8.7 | 10.7 |
| Stress after 30% elongation in CD (%) | 34.2 | 9.9 | 6.1 | 10.2 |
| Air-permeability (ml/cm$^2$ · second) | 21 | 65 | 94 | 56 |
| Moisture-permeability (g/cm$^2$ · hr) | 129 | 281 | 361 | 274 |
| Rate of water absorption (second) | 0 | 0 | 0 | 0 |

TABLE 10

| | Examples | | | | Comparative Example |
|---|---|---|---|---|---|
| | 20 | 21 | 22 | 23 | 7 |
| Foot comfort | good | good | good | good | hard surface, uncomfortable |
| Cushion property | good | good | good | good | poor |
| Sense of humidity | no | no | no | no | sticky, very humid |

As apparent from the results in Tables 9 and 10, each of the buffer substrates and shoe insoles obtained in Examples had a high air-permeability and moisture-permeability and an excellent shape stability as well as an excellent cushion property.

The invention claimed is:

1. A buffer substrate comprising a nonwoven fiber assembly which comprises a fiber comprising a moistenable-thermal adhesive fiber and a conjugated fiber comprising a plurality of resins which are different in thermal shrinkage and form a phase separation structure, in which the fibers constituting the nonwoven fiber assembly are entangled with each other and bonded at contacting points by melting the moistenable-thermal adhesive fiber to distribute the bonded points approximately uniformly, wherein a bonded fiber ratio is from 3 to 30% in each of three areas and the proportion of the minimum value relative to the maximum value among the bonded fiber ratios in each of the three areas is not less than 50%, providing that the three areas are obtained by cutting the buffer substrate in the thickness direction to give a cross section and dividing the cross section in a direction perpendicular to the thickness direction equally into three, wherein the bonded fiber ratio represents the proportion of the number of cross sections of bonded fibers relative to the total number of cross sections of fibers as determined from a microphotograph of a cross section with respect to the thickness direction of the nonwoven fiber assembly, wherein the bonded fibers means fibers which are still contacted with each other as observed on said microphotograph, wherein a curved ratio of the conjugated fiber is not less than 1.3 in each of three areas and the proportion of the minimum value relative to the maximum value among the curved ratios in each of the three areas is not less than 75%, providing that the three areas are obtained by cutting the buffer substrate in the thickness direction to give a cross section and dividing the cross section in a direction perpendicular to the thickness direction equally into three, wherein the curved ratio represents a ratio (L2/L1) of a fiber length (L2) of the crimped fiber relative to a length between the both ends of the crimped fiber (L1).

2. A buffer substrate according to claim 1, wherein the conjugated fibers have approximately uniform crimps having an average curvature radius of 20 to 200 μm and are entangled with the fibers constituting the nonwoven fiber assembly.

3. A buffer substrate according to claim 1, wherein the moistenable-thermal adhesive fiber is a sheath-core structure conjugated fiber which comprises a sheath comprising an ethylene-vinyl alcohol-series copolymer and a core comprising a polyester-series resin.

4. A buffer substrate according to claim 2, wherein the conjugated fiber comprises a poly(alkylene arylate)-series resin and a modified poly(alkylene arylate)-series resin and has a side-by-side structure or an eccentric sheath-core structure.

5. A buffer substrate according to claim 2, wherein the mass ratio of the moistenable-thermal adhesive fiber relative to the conjugated fiber is 90/10 to 10/90.

6. A buffer substrate according to claim 1, wherein the apparent density is from 0.01 to 0.2 g/cm$^3$.

7. A buffer substrate according to claim 1, wherein the air-permeability is from 0.1 to 300 cm$^3$/(cm$^2$·second) in accordance with a Frazier tester method, and a cushion property is not less than 10%, wherein the cushion property is represented by a ratio of a recovery stress (Y) relative to a compression stress (X) based on a hysteresis loop of a behavior in 50% compression and recovery after the compression (50% compression recovery behavior) in accordance with JIS K6400-2, and the compression stress (X) is a stress at 25% compression in an initial 50% compression behavior, and the recovery stress (Y) is a stress at 25% compression in returning (recovering) behavior after 50% compression.

8. A buffer substrate according to claim 1, which has a sheet or plate form and an approximately uniform thickness.

9. A buffer substrate according to claim 8, wherein the fibers constituting the nonwoven fiber assembly are oriented in a direction approximately parallel to a surface direction of the buffer substrate.

10. A buffer substrate according to claim 9, which has a plurality of areas comprising a large amount of the fibers oriented in the thickness direction of the buffer substrate, wherein the plurality of areas are arranged regularly in the surface direction of the buffer substrate.

11. A cushion comprising a buffer substrate according to claim 1.

12. A cushion according to claim 11, wherein the apparent density of the buffer substrate is from 0.02 to 0.2 g/cm$^3$.

13. A method for producing a buffer substrate recited in claim 1, comprising:

(a) forming a web from a fiber comprising a moistenable-thermal adhesive fiber; and (b) subjecting the obtained fiber web to a heat and moisture treatment with a high-temperature water vapor to melt the moistenable-thermal adhesive fiber for bonding the fibers.

14. A method for producing a buffer substrate recited in claim 2, comprising:

(c) forming a web from a fiber comprising a moistenable-thermal adhesive fiber and a conjugated fiber comprising a plurality of resins which are different in thermal shrinkage and form a phase separation structure; and (d) subjecting the obtained fiber web to a heat and moisture treatment with a high-temperature water vapor to melt the moistenable-thermal adhesive fiber for bonding the fibers and to develop a crimp of the conjugated fiber.

15. A method according to claim 13, further comprising subjecting a plurality of regularly arranged areas of a surface of the fiber web to a treatment to change the orientation directions of the fibers prior to conducting (b).

16. A method according to claim 14, further comprising subjecting a plurality of regularly arranged areas of a surface of the fiber web to a treatment to change the orientation directions of the fibers prior to conducting (d).

* * * * *